US006653042B1

(12) United States Patent
Fukino et al.

(10) Patent No.: US 6,653,042 B1
(45) Date of Patent: Nov. 25, 2003

(54) LITHOGRAPHIC PRINTING PLATE PRECURSOR, METHOD FOR PRODUCING THE SAME, AND METHOD OF LITHOGRAPHIC PRINTING

(75) Inventors: Kiyotaka Fukino, Shizuoka (JP); Keiji Akiyama, Shizuoka (JP); Shunsaku Higashi, Shizuoka (JP); Satoshi Hoshi, Shizuoka (JP)

(73) Assignee: Fuji Photo Film Co., Ltd., Minami Ashigara (JP)

( * ) Notice: Subject to any disclaimer, the term of this patent is extended or adjusted under 35 U.S.C. 154(b) by 0 days.

(21) Appl. No.: 09/585,355

(22) Filed: Jun. 2, 2000

(30) Foreign Application Priority Data

Jun. 4, 1999 (JP) ..... 11-158697
Aug. 18, 1999 (JP) ..... 11-231627

(51) Int. Cl.[7] ..... G03F 7/038

(52) U.S. Cl. ..... 430/270.1; 430/273.1; 430/138; 430/302; 430/348; 430/494; 430/944

(58) Field of Search ..... 430/270.1, 273.1, 430/302, 303, 138, 348, 944, 945, 964

(56) References Cited

U.S. PATENT DOCUMENTS 3,476,937 A * 11/1969 Vrancken ..... 250/315.3
4,973,572 A * 11/1990 DeBoer et al. ..... 503/227
5,569,573 A * 10/1996 Takahashi et al. ..... 430/138
5,816,162 A * 10/1998 Vermeersch ..... 101/467
5,858,606 A 1/1999 Meisters et al.
5,919,600 A * 7/1999 Huang et al. ..... 430/272.1
5,948,591 A * 9/1999 Vermeersch et al. ..... 430/270.1
5,952,136 A * 9/1999 Daems et al. ..... 430/22
5,981,144 A * 11/1999 Damme et al. ..... 430/271.1
5,998,095 A * 12/1999 Nagase ..... 430/273.1
6,004,728 A * 12/1999 Deroover et al. ..... 430/302
6,014,390 A 1/2000 Joyner ..... 372/20
6,022,667 A * 2/2000 Vermeersch et al. ..... 430/271.1
6,106,996 A * 8/2000 Van Damme et al. ... 430/271.1
6,110,644 A * 8/2000 Vermeersch et al. ..... 430/302
6,124,079 A * 9/2000 Vermeersch et al. ..... 430/303
6,153,353 A * 11/2000 Van Damme et al. ... 430/270.1
6,197,478 B1 * 3/2001 Vermeersch et al. ..... 430/272.1
6,207,348 B1 * 3/2001 Deboer et al. ..... 430/303
6,230,621 B1 * 5/2001 Verschueren et al. ..... 101/453
6,232,034 B1 * 5/2001 Kasai et al. ..... 430/270.1
6,238,838 B1 * 5/2001 Gaschler et al. ..... 430/278.1
6,258,512 B1 * 7/2001 Kasai et al. ..... 430/302
6,300,032 B1 * 10/2001 Van Damme et al. ..... 430/188
6,427,595 B1 * 8/2002 Van Damme et al. ..... 101/457
6,455,222 B1 * 9/2002 Fukino et al. ..... 430/270.1
2001/0036592 A1 * 11/2001 Hoshi et al. ..... 430/270.1

FOREIGN PATENT DOCUMENTS

EP 0770494 5/1997
EP 0849091 6/1998
EP 0 925 916 A1 6/1999
EP 0949088 10/1999
WO WO 94/18005 8/1994
WO WO 94/23954 10/1994

OTHER PUBLICATIONS

Vermeersch, J., "A Lithographic Printing Plate." 2/ Research Disclosure, 33303, Jan. 1992.

* cited by examiner

*Primary Examiner*—Janet Baxter
*Assistant Examiner*—Barbara Gilliam
(74) *Attorney, Agent, or Firm*—Burns, Doane, Swecker & Mathis, LLP

(57) ABSTRACT

A lithographic printing plate precursor which comprises a support having provided thereon a layer comprising a hydrophilic medium, wherein the layer comprising a hydrophilic medium contains a hydrophobitization precursor having a hydrophilic surface and a light/heat converting agent which is hydrophilic in itself, or at least on the surface.

6 Claims, 1 Drawing Sheet

LITHOGRAPHIC PRINTING PLATE PRECURSOR, METHOD FOR PRODUCING THE SAME, AND METHOD OF LITHOGRAPHIC PRINTING

FIELD OF THE INVENTION

The present invention relates to a direct heat-sensitive lithographic printing plate precursor for offset printing which requires no development and is excellent in press life, a negative type non-processing lithographic printing plate precursor and a method for producing the same, and a method for lithographic printing using the same. More specifically, the present invention relates to a lithographic printing plate precursor or a negative type non-processing lithographic printing plate precursor and a method for producing the same which can be produced by heat mode image recording, is capable of image-recording by scanning exposure based on digital signals, can be developed with water, or is loadable on a printer without development and printing can be performed as it is, and a method for lithographic printing.

BACKGROUND OF THE INVENTION

A lithographic printing plate generally comprises a lipophilic image area which receives an ink during printing and a hydrophilic non-image area which receives fountain solution. As such a lithographic printing plate precursor, a PS plate (presensitized plate) comprising a hydrophilic support having provided thereon a lipophilic photosensitive resin layer has so far been widely used. A plate-making method of a lithographic printing plate precursor generally comprises performing exposure through the image of a developed lith film and the like and then dissolving and removing a non-image area with a developing solution to thereby obtain a printing plate.

The conventional plate-making process of a PS plate is accompanied by the wet operation of dissolution and removal of a non-image area after exposure, and it has been desired to cease to use or simplify such a wet process. In particular in recent years, since the disposal of waste solutions which are discharged as a result of the wet process not only imposes economical load on the industry but also has become a great concern in the industry at large from the standpoint of global environmental protection, there is an increased demand for the improvement in this aspect.

As one simple plate-making method which meets the above demand, there has been suggested a method of using an image-recording layer by which the removal of the non-image area of a printing plate precursor can be performed in usual printing process, and effecting development after exposure on a printer, to thereby obtain a final printing plate. A system of plate-making of a lithographic printing plate by such a method is called an on-press developing system. Specifically, for example, a method of using an image-recording layer soluble in a fountain solution and an ink solvent, and a method of conducting mechanical removal of a non-image area by contact with the impression drum and the blanket drum in a printer can be exemplified. However, a big problem of the on-press developing system is that complicated means should be taken such that a printing plate precursor must be stored under a completely light-shielded state or under a constant temperature condition during the period of time until the printing plate is loaded on a printer because an image-recording layer is not fixed after exposure.

On the other hand, as another trend in this field, digitized techniques of electronically processing, accumulating and outputting image data using a computer have prevailed, and various image output systems corresponding to these digitized techniques have been put to practical use. As one example of such techniques, a computer-to-plate technique directly making a printing plate is attracting public attention, which comprises scanning exposing a printing plate precursor with high convergent radiant rays such as laser beams carrying digitized image data without using a lith film. With such a tendency, it has become an important technical subject to obtain the printing plate precursor well adapted to this purpose.

Accordingly, the simplification of plate-making and the realization of dry system and non-processing system have been further strongly desired from both aspects of the above-described environmental protection and the adaptation for digitization.

Solid state lasers having high output, e.g., a semiconductor laser and a YAG laser are inexpensively available in recent years. As a result, as a producing method of a printing plate by scanning exposure which is easy to be incorporated in a digitized technique, a plate-making method using these lasers as an image-recording means is promising. In conventional plate-making methods, image-recording is performed by imagewise exposing a photosensitive printing plate precursor in low to middle degree to cause the change of physical properties of the image on the surface of the precursor by a photochemical reaction. On the other hand, in a method of using the exposure of high power density by a high output laser, a large quantity of light energy is irradiated on an exposure region convergently during a momentary exposure time, the light energy is efficiently converted to heat energy to cause a chemical change, a phase change, or a thermal change such as the change and rupture of form and structure due to the heat, and that change is utilized in image-recording. That is, image data are inputted by light energy such as laser light, but image-recording is performed by the reaction due to heat energy. This recording system making use of heat generation by high power density exposure is generally called heat mode recording and converting light energy to heat energy is called light/heat conversion.

A big advantage of a plate-making method utilizing a heat mode recording means is that a material is not sensitive to light of general illuminance level, such as room illumination, and images recorded by high illuminance exposure do not necessitate fixation. That is, when a heat mode material is used in image-recording, the material is safe to room light before exposure and fixation of the image after exposure is not essential. Accordingly, for example, when an image-recording layer which is insolubilized or solubilized by heat mode exposure is used in a plate-making process of imagewise removing an exposed image-recording layer to make a printing plate by the on-press developing system, it becomes possible to realize a printing system in which an image is not influenced even when the development (the removal of a non-image area) is exposed to atmospheric light in a room for a certain period of time after image exposure.

Accordingly, if heat mode recording is utilized, it is expected that it will be possible to obtain a lithographic printing plate precursor which is adapted to the on-press developing system, in particular, easily developed to a computer-to-plate system.

As one means of heat mode system which has been advanced as a measure against the simplification of plate-making process, a technique of microencapsulation has been considered.

Plate materials comprising a support having provided thereon a heat-sensitive recording layer comprising a microencapsulated heat-melting substance and a binder resin, wherein a heated part is converted to a lipophilic part, are disclosed in JP-A-3-108588 and JP-A-5-8575 (the term "JP-A" as used herein means an "unexamined published Japanese patent application"). However, since any of the microencapsulated heat-melting substances disclosed in these patents does not have reactivity with the medium, the diffusibility is large and satisfactory discrimination cannot be obtained. On the other hand, lithographic printing plate precursors comprising a support having a hydrophilic surface having provided thereon a recording layer containing an active hydrogen-containing binder polymer together with block isocyanate, and methods for producing the same are disclosed in JP-A-62-164596 and JP-A-62-164049. However, these printing plate materials necessitate the development process to remove a non-printing part after printing.

Further, as one direct type lithographic printing plate material, there is a direct drawing type lithographic printing plate material, wherein an image area is formed on the surface of a hydrophilic layer by external means such as ink jet and toner transfer, and a trial to incorporate a microencapsulation technique to these techniques has been performed. A printing plate material comprising coating a microencapsulated non-reactive heat-melting substance and forming a toner-receiving layer by heat printing is disclosed in JP-A-62-1587. However, this material becomes a printing plate for the first time when a lipophilic toner, etc., are fixed on the formed toner-receiving layer and not an image area is formed after printing.

JP-A-7-1849 discloses a technique which contrives to improve the press life of a printing plate by adopting the mechanism that a lipophilic component in a capsule and a hydrophilic binder polymer bring about chemical bond at the interface between a microcapsule and a binder to thereby suppress swelling. This printing plate precursor certainly meets the demand of the market but since the technique is a system of causing heat rupture of the capsule by means of a thermal head, and then forming an ink-receiving area by the reaction of the lipophilic substance with the binder, enlarging of a hydrophobic area due to the diffusion of the lipophilic substance is expected, therefore, not suitable for highly precise imaging.

As has been described above, even when a technique of microencapsulation was employed, various drawbacks as to conventional materials for a heat-sensitive lithographic printing plate such that press life, discriminability and lipophilicity were unsatisfactory have not been dissolved, therefore, the use has been limited to light scale printing.

As one preferred plate-making method of lithographic printing plate based on heat mode recording, a method has been suggested which comprises providing a hydrophobic image-recording layer on a hydrophilic substrate, imagewise exposing the hydrophobic layer by heat mode exposure to change the solubility and dispersibility of the hydrophobic layer, and, if necessary, removing the non-image area by wet development.

As an example of such a printing plate precursor, there is disclosed in JP-B-46-27919 (the term "JP-B" as used herein means an "examined Japanese patent publication") a method for obtaining a printing plate by heat mode recording a plate precursor comprising a hydrophilic support having provided thereon a recording layer showing a so-called positive function, i.e., whose solubility is improved by heat, specifically a recording layer having a specific composition such as saccharides and melamine-formaldehyde resins. Since disclosed simple plate-making techniques of heat mode recording including the above method are generally not sufficient in heat sensitivity, sensitivity is extremely insufficient for heat mode scanning exposure. Accordingly, the discrimination of hydrophobicity/hydrophilicity of the irradiated part and the non-irradiated part, i.e., the discrimination of an image area and a non-image area, is small, which has been the restriction in practical use. When the discrimination is insufficient, plate-making according to the on-press developing system is substantially difficult.

As the means to solve that problem, methods to remove the image layer at the irradiated part by heat splashing due to the work of heat by high output laser beam irradiation (called abrasion) are disclosed, e.g., in WO 98/40212, WO 98/34796 and JP-A-6-199064, specifically lithographic printing plate precursors capable of plate-making without performing development which comprise a hydrophilic layer containing transition metallic oxide colloid as the upper layer and a lipophilic image-recording layer as the lower layer are disclosed. The discriminability of the irradiated part and the non-irradiated part where heat splashing has been completely performed is certainly large according to these methods, but there are other problems that the printer is stained by the splashed matter, the stain on the printing plate surface impairs the operation of the printer and printing quality, in addition, the heat of the irradiated light often does not reach the deep part of the image-recording layer, as a result, the bottom part of the image-recording layer near the support is not splashed and remains, i.e., the phenomenon called a residual film is brought about. The substantial discriminability cannot be exhibited due to the residual film, which leads to the reduction of printing quality.

As is the situation, as a method not accompanied by such drawbacks, there are disclosed simple plate-making methods making use of the change of the degree of hydrophilicity/hydrophobicity of the surface by heat, i.e., the change of polarity, not according to abrasion even when an image is formed by heat mode light irradiation. For example, methods comprising adding a thermoplastic polymer such as hydrophobic wax and polymer latex to a hydrophilic layer and hydrophobitizing by phase separation to the surface by heat are disclosed in JP-A-58-199153 and U.S. Pat. No. 3,168,864. These techniques suggest a direction of the improving means of discriminability. However, since these disclosed techniques are insufficient in discriminability and there is apprehension about smearing (i.e., staining) of printed matter due to, in particular, insufficient hydrophilicity, the improvement is desired.

Sufficient discrimination of an image area and a non-image area is a fundamental important characteristic directly linked with the improvement of printing quality and press life, hence the development of a plate-making method having discriminating property and easiness of print-making operation, in particular, a method having high discriminating property, high sensitivity, necessitating no development process and capable of heat mode plate-making is desired.

Heat hydrophobitization by heat mode recording has been tried. For example, printing plate materials comprising a support having provided thereon a heat-sensitive layer are disclosed in JP-A-53-64747 and JP-A-1-113290, wherein plate-making is performed by heat printing and melting a heat-melting resin and a thermoplastic resin dispersed in the heat-sensitive layer, and the heated part is converted from hydrophilic to lipophilic, and U.S. Pat. Nos. 4,034,183 and 4,063,949 disclose printing plate materials (i.e., precursors), wherein a hydrophilic polymer provided on a support is irradiated with laser beams to dismiss hydrophilicity and convert to hydrophobicity (i.e., lipophilicity). However, these materials have a drawback that a non-image area is smeared (i.e., stained) since the heat-melting substance on the plate surface is ink-receptive, therefore, the discrimination of an image area and a non-image area is low.

On the other hand, a lithographic printing plate precursor comprising a support having provided thereon a hydrophilic crosslinking layer and a lipophilic light/heat conversion layer, which requires no development for plate-making, is disclosed in EP 94/18005. However, the plate-making necessitates the operation of taking the crosslinked hydrophilic layer away, therefore, it is thought that there is a problem in the point of simplicity.

Further, a lithographic printing plate precursor comprising a support having provided thereon a hydrophilic layer containing metallic oxide colloid and a lipophilic image-recording layer containing a light/heat conversion substance and requiring no development for plate-making is disclosed in WO 98/40212. However, at least the present inventors have thought that there are many problems to be solved to secure the discriminability of an image area and a non-image part when a light/heat conversion layer is lipophilic.

A lithographic printing plate precursor comprising a support having provided thereon a hydrophilic image-recording layer containing a light convertible and ink-receptive light-absorbing substance, e.g., a dye and a pigment, and a colloidal dispersion of metal or metallic oxide and requiring no development for plate-making is disclosed in WO 99/04974, but as the examples of the specific light/heat converting agent, there are merely disclosed two kinds of light-absorbing cationic dyes and carbon black.

Lithographic printing plate precursors by laser beam recording are disclosed in JP-A-6-199064 and WO 98/40212, which comprise two-layer constitution using in combination of a layer containing a light/heat converting agent and a layer differing in the degree of hydrophilicity/hydrophobicity from the above layer. These techniques suggest the way to advance further improvement.

Further, as another big problem in conventional heat mode positive system printing plate precursors, there is the phenomenon called a residual film in a non-image area. That is, the defect that the change in solubility in a recording layer by exposure is small in the vicinity of a support as compared with that in the vicinity of the surface of a recording layer to leave a film substance which is not dissolved and removed is liable to occur and the improvement of this point has been required. In general, in a heat mode positive type printing plate precursor, the heat generation by heat mode exposure is based on the light absorption of the light absorbing substance in a recording layer, hence the generated amount of heat is liable to be large on the surface of a recording layer and small in the vicinity of a support. Therefore, the degree of hydrophilization of a recording layer in the vicinity of a support relatively decreases. As a result, a hydrophobic film is often not removed completely and remains as it is at an exposed part which is substantially to provide a hydrophilic surface. Such a residual film on a non-image area generates smearing on prints. Conventionally used separate function type multilayer structures comprising a light/heat conversion layer and an image-recording layer are disadvantageous in this point.

As is shown in the above-described details of the plate-making/printing technique according to heat mode image-recording, the characteristic advantage of this plate-making/printing technique is that a printing plate can be made directly from a block copy requiring no film, hence on-press plate-making without developing operation is possible. On the other hand, this technique has drawbacks that heat mode sensitivity is insufficient, an image-forming substance is diffused by heat, and the sensitivity is different at a surface area and a bottom area of the image recording layer. These drawbacks are the defects which fundamentally bring about the deficiency of the discriminating property of an image area and a non-image part, hence these are also the defects which directly lead to printing quality and press life. Accordingly, a fundamental means to improve both printing quality and press life of a plate-making/printing method utilizing heat mode image-recording is exclusively to improve the discriminating property. It is expected that the solution of the discriminating property naturally leads to the solution of the above-described other various defects.

SUMMARY OF THE INVENTION

An object of the present invention is to provide, by solving the above defects of heat mode plate-making methods using laser beams, etc., a heat mode type lithographic printing plate precursor capable of plate-making after short time scanning exposure without performing development process, excellent in press life, and generating no smearing (i.e., no staining) on a printing plate surface.

Another object of the present invention is to provide a heat mode type lithographic printing plate precursor which is excellent in the discriminating property of an image area and a non-image area, from the viewpoint of the specific means for improving both press life and the prevention of printing smearing.

A further objects of the present invention are to solve the above-described defects of heat mode plate-making systems and improve printing performance, i.e., to provide a heat mode type (negative) lithographic printing plate precursor capable of easily plate-making, capable of being loaded directly on a printer and plate-making, excellent in press life, and hardly generating smearing on a printing plate surface, to provide a method for producing the same, and to provide a method of lithographic printing using the same.

In particular, an object of the present invention is to provide a heat mode type lithographic printing plate precursor capable of easily plate-making according to scanning type image exposure by a laser beam and excellent in discriminating property of an image area and a non-image area.

The present inventors thought that the key to the solution of the above problems is to find a novel means to give the maximum change from hydrophilicity to hydrophobicity by imagewise light irradiation. As a result of earnest investigation, the present inventors have found the new principle of revealing discriminating property, and the present invention has been attained based on the principle.

In addition, concerning the above objects, the present inventors paid attention to conspicuous ink receptivity (hydrophobicity) and mechanical strength (press life) of a continuous phase metal surface, and as a result of the eager search for the means of imagewise distributing a metal layer on a hydrophilic surface, the present inventors obtained the idea of forming a metal-fused layer by heat and repeated examinations, thus the present invention has been achieved.

That is, the embodiments and the preferred embodiments of the present invention are as follows.

(1) A lithographic printing plate precursor which comprises a support having provided thereon a layer comprising a hydrophilic medium, wherein the layer comprising a hydrophilic medium contains a hydrophobitization precursor having a hydrophilic surface and a light/heat converting agent which is hydrophilic in itself, or at least on the surface.

(2) The lithographic printing plate precursor as described in the above item (1), wherein the layer comprising a hydrophilic medium is sol/gel convertible.

(3) The lithographic printing plate precursor as described in the above item (1) or (2), wherein the hydrophobitization precursor having a hydrophilic surface is a particle dispersion of composite constitution containing a hydrophobic substance at the core part and having a surface layer of superficial hydrophilicity.

(4) The lithographic printing plate precursor as described in the above item (1), (2) or (3), wherein the light/heat converting agent is a solid fine particle selected from the group consisting of a metal, a metallic compound, a pigment and a carbon simple substance each having a hydrophilic surface, or a hydrophilic dye which is soluble in a hydrophilic medium.

(5) The lithographic printing plate precursor as described in the above item (1), (2), (3) or (4), wherein the printing plate precursor is provided with a water-soluble protective layer.

(6) A method of lithographic printing which comprises imagewise irradiating the lithographic printing plate precursor described in any of the above items (1) to (5) with light/heat convertible visible rays or infrared rays, bringing the irradiated part into contact with an ink to make the image area accept the ink to form a printing plate surface, and performing printing.

The embodiments and the preferred embodiments of the present invention are further described below.

(7) A lithographic printing plate precursor, which comprises a hydrophobic area imagewise formed by imagewise irradiating the printing plate precursor containing particles having hydrophilic surfaces carrying a metallic fine piece (sometimes, called a metallic dust) by heat mode exposure of light and thermo-fusing the metallic fine piece on the irradiated part.

(8) The lithographic printing plate precursor as described in the above item (7), wherein the particles having hydrophilic surfaces carrying a metallic fine piece are the surfaces of a metallic compound having photocatalytic property.

(9) The lithographic printing plate precursor as described in the above item (7), wherein the particles having hydrophilic surfaces carrying a metallic fine piece are the surfaces of a metallic compound sparingly soluble in water.

(10) A method for producing a lithographic printing plate precursor which comprises performing imagewise irradiation of heat mode light exposure on the printing plate precursor containing superficially hydrophilic particles carrying a metallic fine piece, and thermo-fusing the metallic fine piece on the irradiated part to thereby form an imagewise ink-receptive hydrophobic area.

(11) A method of lithographic printing which comprises performing imagewise irradiation of heat mode light exposure on the printing plate precursor containing superficially hydrophilic particles carrying a metallic fine piece on the surfaces, and thermo-fusing the metallic fine piece on the irradiated part to form a hydrophobic area of an imagewise metal thin layer, thus the imagewise hydrophobic area forms an ink-receptive printing surface.

The fundamental of the present invention is the discovery of the principle that the surface of a printing plate precursor should be sufficiently hydrophilic for exhibiting the discriminating effect of an image area and a non-image area after plate-making to the best of the ability, which contributes to increase the difference between the hydrophobicity and hydrophilicity of an irradiated part and a non-irradiated part, and insufficient hydrophilicity of the surface of a printing plate precursor cannot be compensated for by the reinforcement of the hydrophobicity in an irradiated part. Based on the principle, the present invention makes it a fundamental constitution that all of the constitutional elements of an image-recording layer provided on a support, i.e., the medium of an image-recording layer, the surface of a hydrophobitization precursor, and a light/heat converting agent itself, or the surfaces of a light/heat converting agent when it takes the form of particles are hydrophilic. When the image-recording layer of such constitution is imagewise irradiated, the light/heat converting agent generates heat, the hydrophobitization precursor makes the vicinities hydrophobic by the heat, and the hydrophobicity of the image area formed exhibits apparent discriminability between the hydrophilicity of the non-image area, which becomes the key to increasing the ink-repellency of the non-image area to prevent printing smearing and improving the press life when a printing plate is formed.

In the present invention, it is devised to hydrophilize each constitutional element of the image-recording layer to meet the fundamental.

In the first place, with respect to the medium, highly hydrophilic media are sol/gel convertible media, in particular, sol/gel convertible media which are converted from metallic oxide sol to metallic oxide gel structure by dehydration condensation represented by sol/gel conversion system of silanol/siloxane described later are preferred.

To further improve the hydrophilicity of the image-recording layer, it is effective to incorporate colloidal dispersion selected from the group consisting of highly hydrophilic silica, silicon hydroxide, aluminum hydroxide, aluminum oxide, titanium oxide and titanium hydroxide into sol/gel convertible hydrophilic media.

In the next place, hydrophobitization precursors having hydrophilic surfaces are (1) a precursor which is a dispersion of particles of composite constitution containing a hydrophobic substance at the core part and having a surface layer of superficial hydrophilicity, and the incorporated hydrophobic substance makes the vicinities hydrophobic due to the work of heat by light irradiation and light/heat conversion, and (2) a precursor which is a dispersion of particles having hydrophilic surface and heat-crosslinkable and exhibits hydrophobicity by the initiation of a crosslinking reaction due to the work of heat.

As the preferred forms of the former dispersion of particles of composite constitution, the following can be exemplified:

(1) So-called hetero coagulation particles containing a thermoplastic resin which softens or melts by the temperature of heat mode image exposure and hydrophilic sol particle layers coagulated and adhered on the surfaces, (2) Hydrophilization treated particles containing a thermoplastic resin which softens or melts by the temperature of heat mode image exposure and hydrophilic surface layers such as sol/gel conversion layers are formed on the surfaces, (3) Core/shell type composite particles comprising hydrophobic fine particles of a thermoplastic polymer obtained by dispersion polymerization as the core part and hydrophilic polymer layers formed around there, (4) Emulsified particles of a thermo-diffusible or thermoplastic hydrophobic organic compound emulsified and dispersed in a hydrophilic medium, and (5) Microencapsulated particles comprising a hydrophobic core substance protected with a wall material having hydrophilic surface.

These particles will be described in detail in the following detailed description of the invention and in the examples.

As the latter particle dispersions which exhibit hydrophobicity by the initiation of a crosslinking reaction by heat, mixed dispersions of a polymerizable monomer and a crosslinkable compound can be exemplified.

In addition, compounds and groups of compounds having the function of hydrophobitizing the vicinities of the particles by the work of heat can be used as the hydrophobitization precursors in the present invention.

Specific hydrophobic compounds which can be incorporated into the emulsified and dispersed particles (4) or in the microencapsulated particles (5) are liquid or solid organic low molecular compounds having the melting point of 300° C. or less and the boiling point of 100° C. or more at normal pressure, and organic high molecular compounds having a solubility in 100 g of water at 25° C. or the amount of water absorption per 100 g of water at 25° C. of 2 g or less.

The organic low molecular compounds particularly preferably have the above-described melting point and boiling point and, in addition, at least either (1) the solubility in 100 g of water at 25° C. is 2 g or less, or (2) the ratio of organic property/inorganic property in the organic conceptual drawing is 0.7 or more.

On the other hand, organic high molecular compounds which can be incorporated into these particles are preferably at least one of polyurethanes, polycarbonates, polyesters, polyacrylates, cellulose esters, and cellulose acetals.

In the next place, light/heat converting agents contained in a hydrophilic medium are light/heat convertible solid fine particles whose surfaces are hydrophilized, or light/heat convertible and biodegradable hydrophilic dyes capable of being dyed or molecularly dispersed in a medium. The solid fine particles are selected from the group consisting of metals, metallic compounds, pigments and carbon simple substance.

It is preferred for the surface of the printing plate precursor according to the present invention to be provided with a water-soluble protective layer for preventing smearing (i.e., staining) of the printing plate precursor during handling, in particular, for preventing hydrophobitization.

The present invention summarized above will be described in further detail below.

Key to the Symbols

Figure 1:
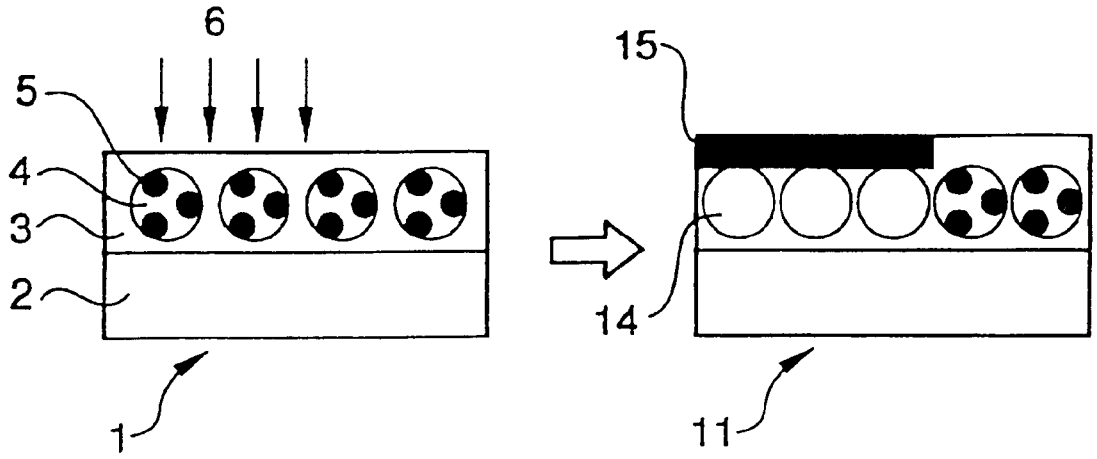
FIG. 1 is a typical drawing showing a representative plate-making process according to the present invention.

1. Printing plate precursor
2. Support
3. Image-recording layer
4. Particle having a hydrophilic surface
5. Metallic fine piece (i.e., Metallic dust)
6. Laser beam
11. Printing plate
14. Titanium oxide fine particle not carrying silver fine piece
15. Metallic silver thin layer by heat diffusion

DETAILED DESCRIPTION OF THE INVENTION

The present invention will be described in order from the image-recording layer.

Image-Recording Layer

The image-recording layer according to the present invention is a hydrophilic layer provided on a support, and contains a hydrophobitization precursor having a hydrophilic surface and a light/heat converting agent which is hydrophilic in itself, or at least on the surface of the converting agent.

Light/Heat Converting Agent

The light/heat converting agents in the present invention means substances having an absorbance of at least $0.3\times10^3$ $cm^{-1}$, preferably $1\times3$ $cm^{-1}$ or more, more preferably $1\times10^4$ $cm^{-1}$ or more, wherein the absorbed light is not substantially converted to fluorescent light or phosphorescent light. An absorbance is a value obtained by dividing the transmission density by the thickness. Further, when the light/heat converting agent is substantially molecularly dispersed in a medium such as a dye, the absorption coefficient of the medium is the absorbance of the light/heat converting agent.

It is needless to say that many substances absorb light to some degree, and when a substance absorbs light, the energy level of the substance excited by the absorption generates heat when returns to the base level unless it does not emit fluorescent light or phosphorescent light. Therefore, strictly speaking, it can be said that almost all the substances have light/heat converting property, if any. Accordingly, it is appropriate that a light/heat converting agent means a substance which has sufficient light absorbing property to bring about objective heat change. Therefore, the light/heat converting agent in the present invention means a substance which has at least the above-described absorbance from the object of the present invention.

Light/heat converting agents for use in the present invention which satisfy the above-described required conditions may be any of a metallic compound such as metal, metallic oxide, metallic nitride, metallic sulfide, metallic carbide, a non-metallic simple substance and compound, carbon simple substance, a pigment and a dye.

Light/Heat Convertible Solid Fine Particles

Light/ heat convertible solid fine particles may be any of particles comprising a hydrophobic substance in itself, a hydrophilic substance or an intermediate, but they must be subjected to surface hydrophilizing treatment except for particles comprising a hydrophilic substance in itself. The surface hydrophilizing treatment is performed by silicate treatment, aluminate treatment, provision of a chemical adsorption layer of water by water vapor treatment, provision of a surface layer of protective colloidal polymer, and surfactant treatment, alone or in combination, which will be described in detail later with specific examples.

Preferred examples of metallic compounds used as light/heat converting agents include oxides of transition metals, sulfides of metallic elements belonging to group II to group VIII of the Periodic Table, and nitrides of metals belonging to group III to group VIII of the Periodic Table. Examples of metallic oxides of transition metals include oxides of iron, cobalt, chromium, manganese, nickel, molybdenum, tellurium, niobium, yttrium, zirconium ismuth, ruthenium, and vanadium. There are classifying methods not necessarily including into transition metals, but oxides of zinc, mercury, cadmium, silver and copper can also be used in the present invention. Of these, particularly preferred metallic oxides include FeO, $Fe_2O_3$, $Fe_3O_4$, CoO, $Cr_2O_3$, $MnO_2$, $ZrO_2$, $Bi_2O_3$, CuO, $CuO_2$, AgO, PbO, $PbO_2$, and $VO_x$ (x is from 1 to 5). $VO_x$ include black VO, $V_2O_3$, $VO_2$ and brown $V_2O_5$.

As preferred inorganic metallic oxides, $TiO_x$ (x is from 1.0 to 2.0), $SiO_x$ (x is from 0.6 to 2.0), $AlO_x$ (x is from 1.0 to 2.0) can also be exemplified. In $TiO_x$ (x is from 1.0 to 2.0), there are black TiO, dark purple $Ti_2O_3$, and $TiO_2$'s which assume various colors from colorless to black due to crystal shapes and impurities. In $SiO_x$ (x is from 0.6 to 2.0), there are SiO, $Si_3O_2$, and $SiO_2$ which assume colorless, or purple, blue and red due to coexisting substances. As $AlO_x$ (x is 1.5), corundum which assume colorless, or red, blue and green due to coexisting substances can be exemplified.

When metallic oxides are lower oxides of polyvalent metals, there are cases where they are light/heat converting agents and at the same time self-exothermic type air oxidation reaction substances. Such a substance is very preferred since the heat energy resulting from self-exothermic reaction can also be used in addition to the energy generated from the light absorbed. As such lower oxides of polyvalent metals, lower oxides of Fe, Co and Ni can be exemplified.

Specifically, ferrous oxide, triiron tetroxide, titanium monoxide, stannous oxide, and chromous oxide can be exemplified. Of these, ferrous oxide, triiron tetroxide and titanium monoxide are preferred.

It can be easily confirmed by differential thermobalance (TG/DTA) (thermogravimetry/differential thermal analysis) whether self-exothermic reaction will occur or not. When a self-exothermic reaction substance is inserted into a differential thermobalance and the temperature is raised at a constant rate, an exothermic peak appears at a certain temperature, by which the fact of an exothermic reaction having occurred can be confirmed. When an oxidation reaction of metal or lower oxidized metal is used as a self-exothermic reaction, the weight increase is also observed in the thermobalance as well as the appearance of the exothermic peak. As is the repetition of the above, by the use of the energy by a self-exothermic reaction in addition to a light/heat conversion mechanism, more heat energy per a unit radiant ray amount than that conventionally used can be used and moreover continuously, as a result, sensitivity can be improved.

When light/heat convertible fine particles comprise a metallic sulfide, preferred metallic sulfides are heavy metallic sulfides such as transition metals. Examples of preferred metallic sulfides include sulfides of iron, cobalt, chromium, manganese, nickel, molybdenum, tellurium, strontium, tin, copper, silver, lead, and cadmium, and silver sulfide, ferrous sulfide and cobalt sulfide are particularly preferred.

When light/heat convertible fine particles comprise a metallic nitride, preferred metallic nitrides are azide compounds of metals. In particular, azide compounds of copper, silver and tin are preferred. These azide compounds are also self-exothermic compounds which generate heat by photodecomposition.

As other preferred inorganic metallic nitrides, $TiN_x$ (x is from 1.0 to 2.0), $SiN_x$ (x is from 1.0 to 2.0), and $AlN_x$ (x is from 1.0 to 2.0) can be exemplified. As $TiN_x$ (x is from 1.0 to 2.0), TiN of a bronze color and brown $TiN_x$ (x is 1.3) can be exemplified. As $SiN_x$ (x is from 1.0 to 2.0), $Si_2N_3$, SiN and $Si_3N_4$ can be exemplified, and as $AlN_x$ (x is from 1.0 to 2.0), AlN can be exemplified.

Each of the above-described metallic oxides, metallic sulfides and metallic nitrides can be obtained by well-known methods. Many of these are also commercially available by the names of titanium black, iron black, molybdenum red, emerald green, cadmium red, cobalt blue, prussian blue, and ultramarine.

The optimal particle sizes of these hydrophilic metallic compounds differ by the refractive indexes and the absorption coefficients of the substances constituting the particles but are in general from 0.005 to 5 $\mu$m, preferably from 0.01 to 3 $\mu$m. Light absorption becomes inefficient due to light scattering if the particle sizes are too fine, and due to interfacial reflection of particles if too big.

Light/Heat Convertible Metallic Fine Particles

Light/heat convertible fine particles of metals are described below. Many of metallic particles are light/heat convertible and also self-exothermic. Metallic particles should undergo surface hydrophilization treatment similarly to the case of a metallic compound which is not hydrophilic in itself.

Examples of metallic fine particles include fine particles of Mg, Al, Si, Ti, V, Cr, Mn, Fe, Co, Ni, Cu, Zn, Ga, Ge, Y, Zr, Nb, Mo, Tc, Ru, Pd, Ag, Cd, In, Sn, Sb, Hf, Ta, W, Re, Os, Ir, Pt, Au, Pb, etc. These metallic fine particles are light/heat convertible and also self-exothermic at the same time. Of these metallic fine particles, those which can easily generate an exothermic reaction such as oxidation reaction by the heat energy obtained by the light/heat conversion of the absorbed light are preferred, specifically Al, Si, Ti, V, Cr, Mn, Fe, Co, Ni, Cu, Zn, Y, Zr, Mo, Ag, In, Sn and W are particularly preferred. Above all, as the metallic fine particles which have high absorbance of radiant rays and large heat energy of self-exothermic reaction, Fe, Co, Ni, Cr, Ti and Zr are preferred.

Further, fine particles may comprise a metal simple substance or may comprise alloys of two or more components. Particles consisting of metals with metallic oxides, metallic nitrides, metallic sulfides, and metallic carbides may also be used. A metal simple substance rather gives large self-exothermic reaction heat energy such as oxidation etc. but treatment in the air is complicated and some metal simple substances are attended with danger of spontaneous combustion when come in contact with the air. Therefore, several nanometers in thickness from the surfaces of such metallic particles are preferably covered with oxides, nitrides, sulfides or carbides of metals.

The particle size of these fine particles is 10 $\mu$m or less, preferably from 0.005 to 5 $\mu$m, and more preferably from 0.01 to 3 $\mu$m. When the particle size is less than 0.01 $\mu$m, dispersion of particles are difficult and when it is more than 10 $\mu$m definition of printed matters is deteriorated.

Solid fine particles such as the above-described weak hydrophilic or hydrophobic inorganic metallic oxide and inorganic metallic nitride, metal simple substance, alloy and light-absorbing simple substance can exhibit the effect of the present invention by subjecting to surface hydrophilizing treatment. As the means of the surface hydrophilizing treatment, conventionally well-known surface hydrophilizing treatment can be used. For example, a method of dispersing fine particles by adding a surfactant which is hydrophilic and adsorptive to particles to form a hydrophilic surfactant-adsorbed layer on the surfaces of fine particles; a method of forming a protective colloidal, hydrophilic and surface-adsorptive high polymer coating, e.g., gelatin, casein, polyvinyl alcohol, and polyvinyl pyrrolidone, in the above method; a dispersing method for further hydrophilizing and stabilizing the particle surfaces in the presence of a surfactant in the above method; and a method of surface treatment with a substance having a hydrophilic group reactive with the constitutional substances of the particles can be used in the present invention.

A particularly preferred method is a surface treatment method with silicate, for example, in the case where fine particles are iron fine particles or triiron tetroxide fine particles, the surfaces of the particles can be sufficiently hydrophilized by immersing in a 3% aqueous solution of sodium silicate at 70° C. for 30 seconds.

Metallic oxide fine particles subjected to surface hydrophilizing treatment, in particular, metallic oxide fine particles treated with surface silicate treatment, above all, iron oxide fine particles and iron fine particles surface-treated with silicate are preferably used in the present invention for exhibiting the effect of the present invention.

When a surfactant is used for dispersion, an appropriate surfactant is selected according to the particles to be dispersed and the kind of the medium of the image-recording layer. For dispersing fine particles having surface hydrophilicity in a hydrophilic medium, nonionic surfactants such as sorbitan tristearate, sorbitan monopalmitate, sorbitan trioleate, stearic acid monoglyceride, and polyoxyethylenenonylphenyl ether; ampholytic surfactants such as alkyldi(aminoethyl) glycine, alkylpolyaminoethyl glycine hydrochloride, 2-alkyl-N-carboxyethyl-N-hydroxyethylimidazolinium betaine, and N-tetradecyl-N,N-betaine (e.g., Amorgen K, manufactured by Daiichi Kogyo Seiyaku Co., Ltd.), and anionic surfactants such as dodecylbenzenesulfonic acid and other alkylbenzenesulfonic acids having from 8 to 22 carbon atoms, alkylnaphthalenesulfonic acid (having from 1 or 2 alkyl groups and from 1 to 6 carbon atoms) naphthalenesulfonic acid, and formalin condensation products thereof (condensation number is from 2 to 5), and alkyl sulfate having from 8 to 22 carbon atoms can be used in the present invention.

Light/Heat Convertible Nonmetal Simple Substance

In addition to the above metallic compounds, light/heat convertible fine particles of nonmetal simple substance and nonmetallic compounds can also be used in the present invention. These light/heat convertible fine particles include simple substance such as carbon black, graphite, bone black, and various organic and inorganic pigments. Many of these are hydrophobic in themselves and it is necessary to be surface-treated with hydrophilization treatment.

Conventionally well-known arbitrary methods can be used for surface-hydrophilizing treatment. For example, the surfaces of carbon black can be hydrophilized by a well-known method by the introduction of hydroxyl groups or by silicate treatment. For example, 10 g of carbon black is put in a reaction vessel under reduced pressure and deaerated, and then plasma irradiation is performed with flowing water vapor, thus carbon black into which hydroxyl groups have been introduced can be obtained. Further, when the thus-obtained hydroxyl group-introduced carbon black is dispersed in water, and tetraethoxysilane is dropwise added thereto and allowed to react with the carbon black at room temperature, surface-treated carbon black with silicate can be obtained.

Light/Heat Convertible Pigment

In the present invention, arbitrary pigments can be used, for example, a pigment which itself has a hydrophilic surface, or a pigment having a coating layer of hydrophilic surface, in addition, light/heat convertible to light of irradiation for image-forming layer and capable of dispersing fine particles.

Pigments may be any of a metal complex pigment and a nonmetallic pigment.

Specific examples of the preferred pigments include Cobalt Green (C.I. 77335), Emerald Green (C.I. 77410), Phthalocyanine Blue (C.I. 74100), Copper Phthalocyanine (C.I. 74160), Ultramarine (C.I. 77007), Prussian Blue (C.I. 77510), Cobalt Violet (C.I. 77360), Pariodiene Red 310 (C.I. 71155), Permanent Red BL (C.I. 71137), Perylene Red (C.I. 71140), Rhodamine Lake B (C.I. 45170:2), Helio Bordeaux BL (C.I. 14830), Light Fast Red Toner R (C.I. 12455), Fast Scarlet VD, Lithol Fast Scarlet G (C.I. 12315), Permanent Brown FG (C.I. 12480), Indanthrene Brilliant Orange RK (C.I. 59300), Chrome Orange (C.I. 77601), Hansa Yellow-lOG (C.I. 11710), Titan Yellow (C.I. 77738), Zinc Yellow (C.I. 77955), and Chrome Yellow (C.I. 77600). In addition to these, various kinds of pigments which are used as toners for electrostatic recording are also preferably used.

With respect to pigments also, except for particles comprising a hydrophilic substance in itself, they are necessary to undergo surface hydrophilizing treatment similar to the cases of metallic compounds which are not hydrophilic in themselves, metals and carbon simple substances.

The content of light/heat convertible fine particles in an image-forming layer is from 1 to 95 wt %, preferably from 3 to 90 wt %, and more preferably from 5 to 80 wt %, based on the content of solid constitutional elements. When the content is less than 1 wt % , the amount of heat generation becomes insufficient, while when it is more than 95 wt %, film strength lowers.

Light/Heat Convertible Hydrophilic Dye

As a light/heat converting agent, hydrophilic dyes having light absorption region in the spectral wavelength region of the irradiation light, in addition, having dyeing property and molecular dispersion property to a hydrophilic medium can also be used in the present invention. A preferred dye is an IR absorber, specifically dyes having a water-soluble group in the molecule, and dyes selected from a polymethine dye, a cyanine dye, a squarylium dye, a pyrylium dye, a diiummonium dye, a phthalocyanine compound, a triarylmethane dye, and a metallic dithiolene. More preferred of these are a polymethine dye, a cyanine dye, a squarylium dye, a pyrylium dye, a diiummonium dye, and a phthalocyanine compound, and a polymethine dye. A polymethine dye, a cyanine dye and a phthalocyanine compound are most preferred from the viewpoint of synthesis aptitude.

As the preferred water-soluble group, a sulfonic acid group, a carboxyl group and a phosphonic acid group can be exemplified.

Specific examples of IR absorbers for use in the present invention are shown below, but the present invention is not limited thereto.

(1)
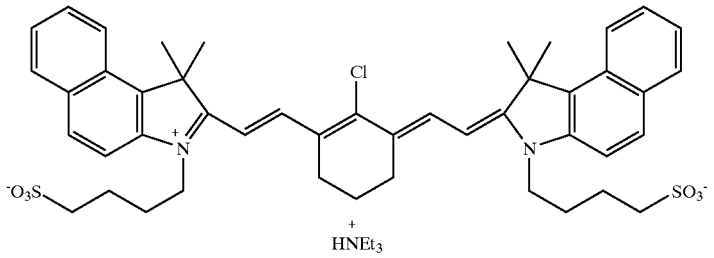
(2)
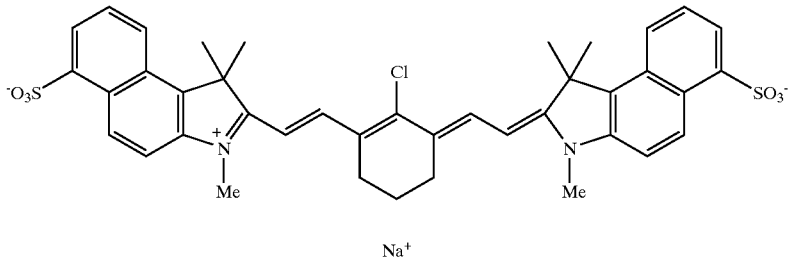
(3)
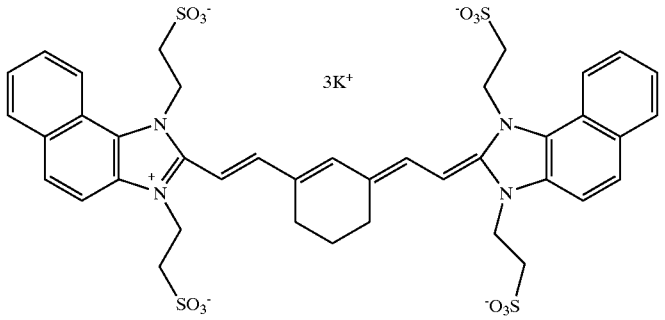
(4)
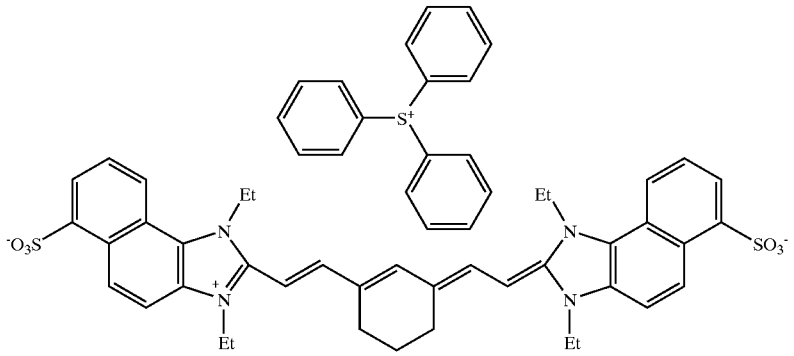
(5)
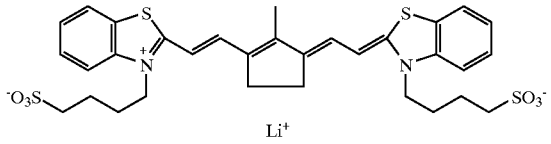
(6)
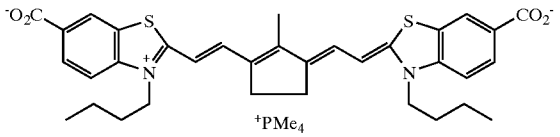
(7)
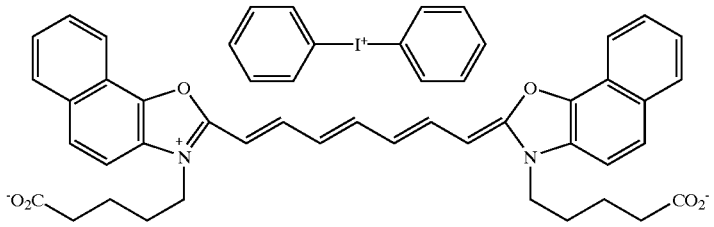

-continued
(8)
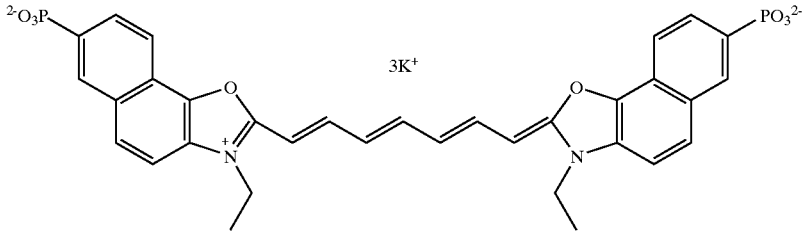
(9)
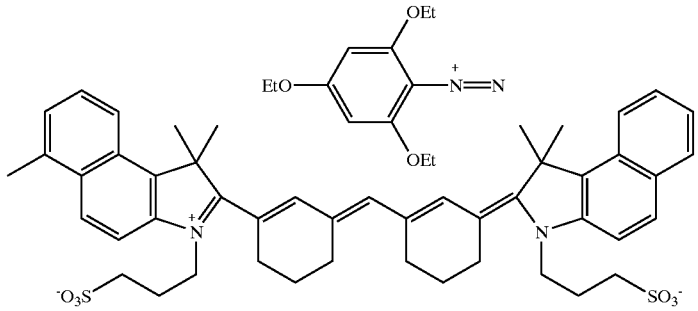
(10)
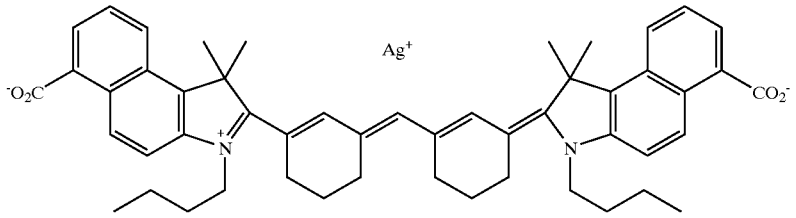
(11)
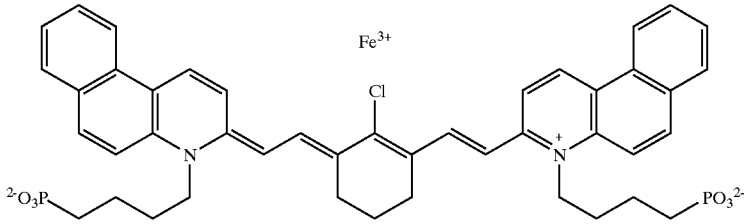
(12)
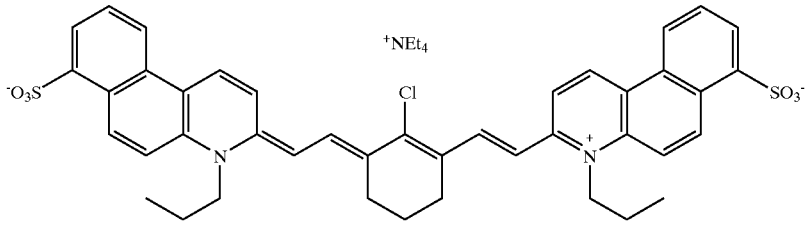
(13)
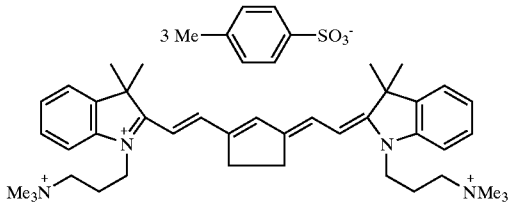
(14)
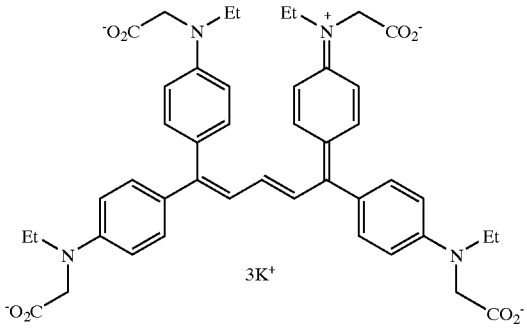

-continued
(15)
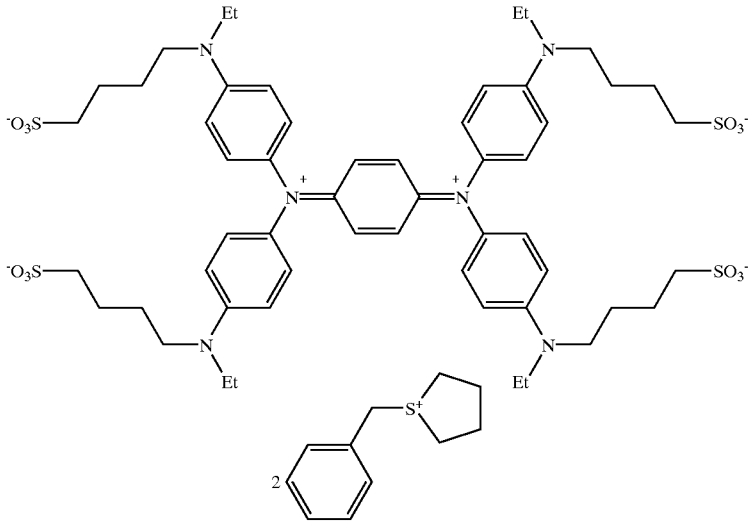
(16)
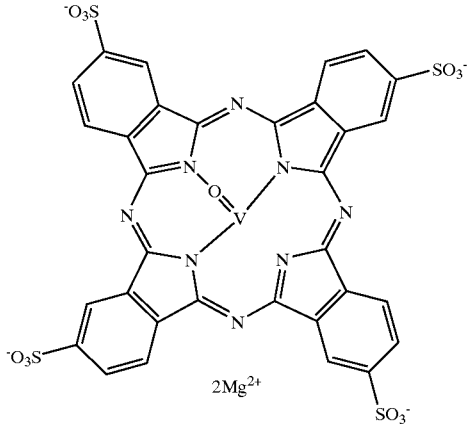
(17)
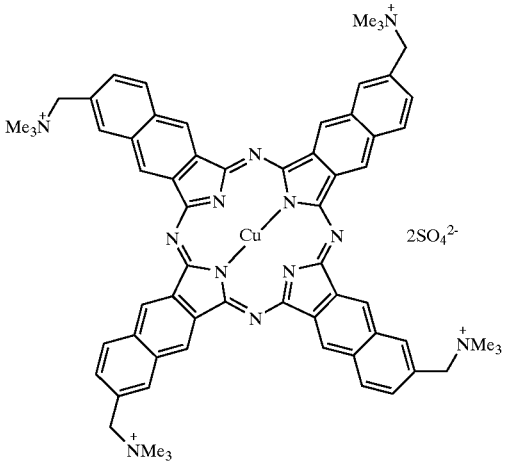
(18)
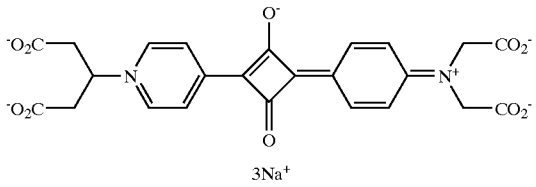
(19)
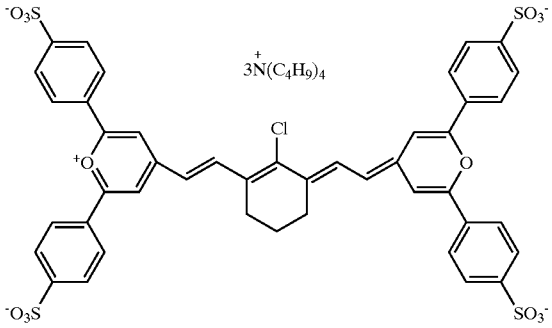

-continued (20)

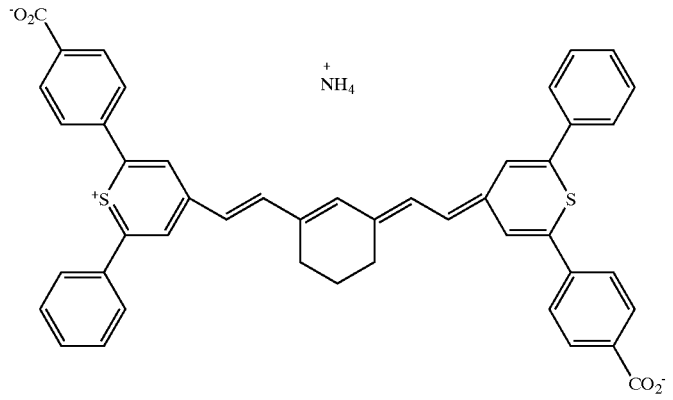

The content of an infrared absorber in the present invention is 6 wt % or more, preferably 10 wt % or more, and more preferably 15 wt % or more, based on the entire solid content in the photosensitive layer. If the content of an infrared absorber is less than 6 wt %, the sensitivity lowers.

For exhibiting the effect of the present invention, it is essential that not only a light/heat converting agent has the above absorbance but also the image-recording layer containing the light/heat converting agent has the necessary level of light absorbing performance, i.e., particle density, for effectively bringing about light/heat conversion function. The necessary light-absorbing performance means to have spectral absorption region having absorbance of 0.3 or more in the light/heat convertible spectral wavelength region of from 300 to 1,200 nm, specifically means to have absorption maximum of absorbance of 0.3 or more in the wavelength region of the irradiated light for image formation (in the case of short wavelength light, the wavelength region of 100 nm width with the wavelength as center), or means that spectral absorption wavelength region of continuous 100 nm or more having absorbance of 0.3 or more is present, if absorption maximum is not present in this wavelength region. When the condition of the light-absorbing performance is satisfied, degree of sensitivity increases and discriminating property is improved by performing imagewise exposure corresponding to the absorption wavelength region.

Moreover, the transmission density of an image-forming layer is preferably from 0.3 to 3.0 measured based on International Standard ISO5-3 and ISO5-4. If the transmission density is more than 3.0, the radiant ray strength at the lower part of an image area conspicuously lowers as a result of attenuation of the radiant ray and the conversion to hydrophobicity occurs with difficulty. When the transmission density is 0.3 or less, the absorption of radiant ray energy becomes insufficient, thus the amount of heat energy obtained by light/heat conversion is liable to be insufficient.

Hydrophobitization Precursor

The explanation of light/heat convertible fine particles is as described above, and a hydrophobitization precursor having a hydrophilic surface will be described below. Various well-known substances whose polarity converts to hydrophobicity by heat can be used as a hydrophilization precursor having hydrophilic surface in the present invention. The preferred embodiment of the hydrophobitization precursors is shown in the following items (1) and (2), but the present invention is not limited thereto.

(1) A precursor which is a dispersion of particles of composite constitution containing a hydrophobic substance at the core part and having a surface layer of superficial hydrophilicity, and the particles of the incorporated hydrophobic substance is broken due to the work of heat by light irradiation and light/heat conversion, and the incorporated hydrophobic substance makes the vicinities hydrophobic; and (2) A precursor which is a dispersion of particles having hydrophilic surface and heat-crosslinkable and exhibits hydrophobicity by the initiation of a crosslinking reaction due to the work of heat.

Hydrophobitization precursors are described in detail below.

(1) A dispersion of particles of composite constitution containing a hydrophobic substance at the core part and having a surface layer of superficial hydrophilicity As the preferred forms of the particles of composite constitution in the above item (1), the following particles are included:

1) Composite particles of so-called hetero coagulation surface layers containing a thermoplastic resin which softens or melts by the temperature of heat mode image exposure and hydrophilic sol particle layers coagulated and adhered on the surfaces (hereinafter sometimes referred to as hetero coagulation surface layer particles), 2) Surface hetero phase composite particles containing a thermoplastic resin which softens or melts by the temperature of heat mode image exposure and hydrophilic gel surface layers are formed on the surfaces by sol/gel conversion by processing a sol/gel substance (hereinafter sometimes referred to as surface hetero phase particles), 3) Core/shell type composite particles comprising hydrophobic fine particles of a thermoplastic polymer obtained by dispersion polymerization as the core part and hydrophilic polymer layers formed around there (hereinafter sometimes referred to as core/shell type particles), 4) Emulsified particles of a thermodiffusible or thermoplastic hydrophobic organic compound emulsified and dispersed in a hydrophilic medium (hereinafter sometimes referred to as hydrophobic organic substance-containing particles), and 5) Microencapsulated particles comprising a hydrophobic core substance protected with a wall material having hydrophilic surface (hereinafter sometimes referred to as simply microencapsulated particles).

As the latter particle dispersions which exhibit hydrophobicity by the initiation of a crosslinking reaction by heat in the above item (2), mixed dispersions of a polymerizable monomer, a crosslinkable compound and a photopolymerization initiator can be exemplified.

<Hetero Coagulation Surface Layer Particles>

The hetero coagulation surface layer particles in the above item 1) of (1) contain particles of emulsified polymer dispersion of a thermo-softening or thermo-melting resin obtained by protecting a monomer with surfactant micelle, emulsifying-dispersing, and polymerizing, the resin particles soften and melt due to the effect of heat by light irradiation and light/heat conversion function, rupture the hydrophilic surface layers, and hydrophobitize the vicinities of the areas where they were present as particles. The hydrophilic surface layer is a protective layer adsorbed around the emulsified polymer dispersion particles of the resin formed by adding sol state fine particle dispersion having relatively large hydrophilicity such as silica fine particles and alumina fine particles. The dispersion of the sol fine particles are the same as the sol fine particles described later in the components added to the medium of a hydrophilic image-recording layer.

The surface hetero phase particles in the above item 2) in (1) contain emulsified polymer dispersion particles of a thermo-softening or thermo-melting resin as core particles similar to the particles in the above item 1), and the surfaces thereof are treated with a sol/gel convertible substance, which will be described later in the medium of a hydrophilic image-recording layer, to form a gel phase on the surfaces of particles.

<Core/Shell Type Particles>

The core/shell type particles in the above item 3) in (1) contain particle dispersion of a resin which softens or melts by heat (hereinafter sometimes referred to as a thermoplastic resin) prepared by emulsifying and polymerizing the monomer as core particles (seeds), and a hydrophilic monomer is added to the dispersion solution and polymerized on the surfaces of core particles to form core/shell type particles having different phase structure.

A monomer which constitutes the core particle is selected from those for hydrophobic thermoplastic resins among the following groups A to L shown as monomer components for high molecular compounds which will be described in the following item 4). A monomer for forming a hydrophilic shell phase can also be selected from the hydrophilic monomers among groups A to L.

<Hydrophobic Organic Substance-containing Particles>

The hydrophobic organic substance-containing particles in the above 4) in (1) take the form of particles comprising the contained hydrophobic substance emulsified and dispersed in a hydrophilic medium and having hydrophilic surfaces. Due to the work of heat by heat mode light irradiation, emulsified particles cannot maintain the particle form any longer, and the vicinities of the precursors are hydrophobitized by exudation, diffusion and dissolution. Compounds suitable for this purpose can be found in hydrophobic organic low molecular compounds and organic high molecular compounds.

Organic Low Molecular Compound

When hydrophobicity precursors contain organic low molecular compounds, the preferred organic low molecular compounds are solid or liquid organic compounds having the melting point of 300° C. or less and the boiling point of 100° C. or more at normal pressure, or organic high molecular compounds having the solubility in water or the water absorption is 2 g or less per 100 g of water. It is preferred embodiment of the present invention to use both compounds. Since organic low molecular compounds are comparatively high in diffusion permeability, when the mobility is given by heat, they diffuse to and hydrophobitize directly or indirectly the vicinities of the areas where they were present. Compounds which are solid at normal temperature and diffuse by heat and form hydrophobic areas are included in this category. When the mobility is too large, hydrophobic area widens too much, and also the local centralization degree of heat energy lowers, as a result the effect of hydrophobitization decreases. Accordingly, compounds which satisfy the above-described conditions of the melting point and the boiling point are preferred. Low molecular compounds in the present invention means compounds having the boiling point or the melting point and such compounds generally have a molecular weight of 2,000 or less, in many cases 1,000 or less.

The condition of the above solubility or water absorption is the condition found experimentally as the barometer that the organic high molecular compound is hydrophobic. On this condition, the hydrophobitization of the area in the vicinity of the particles can be exhibited by the change of the state of the organic high molecular compound near the area where the particles were present due to the work of heat.

It is necessary that preferred organic low molecular compounds which meet the purpose of hydrophobitization should have extremely low solubility in water or high degree of organic property from the necessity of capable of sufficiently hydrophobitizing the vicinities of the precursor by itself, apart from the viewpoint of the melting point and boiling point concerning the above-described mobility of the compound. As described above, that which specifically shows the condition is the case where the organic low molecular compound corresponds to at least either of (1) the solubility in 100 g of water at 25° C. is 2 g or less, or (2) the ratio of organic property/inorganic property in the organic conceptual drawing is 0.7 or more.

The organic conceptual drawing is the practical and simple standard to show the degree of organic property and inorganic property and details are described in Yoshio Tanaka, Yuki Gainenzu (Organic Conceptual Drawing), First Edition, pp. 1 to 31, Sankyo Shuppan Co., Ltd. (1983). The reason why the organic compounds in the above range on the organic conceptual drawing have the function of accelerating hydrophobitization is unknown but the compounds in this range have a relatively large organic property and hydrophobitize the vicinities of composite particles. The organic property of organic compounds on the organic conceptual drawing is 100 or more and the upper limit is not particularly limited, generally from 100 to 1,200, preferably from 100 to 800, the ratio of organic property/inorganic property is from 0.7 to infinity (i.e., inorganic property is 0), preferably from 0.9 to 10.

As the organic low molecular compounds having the boiling point falling in this range, specifically aliphatic and aromatic hydrocarbons, aliphatic and aromatic carboxylic acids, aliphatic and aromatic alcohols, aliphatic and aromatic esters, aliphatic and aromatic ethers, organic amines, and organic silicon compounds can be exemplified, and various solvents and plasticizers which are known to be added to printing ink are exemplified, although the effect is not large.

The preferred aliphatic hydrocarbons are hydrocarbons having from 8 to 30, more preferably from 8 to 20, carbon atoms, the preferred aromatic hydrocarbons are hydrocarbons having from 6 to 40, more preferably from 6 to 20, carbon atoms, the preferred aliphatic alcohols are aliphatic alcohols having from 2 to 30, more preferably from 2 to 18, carbon atoms, the preferred aromatic alcohols are aromatic alcohols having from 6 to 30, more preferably from 6 to 18, carbon atoms, the preferred aliphatic carboxylic acids are aliphatic carboxylic acids having from 2 to 24, more preferably aliphatic monocarboxylic acids having from 2 to 20 carbon atoms, and aliphatic polycarboxylic acids having from 4 to 12 carbon atoms, the preferred aromatic carboxylic acids are aromatic carboxylic acids having from 6 to 30, more preferably from 6 to 18, carbon atoms, the preferred aliphatic esters are aliphatic esters having from 2 to 30, more preferably from 2 to 18, carbon atoms, the preferred aromatic esters are aromatic carboxylic acid esters having from 8 to 30, more preferably from 8 to 18, carbon atoms, the preferred aliphatic ethers are aliphatic ethers having from 8 to 36, preferably from 8 to 18, carbon atoms, and the preferred aromatic ethers are aromatic ethers having from 7 to 39, more preferably from 7 to 18, carbon atoms. Besides these, aliphatic or aromatic amides having from 7 to 30, more preferably from 7 to 18, carbon atoms can also be used.

Specific examples thereof include aliphatic hydrocarbon such as 2,2,4-trimethylpentane (isooctane), n-nonane, n-decane, n-hexadecane, octadecane, eicosane, methylheptane, 2,2-dimethylhexane, and 2-methyloctane; aromatic hydrocarbon such as benzene, toluene, xylene, cumene, naphthalene, anthracene, and styrene; monovalent alcohol such as dodecyl alcohol, octyl alcohol, n-octadecyl alcohol, 2-octanol, and lauryl alcohol; polyvalent alcohol such as propylene glycol, triethylene glycol, tetraethylene glycol, glycerin, hexylene glycol, and dipropylene glycol; aromatic alcohol such as benzyl alcohol, 4-hydroxytoluene, phenethyl alcohol, 1-naphthol, 2-naphthol, catechol, and phenol; monovalent aliphatic carboxylic acid such as acetic acid, propionic acid, butyric acid, caproic acid, acrylic acid, crotonic acid, caprylic acid, stearic acid, and oleic acid; polyvalent aliphatic carboxylic acid such as oxalic acid, succinic acid, adipic acid, maleic acid, and glutaric acid; aromatic carboxylic acid such as benzoic acid, 2-methylbenzoic acid, and 4-methylbenzoic acid; aliphatic ester such as ethyl acetate, isobutyl acetate, n-butyl acetate, methyl propionate, ethyl propionate, methyl butyrate, methyl acrylate, dimethyl oxalate, dimethyl succinate, and methyl crotonate; aromatic carboxylate such as methyl benzoate, and methyl 2-methylbenzoate; organic amine such as imidazole, triethanolamine, diethanolamine, cyclohexylamine, hexamethylenetetramine, triethylenetetramine, aniline, octylamine, and phenethylamine; ketones such as acetone, methyl ethyl ketone, methyl isobutyl ketone, and benzophenone; ether such as methoxybenzene, ethoxybenzene, methoxytoluene, laurylmethyl ether, and stearylmethyl ether; and amides such as stearylamide, benzoylamide, and acetamide. In addition, organic solvents such as ethylene glycol monoethyl ether, cyclohexanone, butyl cellosolve, and cellosolve acetate having the boiling point within the above preferred range can also be used.

Fats and oils such as linseed oil, soybean oil, poppy seed oil and safflower oil which are the components of printing ink, and plasticizers such as tributyl phosphate, tricresyl phosphate, dibutyl phthalate, butyl laurate, dioctyl phthalate, and paraffin wax can also be exemplified.

In addition, esters of long chain fatty acids and long chain monovalent alcohols, i.e., waxes, are also preferred low molecular organic compounds which are hydrophobic, have appropriately low melting point, melt in the vicinity of light/heat converting fine particles due to the heat brought about by light irradiation and hydrophobitize the area. Waxes preferably melt at 50 to 200° C., and any of carnauba wax, castor wax, microcrystalline wax, paraffin wax, shellac wax, palm wax, and bees wax, which are called such by the raw material, can be used. In addition to waxes, fine particle dispersions of low molecular weight polyethylene; solid acids, e.g., oleic acid, stearic acid and palmitic acid; and metallic salts of long chain fatty acids, e.g., silver behenate, calcium stearate, and magnesium palmitate, can also be used.

Organic High Molecular Compound

The above-described preferred organic high molecular compounds which satisfy the condition of solubility or water absorption are hydrophobic high molecular compounds soluble in the coexisting low molecular organic compounds or thermoplastic in themselves. For example, polyvinyl chloride, polyvinyl acetate, polyvinyl phenol, polyvinyl halogenated phenol, polyvinyl formal, polyvinyl acetal, polyvinyl butyral, polyamide, polyurethane, polyurea, polyimide, polycarbonate, epoxy resin, phenol, novolak, condensation resins of resol phenols with aldehyde or ketone, polyvinylidene chloride, polystyrene, acryl-based copolymerization resins, etc., can be exemplified.

One preferred compound is a phenol novolak resin or resol resin which is not necessarily thermoplastic but is soluble in organic low molecular compounds, and examples thereof include novolak resins and resol resins of condensation with formaldehyde such as phenol, cresol (m-cresol, p-cresol, m/p mixed cresol), phenol/cresol (m-cresol, p-cresol, m/p mixed cresol), phenol modified xylene, tert-butylphenol, octylphenol, resorcinol, pyrogallol, catechol, chlorophenyl (m-Cl, p-Cl), bromophenol (m-Br, p-Br), salicylic acid, and fluoroglucinol, and condensation resins of the above phenol compounds with acetone.

As other preferred high molecular compounds, copolymers with the monomers shown in (A) to (L) below as repeating units and have molecular weight of generally from 10,000 to 200,000 can be exemplified.

(A) Acrylamides, methacrylamides, acrylates, methacrylates, hydroxystyrenes, each having an aromatic hydroxyl group, e.g., N-(4-hydroxyphenyl) acrylamide, N-(4-hydroxyphenyl)-methacrylamide, o-, m- and p-hydroxystyrene, o-, m- and p-hydroxyphenyl acrylate or methacrylate (B) Acrylates and methacrylates each having an aliphatic hydroxyl group, e.g., 2-hydroxyethyl acrylate, or 2-hydroxyethyl methacrylate (C) (Substituted) acrylates, e.g., methyl acrylate, ethyl acrylate, propyl acrylate, butyl acrylate, amyl acrylate, hexyl acrylate, cyclohexyl acrylate, octyl acrylate, phenyl acrylate, benzyl acrylate, 2-chloroethyl acrylate, 4-hydroxybutyl acrylate, glycidyl acrylate, and N-dimethylaminoethyl acrylate, etc.

(D) (Substituted) methacrylates, e.g., methyl methacrylate, ethyl methacrylate, propyl methacrylate, butyl methacrylate, amyl methacrylate, hexyl methacrylate, cyclohexyl methacrylate, octyl methacrylate, phenyl methacrylate, benzyl methacrylate, 2-chloroethyl methacrylate, 4-hydroxybutyl methacrylate, glycidyl methacrylate, and N-dimethylaminoethyl methacrylate, etc.

(E) Acrylamide or methacrylamide, e.g., acrylamide, methacrylamide, N-me thylolacrylamide, N-methylolmethacrylamide, N-ethylacrylamide, N-ethylmethacrylamide, N-hexylacrylamide, N-hexylmethacrylamide, N-cyclohexylacrylamide, N-cyclohexylmethacrylamide, N-hydroxyethylacrylamide, N-hydroxyethylmethacrylamide, N-phenylacrylamide, N-phenyl-methacrylamide, N-ben zylacrylamide, N-benzylmethacrylamide, N-nitrophenylacrylamide, N-nitrophenylmethacrylamide, N-ethyl-N-phenylacrylamide, and N-ethyl-N-phenylmethacrylamide, etc.

(F) Vinyl ethers, e.g., ethyl vinyl ether, 2-chloroethyl vinyl ether, hydroxyethyl vinyl ether, propyl vinyl ether, butyl vinyl ether, octyl vinyl ether, phenyl vinyl ether, etc.

(G) Vinyl esters, e.g., vinyl acetate, vinyl chloroacetate, vinyl butyrate, vinyl benzoate, etc.

(H) Styrenes, e.g., styrene, methylstyrene, chloromethylstyrene, etc.

(I) Vinyl ketones, e.g., ethyl vinyl ketone, propyl vinyl ketone, phenyl vinyl ketone, etc.

(J) Olefins such as ethylene, propylene, isobutylene, butadiene, isoprene, etc.

(K) N-vinylpyrrolidone, N-vinylcarbazole, N-vinylpyridine, acrylonitrile, methacrylonitrile, etc.

(L) Acrylamides, e.g., N-(o-aminosulfonylphenyl) acrylamide, N-(m-aminosulfonylphenyl)acrylamide, N-(p-aminosulfonyl-phenyl)acrylamide, N-[1-(3-aminosulfonyl)naphthyl]acrylamide, and N-(2-aminosulfonylethyl)acrylamide, methacrylamide, e.g., N-(o-aminosulfonylphenyl)methacrylamide, N-(m-aminosulfonyl-phenyl)methacrylamide, N-(p-aminosulfonylphenyl)methacrylamide, N-[1-(3-aminosulfonyl)naphthyl]methacrylamide, and N-(2-aminosulfonylethyl)methacrylamide, unsaturated sulfonamides such as acrylate, e.g., o-aminosulfonylphenyl acrylate, m-aminosulfonylphenyl acrylate, p-aminosulfonylphenyl acrylate, and 1-(3-aminosulfonylphenylnaphthyl)acrylate, and unsaturated sulfonamides such as methacrylate, e.g., o-aminosulfonylphenyl methacrylate, m-aminosulfonylphenyl methacrylate, p-aminosulfonylphenyl methacrylate, and 1-(3-aminosulfonylphenylnaphthyl) methacrylate.

These organic high molecular compounds preferably have a weight average molecular weight of from 500 to 20,000 and a number average molecular weight of from 200 to 60,000.

Hydrophobitization precursors may comprise organic low molecular compounds alone, organic high molecular compounds alone, or may comprise both organic low molecular compounds and organic high molecular compounds. Further, the third components may be contained in hydrophobitization precursors for the purpose of improving the affinity of the organic low molecular compounds and organic high molecular compounds.

For hydrophilizing the surfaces of hydrophobitization precursors, the hydrophilizing method described in the light/heat converting agent can be used. For example, a method of dispersing particles by adding a surfactant which is hydrophilic and adsorptive to hydrophobitization precursors to form a hydrophilic surfactant-adsorbed layer on the surfaces of particles; a method of forming a protective colloidal, hydrophilic and surface-adsorptive highpolymer coating, e.g., gelatin, polyvinyl alcohol, and polyvinyl pyrrolidone, in the above method; a dispersing method for further hydrophilizing and stabilizing the particle surfaces in the presence of a surfactant in the above method; and a method of surface treatment with a substance having a hydrophilic group reactive with the constitutional substances of the particles can be used in the present invention. The surfactants described in the surface hydrophilization of the light/heat converting agent can be used as the surfactants for use for surface hydrophilization of the hydrophobitization precursors.

The total amount of the hydrophobic constitutional components (the core part substances) in each surface hydrophilic hydrophobitization precursor in the above items 1) to 4) is generally from 10 to 95 wt %, preferably from 20 to 80 wt %, based on the total amount of the hydrophobitization precursor. Further, in item 4), when the organic low molecular compound and the organic high molecular compound are used together, the ratio may be arbitrary. On the other hand, the components forming a hydrophilic surface layer are different, such as surfactants, protective colloids, hydrophilic polymerization resins, hydrophilic sol, and sol/gel conversion components, according to the forms of 1) to 4) In some cases, these components are contained in the medium of an image-recording layer. The amount of the components forming a hydrophilic surface layer of the hydrophobitization precursor is from 5 to 80 wt %, preferably from 10 to 50 wt %, based on the total amount of the hydrophobitization precursor.

The range of the optimal size of dispersion particles is different according to the forms of 1) to 4), but is preferably from 0.01 $\mu$m to 5 $\mu$m or less, more preferably from 0.05 to 2 $\mu$m, and particularly preferably from 0.2 to 0.5 $\mu$m, on volume average.

<Microencapsulated Particles>

The hydrophobitization precursor which is a constitutional material of microencapsulated particles and hydrophobitizes the vicinities due to rupture by heat as described above in item 5) of a dispersion of particles of composite constitution containing a hydrophobic substance at the core part and having a surface layer of superficial hydrophilicity will be described below.

Microcapsules for use in the present invention can be produced by various well-known methods, and as the core substances (the substance contained in the capsule), the above-described organic low molecular compounds and organic high molecular compounds, further, organic solvents for mixing them can be used. That is, the microencapsulated particles can be prepared by directly emulsifying and dispersing the core substance in an aqueous medium, or after mixing the core substance and the organic solvent, and forming a wall film comprising a high molecular substance around the oil droplet. Specific examples of high molecular substances for the wall film of the microcapsule include, e.g., a polyurethane resin, a polyurea resin, a polyamide resin, a polyester resin, a polycarbonate resin, an aminoaldehyde resin, a melamine resin, a polystyrene resin, a styrene-acrylate copolymer resin, a styrene-methacrylate copolymer resin, gelatin and polyvinyl alcohol. Particularly preferred are microcapsules having wall films comprising polyurethane-polyurea resins.

Microcapsules having wall films comprising polyurethane-polyurea resins are produced by mixing a wall material such as polyvalent isocyanate in the core substance to be encapsulated, emulsifying and dispersing the mixture in the aqueous medium of dissolved protective colloid substance such as polyvinyl alcohol, and increasing the temperature to cause the high molecular compound-forming reaction at the oil droplet interface.

Specific examples of polyvalent isocyanate compounds include diisocyanates, e.g., m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-diphenylmethane-4,4'-diisocyanate, xylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate, and cyclohexylene-1,4-diisocyanate, triisocyanates, e.g., 4,4,',4"-triphenylmethane triisocyanate and toluene-2,4,6-triisocyanate, tetraisocyanates, e.g., 4,4'-dimethyldiphenylmethane-2,2',5,5'-tetraisocyanate, and isocyanate prepolymers, e.g., adducts of hexamethylene diisocyanate and trimethylolpropane, adducts of 2,4-tolylene diisocyanate and trimethylolpropane, adducts of xylylene diisocyanate and trimethylolpropane, and adducts of tolylene diisocyanate and hexanetriol, but the present invention is not limited to the above compounds. If necessary, two or more compounds can be used in combination. Particularly preferred of these are those having three or more isocyanate groups in the molecule.

As wall materials of microcapsules, the above-described gelatin, polyurea, polyurethane, polyimide, polyester, polycarbonate, melamine, etc., can be used, but for obtaining heat-responding microcapsules, polyurea and polyurethane walls are preferred. For imparting heat-responding property to capsule walls, the capsule walls preferably have a glass transition point of from room temperature to 200° C., particularly preferably from 70 to 150° C.

For controlling the glass transition point of the capsule walls, the kinds of polymers of the capsule walls may be selected or it is possible to add an appropriate plasticizer. As such auxiliaries, a phenol compound, an alcohol compound, an amide compound, and a sulfonamide compound can be exemplified, and they can be contained in the core substance in the capsules, or they may be added to the outside of the capsules as a dispersion.

General methods of microencapsulation and the materials for use are disclosed in U.S. Pat. Nos. 3,726,804 and 3,796,696, which can be applied to the present invention.

The size of the microcapsule is preferably from 0.02 to 5 μm, more preferably from 0.05 to 0.7 μm, on volume average, from the improvement of the resolving power of images and handling. Hydrophobitization precursor which contains polymerizable monomer/crosslinkable compound and forms hydrophobic polymer/crosslinked structure in the vicinity of particle due to rupture by heat.

The hydrophobitization precursor described above is a dispersion containing polymerizable monomer/crosslinkable compound which do not react at normal temperature, cause a polymerization reaction by the work of heat, and hydrophobitize the vicinities of the precursor particles. As examples thereof, the systems including polymerizable monomers in which a polymerization reaction, in particular, a crosslinking reaction advances at high temperature, heat-crosslinkable polymers and oligomers having a crosslinking group, and thermal polymerization initiators can be exemplified. The surface hydrophilizing means described above in the hydrophobitization precursors in items 1), 2) and 4) can be used for the surface hydrophilization of the dispersion.

Examples of polymerizable monomers and crosslinkable compounds contained in the hydrophobitization precursors according to the present invention include isocyanate, e.g., phenyl isocyanate, 2,4-tolylene diisocyanate, 2,6-tolylene diisocyanate, 4,4'-diphenylmethane diisocyanate, 3,3'-dimethylbiphenyl-4,4'-diisocyanate, 1,5-naphthalene diisocyanate, tolidine diisocyanate, 1,6-hexamethylene diisocyanate, isophorone diisocyanate, xylylene diisocyanate, lysine diisocyanate, triphenylmethane triisocyanate, bicycloheptane triisocyanate, tridene diisocyanate, polymethylenepolyphenyl isocyanate, and polymeric polyisocyanate; polyisocyanates such as 1/3 molar adducts of trimethylolpropane and the above-described diisocyanate such as 1,6-hexane diisocyanate or 2,4-tolylene diisocyanate, isocyanate compounds such as oligomers or polymers of 2-isocyanatoethyl (meth)acrylate; polyfunctional (meth)acryl monomers or combinations of these with monofunctional (meth)acrylate, e.g., N,N'-methylene-bisacrylamide, (meth)acryloylmorpholine, vinylpyridine, N-methyl (meth)acrylamide, N,N'-dimethyl (meth)acrylamide, N,N'-dimethylaminopropyl (meth) acrylamide, N,N'-dimethylaminoethyl (meth)acrylate, N,N'-diethylaminoethyl (meth)acrylate, N,N'-dimethylaminoneopentyl (meth)acrylate, N-vinyl-2-pyrrolidone, diacetone acrylamide, N-methylol (meth) amylylamide, and p-styrene sulfonic acid or salts thereof, methoxyethylene glycol (meth)acrylate, methoxytetraethylene glycol (meth)acrylate, methoxypolyethylene glycol (meth)acrylate (number average molecular weight of PEG: 400), methoxypolyethylene glycol (meth)acrylate (number average molecular weight of PEG: 1,000), butoxyethyl (meth)acrylate, phenoxyethyl (meth)acrylate, phenoxydiethylene glycol (meth)acrylate, phenoxyethylene glycol (meth) acrylate, phenoxypolyethylene glycol (meth)acrylate, nonylphenoxyethyl (meth) acrylate, dimethyloltricyclodecane di(meth)acrylate, diethylene glycol (meth)acrylate, and tetraethylene glycol di(meth)acrylate, polyethylene glycol di(meth)acrylate (number average molecular weight of PEG: 400), polyethylene glycol di(meth)acrylate (number average molecular weight of PEG: 600), polyethylene glycol di(meth)acrylate (number average molecular weight of PEG: 1,000), polypropylene glycol di(meth)acrylate (number average molecular weight of PEG: 400), 2,2-bis[4-(methacryloxyethoxy)phenyl]propane, 2,2-bis[4-(methacryloxydiethoxy)phenyl]propane, 2,2-bis[4-(methacryloxypolyethoxy)phenyl]propane or acrylate thereof, β-(meth)acryloyloxyethylhydrogenphthalate, β-(meth)acryloyloxyethylhydrogensuccinate, polyethylene or polypropylene glycol mono(meth)acrylate, 3-chloro-2-hydroxypropyl (meth)acrylate, 1,3-butylene glycol di(meth) acrylate, 1,6-hexanediol di(meth)acrylate, neopentyl glycol di(meth) acrylate, trimethylolpropane tri(meth)acrylate, tetramethylolmethane tri(meth)acrylate, tetramethylolmethane tetra(meth)acrylate, isobornyl (meth)acrylate, lauryl (meth) acrylate, tridecyl (meth)acrylate, stearyl (meth)acrylate, isodecyl (meth)acrylate, cyclohexyl (meth)acrylate, tetrafurfuryl (meth)acrylate, benzyl (meth)acrylate, mono(2-acryloyloxyethyl) acid phosphate ormethacrylate, glycerin mono- or di(meth)acrylate, tris(2-acryloxyethyl) isocyanurate or methacrylate, and 2-isocyanatoethyl (meth) acrylate.

When these polymerizable monomers and crosslinkable compounds are used, it is preferred to add a photopolymerization initiator to accelerate the effect by heat. As the examples of the photopolymerization initiators, peroxides such as methyl ethyl ketone peroxide, cyclohexanone peroxide, n-butyl-4,4-bis (t-butylperoxy)valerate, 1,1-bis(t-butylperoxy) cyclodecane, 2,2-bis(t-butylperoxy)butane, cumene hydroperoxide, p-methane hydroperoxide, t-hexyl peroxy benzoate, t-butylperoxy benzoate, and t-butylperoxy acetate can be exemplified.

The addition amount of these polymerizable monomers and crosslinkable compounds is generally from 5 to 95 wt %, preferably from 20 to 90 wt %, and substantially most preferably from 30 to 80 wt %, based on the total weight of the hydrophobitization precursor. The addition amount of the photopolymerization catalyst is 50% or less, preferably 30% or less, more preferably from 1 to 10%, of the total addition amount of the polymerizable monomers and crosslinkable compounds.

Hydrophilic Medium

The explanations of the superficially hydrophilic hydrophobitization precursors and light/heat converting agents which are hydrophilic in themselves or hydrophilic surfaces, which are contained in the hydrophilic image-forming layer, are as described above, and a hydrophilic medium for the image-forming layer will be described below.

A hydrophilic medium according to the present invention has the constitution comprising a hydrophilic high molecular compound, sol/gel convertible material consisting of the system of metallic hydroxide and metallic oxide, hydrophilic sol particles, and as other subsidiary components, compounds, e.g., dyes and surfactants, selected from various purposes such as the control of the degree of hydrophilicity, the improvement of the physical strength of the image-recording layer, the improvement of mutual dispersibility of the compositions constituting the layer, the improvement of coating property, the improvement of printing aptitude, and the convenience of plate-making operation.

It is particularly preferred for the present invention that a hydrophilic image-forming layer comprises a sol/gel convertible system. A sol/gel convertible system having a property of forming polysiloxane gel structure is preferred above all.

<Medium of Sol/Gel Convertible System>

Particularly preferred media for the image-recording layer of the present invention are sol/gel convertible systems described below. That is, the sol/gel convertible system is a sol in the state of a coating solution, becomes a gel state after coating and during the lapse of time, thus can be applied to a printing plate. The sol/gel convertible systems which are preferably applied to the present invention are polymers wherein the bonding groups of polyvalent elements form a network structure via oxygen atoms and, at the same time, polyvalent metals also have hydroxyl groups and alkoxyl groups not bonded and they are mixed and form resinous structure. The systems are in a sol state before coating when there are many alkoxyl groups and hydroxyl groups, and the network resinous structure comes to heighten with the advancement of ester bonding after coating and becomes gel state. In addition to the property that the degree of the hydrophilicity of the resinous structure varies, the sol/gel convertible systems according to the present invention also have the function of bonding a part of the hydroxyl groups to the solid fine particles to modify the surfaces of the solid fine particles, to thereby change the degree of the hydrophilicity. The polyvalent bonding elements of the compounds having sol/gel convertible hydroxyl groups and alkoxyl groups are aluminum, silicon, titanium and zirconium, all of which can be used in the present invention. The sol/gel convertible systems by siloxane bonding which are most preferably used in the present invention are described below. Sol/gel conversion using aluminum, titanium and zirconium can be executed by substituting respective elements with the following-described silicons.

In the above, since the metallic fine piece (i.e., sometimes, called the metallic dust) has a light/heat converting property, i.e., the property of absorbing light energy and converting it to heat energy, if the energy of the irradiated light is sufficiently large, the temperature of the metallic fine piece increases more than the melting point of the metal by the light absorbed by the metallic fine piece itself, as a result, the metallic fine piece fuses and forms a metal thin layer. Further, it is thought that when the metallic fine piece fuses, the binder matrix also fuses together by the work of the heat, and shows the similar function with being surrounded by the metal thin layer. Accordingly, the part irradiated with light forms imagewise metal layer area, and the surface of the metal thin layer shows conspicuous hydrophobicity and also high mechanical strength, therefore, excellent printing quality with high discrimination and the superior printing property can be realized. Moreover, the plate-making process is simple and requires no development, thus sufficiently satisfy the object of the present invention.

This mechanism is further explained by FIG. 1. FIG. 1 is a typical drawing showing a representative plate-making process according to the present invention. Printing plate precursor 1 shown on the left side of FIG. 1 comprises support 2 and image-recording layer 3 provided on support 1, and image-recording layer 3 comprises superficially hydrophilic particles 4 carrying metallic fine piece 5. In the example shown in FIG. 1, metallic fine piece 5 is a dust of metallic silver, and superficially hydrophilic particles 4 are titanium oxide particles. Printing plate 11 on the right side of FIG. 1 shows that silver fine piece 5 melts due to heat by irradiation with laser beam 6 shown in arrows on the upper side of printing plate precursor 1 on the left side and becomes silver thin layer 15, and a hydrophobic area is formed on the surface of the irradiated area of the image-recording layer containing titanium oxide particles 14 where the silver fine piece has vanished.

The superficially hydrophilic particles carrying metallic fine piece are the surfaces of hydrophilic particles 4 in FIG. 1. The hydrophilic surfaces carrying metallic fine piece are preferably the surfaces of the particles. The surface of the printing plate precursor which is hydrophilic by being roughened by the particles is smoothed by the thermo-fusion of the metallic fine piece, and it is thought that the acceleration of hydrophobitization is brought about by the conversion of the surface shape.

As a means to make particle surfaces carry a metallic fine piece, a method of using a metallic compound having a photocatalytic property can be applied to the present invention. According to this method, when the metallic compound is irradiated with an active light in the presence of a reducible metallic salt, the surface of the compound becomes a strongly reducible surface by the catalytic function and reduces the above metallic salt to precipitate a metallic fine piece on the surface.

Another method is a method of using a sparingly water-soluble metallic compound. According to this method, when a reducible metallic salt is subjected to electroless reduction, a metallic fine piece is precipitated on the surface of the sparingly water-soluble metallic compound.

According to the above methods of the present invention, the mere heat mode imagewise light irradiation on the printing plate precursor containing superficially hydrophilic particles carrying metallic fine piece on the surfaces is enough to form a metal layer of the metallic fine piece thermo-fused on the irradiated part, thus an ink-receptive imagewise hydrophobic area is formed, which generates noticeable difference in polarity between a non-irradiated area carrying a metallic fine piece and showing conspicuous hydrophilicity. Therefore, a printing plate causing little printing smearing and excellent in press life can be produced by a simple method requiring no development.

A first feature of the present invention is that since surface roughening is performed with carrying a metallic fine piece, the conspicuously hydrophilized surface is used as the ink-repellent area of the printing plate regardless of the sizes of the original polarities of the fine piece substances.

A second feature of the present invention is that a stable, conspicuously hydrophobic and continuous phase metal surface made of the metallic fine piece by the work of heat is used as the ink-receptive area of the printing plate.

The third is the feature concerning the realizing method of the functional surface carrying the above metallic fine piece, i.e., the feature is that the above characteristic printing plate precursor leading to the printing plate is obtained by using a photocatalyst or electroless reduction.

When a metallic compound having a photocatalytic property is used in the production of a metallic fine piece, the metallic element of the fine piece is preferably a metallic element of after order (noble) in ionization tendency than a hydrogen element and metallic salts comprising such metallic elements are used for the formation of a fine piece.

On the other hand, when electroless reduction is used in the production of a metallic fine piece, a metallic salt donating the metallic element of a fine piece will suffice so long as it is a metallic salt reduced by electroless reduction condition, hence the metallic elements higher in ionization tendency can also be used. Further, it is not necessary for hardly water-soluble particles carrying a metallic fine piece to have a photocatalytic property, thus the material can be selected from a broader range.

Another embodiment of the present invention will be described in detail below.

Preparation of Particles Carrying Metallic Fine Piece

The producing method of particles carrying a metallic fine pieces (sometimes, called metallic dusts) is selected, as described above, from (1) a method of precipitating a metallic fine piece on the surfaces of the metallic compound particles having a photocatalytic property by light irradiation, and (2) a method of precipitating a metallic fine piece on the surface of the sparingly water-soluble metallic compound by electroless reduction.

(1) A method of precipitating a metallic fine piece on the surfaces of the metallic compound particles having a photocatalytic property by light irradiation <Metallic Compound Particles Having Photocatalytic Property>

Metallic compound particles having a photocatalytic property are compounds having a property that the electronic energy level is excited and the reactivity is accelerated when they absorb an active light. The light having an exciting function is called an active light. As the metallic compounds having a photocatalytic property which can be used in the present invention, $TiO_2$, $RTiO_3$ (where R represents an alkaline earth metal atom), $AB_{2-x}C_xD_{3-x}E_xO_{10}$ (where A represents a hydrogen atom or an alkali metal atom, B represents an alkali metal atom or a lead atom, C represents a rare earth atom, D represents a metal atom belonging to Group V-A of the Periodic Table, E represents a metal atom belonging to Group IV of the Periodic Table, and x represents an arbitrary numerical value of from 0 to 2), $SnO_2$, $MoS_2$, $MoSe_2$, $ZrO_2$, ZnO, ZnS, CdS, CdSe, PbS, SiC, $Bi_2O_3$, $WO_3$ and $Fe_2O_3$ can be exemplified.

Titanium oxide ($TiO_2$) produced by arbitrary well-known methods, e.g., sulfuric acid heating calcination or oxygen oxidation after heat chlorination of ilmenite and titanium slug, can be used in the present invention. Any crystal type titanium oxide can be used in the present invention, in particular, anatase type crystals are preferred because of high sensitivity. It is well known that anatase type crystals can be obtained by selecting the calcination conditions to obtain titanium oxide by calcination. In that case, amorphous titanium oxide or rutile type titanium oxide may be contained but those comprising 40% or more of anatase type, preferably 60% or more, are preferred from the above reason.

R of $RTiO_3$ is a metal atom belonging to alkaline earth elements of the Periodic Table, such as magnesium, calcium, strontium, barium, and beryllium, and strontium and barium are particularly preferred. Two or more kinds of alkaline earth metal atoms may coexist so long as the total of the above R stoichiometrically coordinate with the formula.

In formula represented by $AB_{2-x}C_xD_{3-x}E_xO_{10}$, A represents a hydrogen atom or a monovalent atom selected from an alkali metal atom, such as sodium, potassium, rubidium, cesium, and lithium, and two or more kinds of alkali metal atoms may coexist so long as the total of A stoichiometrically coordinate with the formula.

B represents the same alkaline earth metal atom with the above R or a lead atom, and similarly to the above two or more atoms may coexist so long as the total of B stoichiometrically coordinate with the formula.

C represents a rare earth atom, preferably represents, in addition to scandium and yttrium, an atom belonging to lanthanoid series elements, such as lanthanum, cerium, praseodymium, neodymium, holmium, europium, gadolinium, terbium, thulium, ytterbium, or lutetium, and two or more atoms may coexist so long as the total of C stoichiometrically coordinate with the formula.

D represents one or more metal atoms belonging to elements of Group V-A of the Periodic Table, such as vanadium, niobium or tantalum, and two or more Group V-A atoms may coexist so long as the stoichiometrical relationship is satisfied.

E represents a metal atom belonging to elements of Group IV of the Periodic Table, such as silicon, germanium, tin, lead, titanium, or zirconium, and two or more Group IV metal atoms may coexist.

x represents an arbitrary numerical value of from 0 to 2.

Specific examples of the compounds represented by formula $AB_{2-x}C_xD_{3-x}E_xO_{10}$ include $CsLa_2NbTi_2O_{10}$, $HCa_{1.5}La_{0.5}Nb_{2.5}Ti_{0.5}O_{10}$, and $LaNbTi_2O_{10}$.

As the manufacturing method of these compounds, for example, fine particles of $CsLa_2NbTi_2Ol_0$ can be obtained by finely pulverizing stoichiometrically corresponding $Cs_2CO_3$, $La_2O_3$, $NbO_5$ and $TiO_2$ in a mortar, putting the content in a platinum crucible and calcining at 130° C. for 5 hours, then cooling the calcined product and putting it again in the mortar and pulverizing to fine particles of a particle size of several micrometers or less. This method is not limited to fine particles of $CsLa_2NbTi_2O_{10}$ and also applied to $HCa_{1.5}La_{0.5}Nb_{2.5}Ti_{0.5}O_{10}$ and $LaNbTi_2O_{10}$ represented by above formula $AB_{2-x}C_xD_{3-x}E_xO_{10}$ ($0<x<2$).

As other metallic compounds having a photocatalytic property, those easily commercially available can be used.

In the present invention, a dispersed particle layer comprising at least one compound alone or combination of two or more of $TiO_2$, $RTiO_3$, $AB_{2-x}C_xD_{3-x}E_xO_{10}$, $SnO_2$, $MoS_2$, $MoSe_2$, $ZrO_2$, ZnO, ZnS, CdS, CdSe, PbS, SiC, $Bi_2O_3$, $WO_3$ and $Fe_2O_3$ is provided on the support.

The optimal particle sizes of these metallic compound particles differ by the refractive indices and the absorption coefficients of the substances constituting the particles but are in general from 0.01 to 10 m, preferably from 0.02 to 5 $\mu$m. Light absorption becomes inefficient due to light scattering if the particle sizes are too fine, and due to the reduction of dispersibility and interfacial reflection of particles if too big.

The content of metallic compound particles in the hydrophilic layer containing metallic compound particles having a photocatalytic property is from 2 to 90 wt %, preferably from 5 to 80 wt %.

<Superficially Hydrophilic Light/Heat Convertible Fine Piece>

A light/heat convertible substance carried as a fine piece on the surface of a metallic salt having a photocatalytic property may be hydrophilic or hydrophobic in itself if the substance exhibits hydrophilicity in the carried state, and various well-known light/heat convertible substances can be used in the present invention.

Light/heat convertible substances which can be preferably used in the present invention are metallic fine piece and Al, Si, Ti, V, Cr, Mn, Fe, Co, Ni, Cu, Zn, Y, Zr, Mo, Ag, Au, Pt, Pd, Rh, In, Sn and W can be exemplified.

Preferred among metals constituting these metallic dust are metals of after order (noble) in ionization tendency than a hydrogen element, e.g., Ag, Au, Cu, Pt, Pd and Rh, and particularly preferred elements are Ag, Au and Cu. These metals can be carried on the surfaces of particles of a metallic compound having a photocatalytic property by the above methods, but more preferably, when the particles of a metallic compound having a photocatalytic property are irradiated with an active light in the presence of the water-soluble salts of the above metals, the water-soluble salts are photo-reduced and precipitated on the surface a metallic compound having a photocatalytic property as a dust, thus a hydrophilic surface is formed. Accordingly, the metallic compound particles having a photocatalytic property carrying a hydrophilic light/heat convertible dust of the present invention can be easily obtained.

Water-soluble metallic salts which are used for forming a metallic dust are nitrates, sulfates, halogen acid salts, halides, halogen acid complex salts, ammonium complex salts (ammoniacal aqueous solution of each of the above salts), and sulfites of the above preferred metals.

Metallic complex salt of ammonium and carboxylic acid may also be used. For example, silver ammine complex nitrate, silver acetate, silver lactate and silver benzoate can be exemplified.

<Method of Carrying Metallic Fine Piece>

For the surface of a metal having a photocatalytic property to carry a metallic fine piece, the metal having a photocatalytic property is irradiated with an active light in the presence of the metallic salt corresponding to the metal of the fine piece (i.e., the precursor of the metallic fine piece). Specifically, any of the following methods can be used, i.e., a method in which a hydrophilic layer containing metallic compound particles having a photocatalytic property dispersed therein is immersed in an aqueous solution of a metallic salt, and the entire surface is irradiated with an active light, a method in which a hydrophilic layer containing metallic compound particles having a photocatalytic property is impregnated with an aqueous solution of a metallic salt and the entire surface is irradiated with an active light, a method in which a hydrophilic layer containing a metallic salt together with metallic compound particles having a photocatalytic property is irradiated with an active light, a method in which metallic compound particles having a photocatalytic property is suspended in a solution containing a metallic salt, irradiated with an active light to precipitate a metallic fine piece on the surfaces of the metallic compound particles in advance, and a method in which a coating solution containing at least metallic compound particles and a metallic salt is irradiated with an active light to precipitate a metallic fine piece on the surfaces of the metallic compound particles, and then a printing plate is produced. When an aqueous solution of a metallic salt is used, the concentration of the metallic salt in the aqueous solution is from 0.0001 to 10 mol/liter, preferably from 0.001 to 5 mol/liter, and more preferably from 0.01 to 3 mol/liter. When a metallic salt is impregnated or added to a photosensitive printing plate precursor, the metallic salt is impregnated or added so that the concentration in the coated layer on a dry film base becomes from 0.0001 to 10 mol/liter, preferably from 0.001 to 5 mol/liter, and more preferably from 0.01 to 3 mol/liter.

The coating rate of the dust of a light/heat convertible substance carried on the surface of a metal having a photocatalytic property can be selected arbitrarily within the range of exhibiting heat mode light response. In general, the coating rate exhibiting heat mode light response on a practicable level is 2% or more, and the entire surface maybe coated. However, for maintaining high surface hydrophilicity, the coating rate is 90% or less, preferably from 20 to 80%. The coexistent concentration of a metallic salt, the irradiation intensity of an active light and the irradiation time are selected so as to reach the above range of the coating rate. The light exposure amount is from 0.01 to 20 CMS, preferably from 0.1 to 10 CMS, and reciprocity law failure is negligible.

The active light means the light of the wavelength by the absorption of which a compound having a photocatalytic property is activated and exhibits catalytic function. The light sources of the active light are a mercury lamp such as a high pressure mercury lamp, a xenon arc lamp, a xenon electric discharge lamp, various kinds of fluorescent lamps, a tungsten-halogen lamp, and laser beams having oscillation wavelength at visible ray region and ultraviolet ray region, which are selected according to the plate-making methods and the kinds of compounds having a photocatalytic property.

Further, it is preferred to contain a oxidizable compound at active light irradiation for the purpose of accelerating the precipitation of a metallic fine piece. Examples of the compounds for use for this purpose include saccharides and carbohydrates such as maltose, lactose, dextran, dextrin, and soluble starch, aldehydes such as formaldehyde, acetaldehyde, glyoxal, and succindialdehyde, alcohols and phenols having a hydroxyl group such as sorbitol, polyethylene glycol, polyvinyl alcohol, and hydroquinone, compounds having a carboxyl group such as polyacrylic acid, ethers such as ethylene glycol dimethyl ether, amides such as N-methylpyrrolidone, esters such as ethylene glycol monomethyl monoacetate, and ketones such as acetyl ketone. The addition amount of these compounds varies according to the kinds of compounds but when they are added to a hydrophilic layer, the amount is from 0.1 to 50 wt %, preferably from 0.5 to 30 wt %, based on the weight of the solid content in the hydrophilic layer, and when they are added to an aqueous solution containing a metallic salt, the amount is from 0.001 to 5 wt %, preferably from 0.01 to 1 wt %.

(2) Method of precipitating a metallic fine piece on the surface of sparingly water-soluble metallic compound by electroless reduction <Sparingly Water-soluble Metallic Compound Particles>

Sparingly water-soluble compounds which can be applied to the method of precipitating a metallic fine piece by electroless reduction can be used in the present invention if they are metallic compounds substantially hardly soluble in the coating solution for an image-forming layer, and capable of becoming particles dispersible in an image-forming layer. Examples of preferred metallic compounds include oxides, hydroxides and sulfates of the metallic element belonging to Groups II to VI and Group VIII of the Periodic Table, minerals and synthetic minerals containing these metallic compounds and glass.

Examples of the preferred compounds belonging to oxides, hydroxides and sulfates of the metallic element belonging to Groups II to VI and Group VIII of the Periodic Table include sulfates of Group II-A elements, oxides and hydroxides of Groups II-B, III to V, VI-A and VIII elements, specifically sulfates of Ba, Ca and Sr, and oxides and hydroxides of Al, Ga, Ti, Zr, Sn, Pb, V, Nb, Ta, Cr, Mo, W, Fe, Co, Ni, Pd, Rh, Si and Mn.

Particularly preferred of these are barium sulfate, alumina, zirconia, titanium oxide, silicon dioxide, tin oxide, vanadium oxide, chromium oxide, ferric oxide, triiron tetroxide, lead oxide, nickel oxide and cobalt oxide are particularly preferred.

As preferred examples of minerals and synthetic minerals containing these elements of the Periodic Table, silica, zeolite, montmorillonite, kaolinite, zeophyllite, and Molecular Sieves of various structures can be exemplified.

As preferred examples of glass, soda glass, boro-silicate glass, lead glass, quartz glass and boron glass can be exemplified. So-called low melting point glass whose composition is modified by increasing the content of a lead oxide and the like can be exemplified as a preferred example due to its contribution to the shape change of glass particles with light irradiation.

The particles of these hardly water-soluble metallic compound preferably have a particle size which is dispersible in an image-recording layer, i.e., from 0.005 to 10 $\mu$m, preferably from 0.01 to 5.0 $\mu$m, and more preferably from 0.05 to 3.0 $\mu$m. These metallic compound particles may subjected to well-known surface treatments, e.g., silicate treatment, according to the necessity of improving the dispersibility in a hydrophilic image-recording layer.

The content of the hardly water-soluble metallic compound particles in the hydrophilic layer containing the hardly water-soluble metallic compound particles is from 2 to 90 wt %, preferably from 5 to 80 wt %.

<Reducible Metallic Salt>

Reducible metallic salts (i.e., metallic salts which are reduced) which can be applied to the present invention will be explained below.

Since the non-reducibility of metallic salts are determined by the control of electroless reduction condition, usable metallic salts can be selected from the broader range than in the case of precipitating a metallic dust by utilizing photocatalytic property as described above. Preferred metallic salts are water-soluble metallic salts and the salts of elements of after order in ionization tendency of the constitutional metallic element than a chromium element, i.e., the salts of nobler elements. These metallic elements include chromium, cobalt, nickel, tin, titanium, lead, iron(III), copper, molybdenum, tungsten, rhodium, iridium, palladium, mercury, silver, platinum and gold.

The metallic elements constitute particularly preferred metallic salts are silver, copper, iron, nickel, lead, palladium, gold, platinum, tungsten, titanium, cobalt and chromium, and most preferred are iron, chromium, gold, silver and copper.

The counter salts of the metallic element of metallic salts may be any form of salt so long as they are water-soluble, e.g., they are selected from inorganic salts such as nitrate, sulfate, chloride, and thiocyanate, ammine complex salts such as silver ammonium complex nitrate and copper ammonium complex nitrate, and polyhalo complex salts of silver and gold such as polychloro-silver complex ion.

<Reducing Agent for Electroless Reduction>

The reducing agents to be combined with reducible metallic salt are described below.

As described above, the condition of a reducing agent is that the oxidation potential of the reducing agent is lower than the reduction potential of the metallic salt combined in the system of the concerned aqueous solution, which practically means that the maximum potential of the oxidation wave of the reducing agent is on the negative side (less side) than the maximum potential of the reduction wave of the metallic salt. More preferably, the reduction potential of the metallic salt is nobler than the oxidation potential of the reducing agent by 20 mV or more.

As a practical standard, reducible compounds having the maximum potential of the oxidation wave of from +100 to −700 mV (SCE) are preferred. Hydrogen ions (or hydroxide ion) are concerned in many oxidation/reduction reaction, hence the maximum potential of the reduction wave in cyclic voltammetry of reducible compounds largely differ by pH. Accordingly, the condition capable of precipitation and precipitation rate can be selected by the control of pH, and when the metallic salts are the above-described gold, silver or copper compounds, the appropriate maximum oxidation potential of the reducing agent is from +100 to −700 mV (SCE) in the system of the concerned aqueous solution. Preferred reducing agents falling in this range of potential in the system of an alkaline aqueous solution will be described in further detail below.

Specific examples of the reducing agents are shown below.

1) Saccharides and Carbohydrates

Saccharides and carbohydrates including starches which are polymerized form of saccharides are used in the present invention as preferred reducing agents. The reducing property of saccharides and carbohydrates are thought to be weak, however, they have reducing property to sufficiently reduce the above-described reducible metallic salts under alkaline condition. In addition, they can be used in high concentration and the reduction reaction advances uniformly, therefore, even precise patterns can be formed with accuracy.

As preferred specific examples, the following can be exemplified.

Specific examples of monosaccharides for use in the present invention are shown below. The following can be exemplified as monosaccharides: glyceraldehyde, dihydroxyacetone (inclusive of a dimer), erythrose, threose, ribose, arabinose, xylose, lyxose, xylulose, ribulose, deoxy-D-ribose, allose, altrose, glucose, mannose, gulose, idose, galactose, talose, quinovose, digitalose, digitoxose, cymarose, sorbose, tagatose, fucose, 2-deoxy-D-glucose, psicose, fructose, rhamnose, D-glucosamine, D-galactosamine, D-mannosamine, D-glycero-D-galactoheptose, D-glycero-D/L-mannoheptose, D-glycero-D-gloheptose, D-glycero-D-idoheptose, D-glycero-L-glucoheptose, D-glycero-L-taloheptose, altroheptulose, mannoheptulose, altro-3-heptulose, glucuronic acid, N-acetyl-D-glucosamine, glycerol, threitol, erythritol, arabitol, adonite, xylitol, sorbitol, mannitol, iditol, talitol, dulcitol, and allodulcitol.

Of these exemplified compounds, particularly preferably used are xylose, glucose, mannose, galactose, sorbose, D-glycero-D/L-mannoheptose, glycerol, sorbitol and mannitol.

Specific examples of polysaccharides for use in the present invention are shown below. The following can be exemplified as polysaccharides: maltose, cerbiose, trehalose, gentiobiose, isomaltose, lactose, raffinose, gentianose, stachyose, xylan, araban, glycogen, dextran, inulin, levan, galactan, agarose, amylose, sucrose, agarobiose, α-dextrin, β-dextrin, γ-dextrin, δ-dextrin, __-dextrin, soluble starch, and thin paste starch. As derivatives of polysaccharides, methyl cellulose, dimethyl cellulose, trimethyl cellulose, ethyl cellulose, diethyl cellulose, triethyl cellulose, carboxymethyl cellulose, carboxyethyl cellulose, aminoethyl cellulose, hydroxymethyl cellulose, hydroxyethylmethyl cellulose, hydroxypropyl cellulose, hydroxypropylmethyl cellulose, hydroxypropylmethyl cellulose acetate succinate, and carboxymethylhydroxyethyl cellulose can be used.

Of these exemplified compounds, maltose, lactose, dextran, inulin, amylose, sucrose, α-dextrin, β-dextrin, γ-dextrin, soluble starch, methyl cellulose, ethyl cellulose, carboxymethyl cellulose, carboxyethyl cellulose, hydroxymethyl cellulose, hydroxyethylmethyl cellulose, hydroxypropyl cellulose, hydroxypropylmethyl cellulose, hydroxypropylmethyl cellulose acetate succinate, and carboxymethylhydroxyethyl cellulose are particularly preferably used.

Saccharides are in existence widely and naturally and easily commercially available. In addition, they can be easily synthesized by reduction, oxidation or dehydration reaction with various kinds of derivatives.

When saccharides are used as a reducing agent, the pH of the aqueous solution for electroless reduction for the precipitation of a metallic dust is preferably 8 or more, more preferably 10 or more, and particularly preferably 12 or more. The upper limit may be the region where pH has no substantial means, i.e., 14 or more, or the concentration of alkali hydroxide may be 10%.

The addition amount of these saccharides to the aqueous solution for electroless reduction is from 0.1 to 30 wt %, preferably from 0.5 to 15 wt %, and it is preferred that the total amount thereof is stoichiometrically larger than the amount of the metallic salt when the metallic salt is coexistent in the aqueous solution and also when contained in the materials of the image-recording layer. In general, the amount is from 1.0 to 10 equivalent weight, preferably from 1.01 to 5 equivalent weight, based on the metallic salt. The optimal range differs according to the existence of a metallic compound and a complex-forming agent.

2) Aldehydes

As can be thought from the example of Fehling's solution, aldehydes can be used in the present invention as a reducing agent. Specific examples of the aldehyde compounds which can be used in the present invention include aliphatic saturated aldehydes such as formaldehyde, glutaraldehyde, acetaldehyde, propionaldehyde, and butyraldehyde, aliphatic dialdehyde such as glyoxal and succindialdehyde, unsaturated aldehydes such as acrolein, crotonaldehyde and propiolaldehyde, aromatic aldehydes such as benzaldehyde and salicylaldehyde, and heterocyclic aldehyde such as furfural, in addition, sucroses having an aldehyde group or a ketone group, monosaccharides such as glucose, fructoses, oligosaccharides, monosaccharides-substituted deoxysugar, methylglycose, thiosugar, and amino sugar.

The addition amount of these aldehyde compounds to the aqueous solution for electroless reduction is from 0.02 to 5.0 mol, preferably from 0.1 to 2.0 mol, per liter of the aqueous solution. Aldehydes are preferably used under alkaline condition, pH is from 7 to 14, preferably from 9 to 12.

3) Photographic Developing Agent

Further, the following compounds which are known as photographic developing agents are also preferably used as the reducing agent for electroless reduction, e.g., hydroquinones such as hydroquinone and monochlorohydroquinone, catechols such as catechol and pyrocatechol, p-aminophenols such as p-aminophenol and N-methyl-p-aminophenol, p-phenylenediamines such as p-phenylenediamine, 2-methyl-p-phenylenediamine, and diethyl-p-phenylenediamine, 3-pyrazolidones such as o-phenylenediamine and 1-phenyl-3-pyrazolidones, 3-aminopyrazoles, 4-aminopyrazolones, 5-aminouracils, 4,5-dihydroxy-6-aminopyridines, leductones such as ascorbic acid, erysorbic acid, and leductonic acid, o- or p-sulfonamidonaphthols, o- or p-sulfonamidophenols, 2,4-disulfonamidophenols, resorcins such as resorcin and diaminoresorcin, 2,4-disulfonamidonaphthols, o- or p-acylaminophenols, 2-sulfonamidoindanones, 4-sulfonamido-5-pyrazolones, 3-sulfonamidoindoles, sulfonamidopyrazolobenzimidazoles, sulfonamidopyrazolobenztriazoles, sulfonamide ketones, and hydrazines such as arylhydrazine, phenylhydrazine and hydrazobenzene.

Leductones do not adversely influence oxidants, hence particularly preferred. Particularly preferred leductones are ascorbic acid, erysorbic acid, glucoleductone and leductonic acid.

The addition amount of these developing agents to the aqueous solution for electroless reduction is from 0.005 to 1.0 mol, preferably from 0.05 to 0.5 mol, per liter of the aqueous solution. When developing agents are used as the reducing agent, they are also preferably used under alkaline condition, pH is preferably lower than that in the developing condition of photographic materials, e.g., from 5 to 12, preferably from 7 to 9.

<Method of Carrying Metallic Fine Piece>

For the surface of a hardly water-soluble metallic compound to carry a metallic fine piece, the aqueous solution for electroless reduction containing a reducing agent is applied to the surface of the metallic compound in the presence of the metallic salt corresponding to the metal of the fine piece (i.e., the precursor of the metallic fine piece). Specifically, any of the following methods can be used, i.e., a method in which a metallic salt and a reducing agent are added to the aqueous solution for electroless reduction, and a hydrophilic image-recording layer containing metallic compound particles dispersed therein is immersed in or impregnated with the aqueous solution to thereby precipitate a metallic fine piece on the surfaces of the particles, a method in which a hydrophilic image-recording layer containing a metallic salt together with metallic compound particles is immersed in or impregnated with the aqueous solution containing a reducing agent to thereby precipitate a metallic fine piece on the surfaces of the particles, and a method in which hardly water-soluble metallic compound particles are suspended in the aqueous solution for electroless reduction containing a reducing agent, to thereby precipitate a metallic fine piece on the surfaces of the metallic compound particles in advance, and an image-recording layer is coated with the above metallic compound particles. When an aqueous solution of a metallic salt is used, the concentration of the metallic salt in the aqueous solution is from 0.0001 to 10 mol/liter, preferably from 0.001 to 5 mol/liter, and more preferably from 0.01 to 2 mol/liter. When a metallic salt is impregnated or added to an image-recording layer, the metallic salt is impregnated or added so that the concentration in the reduction reaction atmosphere of the precipitation of a metallic fine piece becomes from 0.0001 to 10 mol/liter, preferably from 0.001 to 5 mol/liter, and more preferably from 0.01 to 2 mol/liter.

The preferred coating rate of a metallic fine piece carried on the surface of a metallic compound is the same as described above in the metallic compound particles having a photocatalytic property, and can be selected arbitrarily within the range of exhibiting heat mode light response. In general, the coating rate exhibiting heat mode light response on a practicable level is 2% or more, and the entire surface may be coated. However, for maintaining high surface hydrophilicity, the coating rate is 90% or less, preferably from 20 to 80%. The concentrations of a reducing agent and a metallic salt, pH, temperature and reaction time are selected so as to reach the above range of the coating rate.

<Other Auxiliary Additives>

The aqueous solution for electroless reduction or, if necessary, a hydrophilic image-recording layer may contain the following compounds for the purpose of accelerating the precipitation of a metallic fine piece or suppressing a side-reaction.

1) Complex-forming Agent

Complex-forming agents, which are not an essential component in the present invention but are preferably used for the precipitation of a metallic fine piece according to the kinds of metallic salts and reducing agents, will be described below. A complex-forming agent is added to the aqueous solution for electroless reduction but it may be added to a hydrophilic image-recording layer according to circumstances.

In the system of the aqueous solution for electroless reduction, the reduction precipitation of a metallic salt often competes with the formation reaction of a metallic hydroxide, the aqueous solution frequently becomes unstable. Accordingly, in such a case, it is preferred to add a complex-forming agent corresponding to the metal ion to an alkaline solution of a water-soluble metallic salt to stabilize the metallic salt. Such a complex-forming agent preferably has a total safety constant of at least 10 or more, and the system in which a complex-forming agent is at least equimolar or more to the water-soluble metallic salt is selected.

Preferred complex-forming agents which satisfy the conditions to water-soluble metallic salts, in particular, gold, silver and copper compounds, are selected from nitrogen-containing organic compounds, sulfur-containing organic compounds and oxygen-containing organic compounds. Particularly preferred complex-forming agents are selected from each compound group of halide, thiocyanic acid, cyanide, alkanolamine, aliphaticamine, cyclicamine, aminoacid, ammonium, thiourea, and thiosulfate.

Specific examples of complex-forming agents are described below but the complex-forming agents for use in the present invention are not limited thereto.

Chlorine ion, bromine ion, iodine ion, ammonium, cyanide ion, thiocyanate ion, sulfite ion, thiosulfate ion, thiourea, aliphatic primary amine (straight chain or branched dodecylamine, hexylamine, nonylamine, pentadecylamine, etc.), cyclic amine (pyridine, imidazole, 2-methylimidazole, triazole, thiadiazole, picoline, piperazine, pyrrole, piperidine, pyrazine, pyrimidine, pyridazine, isothiazole, quinoline, isoquinoline, etc.), alkanolamine (diethanolamine, monoethanolamine, isopropanolamine, triisopropanolamine, etc.), polyamine (triethylenetetramine, pentaethylenehexamine, diethylenetriamine, ethylenediamine, etc.), amino acid (alanine, arginine, histidine, cysteine, methionine, glutamine, etc.), thiol (thioglycol, etc.), thiosemicarbazide and thiouracil.

The complex-forming agents to silver ions are described in T. H. James, *The Theory of the Photographic Processes*, 4th Ed., pp. 8 to 11, Macmillan Publishing Co., Inc.

Of the above complex-forming agents of metal ions, particularly preferred are alkali metal ions, alkaline earth metal ions and ammonium salts of each ion of chlorine ion, bromine ion, cyanide ion, thiocyanate ion, thiosulfate ion, each base itself or chloride, sulfate or hydrochloride of thiourea, ammonia, imidazole, 2-methylimidazole, and ethylenediamine.

When a complex-forming agent is used by adding to the aqueous solution for electroless reduction, the concentration of the metallic salt in the aqueous solution is from 0.01 to 10 mol/liter, preferably from 0.05 to 5 mol/liter, and more preferably from 0.1 to2 mol/liter. When a complex-forming agent is impregnated or added to an image-recording layer, impregnation or addition is performed so that the concentration in the reduction reaction atmosphere of the precipitation of a metallic fine piece becomes from 0.01 to 10 mol/liter, preferably from 0.05 to 5 mol/liter, and more preferably from 0.1 to 2 mol/liter.

2) Alkali Agent and pH Buffer

An alkali agent for adjust pH appropriately and, if necessary, a pH buffer for maintain the pH stably are added to the aqueous solution for electroless reduction.

As an alkali agent or a pH buffer, alkali metal hydroxide, alkaline earth metal hydroxide, carbonate, phosphate, borate, tetraborate, hydroxybenzoate, glycyl salt, N,N-dimethylglycine salt, leucine salt, norleucine salt, guanine salt, 3,4-dihydroxyphenylalanine salt, alanine salt, aminobutyrate, 2-amino-2-methyl-1,3-propanediol salt, valine salt, proline salt, trihydroxyaminomethane salt, and lysine salt can be used. In particular, carbonate, phosphate, tetraborate, and hydroxybenzoate are excellent in buffering performance at high pH region of 9.0 or more.

Specific examples of these alkali agents and pH buffers include potassium hydroxide, sodium hydroxide, calcium hydroxide, magnesium hydroxide, tetramethylammonium hydroxide, sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate), but the present invention is not limited to these compounds.

The amount of an alkali agent or a buffer, and the total amount when used in combination, is from 0.02 to 5.0 mol/liter, particularly from 0.1 to 2.0 mol/liter.

When an alkali agent and a buffer are used by adding to the aqueous solution for electroless reduction, the concentration of them in the aqueous solution is from 0.01 to 10 mol/liter, preferably from 0.02 to 2 mol/liter, and more preferably from 0.05 to 1 mol/liter. When they are impregnated or added to an image-recording layer, impregnation or addition is performed so that the concentration in the reduction reaction atmosphere of the precipitation of a metallic fine piece becomes the above concentration.

3) Surfactant

An alkaline aqueous solution containing a water-soluble metallic compound and a reducing agent, preferably further containing a complex-forming agent to a metal, can additionally contain a surfactant as well for the purpose of advancing precipitation of a metal uniformly and smoothly and improving the accuracy of the metal pattern formed.

Surfactants may be any of nonionic, anionic (each includes ampholytic) and cationic so long as they can lower the contact angle of an aqueous solution and a substrate material, but nonionic surfactants and anionic surfactants are particularly preferred.

As preferred nonionic surfactants, polyoxyethylene alkyl ethers, e.g., polyoxyethylene lauryl ether, polyoxyethylene stearyl ether, polyoxyethylene cetyl ether, and polyoxyethylene oleyl ether, polyoxyethylene alkylaryl ethers, e.g., polyoxyethylene octylphenyl ether, and polyoxyethylene nonylphenyl ether, polyoxyethylene-polyoxypropylene block copolymers, composite polyoxyalkylene alkyl ethers, e.g., polyoxyethylene-polyoxypropylene block copolymer to which an aliphatic group having from 5 to 24 carbon atoms is bonded at the terminal hydroxyl group by ether bonding, and polyoxyethylene-polyoxypropylene block copolymer to which an alkyl-substituted aryl group is bonded at the terminal hydroxyl group by ether bonding, sorbitan fatty acid esters, e.g., sorbitan monolaurate, sorbitan monopalmitate, sorbitan monostearate, sorbitan monooleate, sorbitane trioleate, and sorbitan triastearate, and polyoxyethylene sorbitan fatty acid esters, e.g., polyoxyethylene sorbitan monolaurate, polyoxyethylene sorbitan monopalmitate, polyoxyethylene sorbitan monostearate, polyoxyethylene sorbitan trioleate, and polyoxyethylene sorbitan tristearate.

Examples of anionic surfactants include alkylsulfonic acids, arylsulfonic acids, aliphatic carboxylic acids, aromatic carboxylic acids, alkylnaphthalenesulfonic acids, condensation products of naphthalenesulfonic acid or alkylnaphthalenesulfonic acid with formaldehyde, aliphatic carboxylic acids having from 9 to 26 carbon atoms, aliphatic sulfonic acids having from 9 to 26 carbon atoms, alkylbenzenesulfonic acids, and polyoxyethylene-containing sulfuric acids and polyoxyethylene-containing phosphoric acids, e.g., lauroylpolyoxyethylene sulfuric acid, stearoylpolyoxyethylene sulfuric acid, cetyloxypolyoxyethylene sulfonic acid, and oleyloylpolyoxyethylenephosphonic acid.

The addition amount of these surfactants is generally from 0.1 to 10 g, preferably from 0.5 to 5 g, per liter of the aqueous solution for electroless reduction.

Surfactants may be used alone or in combination of two or more.

4) Viscosity Controlling Agent

For controlling the viscosity of the aqueous solution containing a reducible metallic salt and a reducing agent and for precipitating a metallic dust on the surfaces of metallic compound particles uniformly and not coarsely, the aqueous solution can contain a water-soluble high molecular compound as a viscosity controlling agent.

High molecular compounds which show a certain degree of viscosity increase when dissolved in an aqueous solution, have a function of protective colloid, and do not adversely affect the reducing property of an aqueous solution can be used. As for the viscosity, a high molecular compound is added so as to reach a viscosity coefficient of from 0.05 to 50 cp (centipoise), preferably from 0.1 to 20 cp. A viscosity coefficient, i.e., viscosity, can be obtained with a falling ball viscometer, a rotational viscometer, an Ostwald viscometer, or arbitrary viscometers based on the same principle as any of the above and having appropriate measurement range. The above-described viscosity is the measured value at 25° C. unless otherwise indicated.

Preferred examples of water-soluble high molecular compounds include gelatin, polyvinyl alcohol, partially saponified polymer of polyvinyl alcohol, polyvinyl pyrrolidone, partially saponified polymer of polyvinyl pyrrolidone, polyacrylic acid, polymethacrylic acid, and water-soluble esters thereof; polystyrene sulfonic acid; copolymers of acrylic acid, methacrylic acid, and water-soluble esters thereof, styrene and acrylonitrile; and water-soluble cellulose derivatives such as methyl cellulose, ethyl cellulose, hydroxymethyl cellulose, hydroxyethyl cellulose, carboxymethyl cellulose, carboxyethyl cellulose, methoxymethyl cellulose, and methoxyethyl cellulose.

The addition amount of these water-soluble high molecular compounds is appropriately selected so as to reach the above viscosity, in many cases the addition amount is from 1 to 20 g per liter of the aqueous solution for electroless reduction.

These high molecular compounds may be used alone or in combination of two or more.

<Pretreatment of Activation>

There are cases where the precipitation of a metallic fine piece does not sufficiently advance according to the combination of reducible metallic salts and reducing agents. In such a case, activation pretreatment may be performed to provide in advance a highly active precipitation speck on the surface of the particle carrying a metallic dust.

Preferred precipitation specks are metallic fine particles of palladium, platinum, iridium or rhodium. When a palladium speck is provided as a precipitation speck, the surface of the particle carrying a metallic dust is treated with a tin chloride solution obtained by dissolving from 0.2 to 0.5 mol of tin chloride per liter of a 0.01 to 0.1 mol of a hydrochloric acid aqueous solution for 1 to 10 minutes at room temperature, and then treated with a palladium chloride solution obtained by dissolving from 0.1 to 0.5 g of palladium chloride per liter of a 0.01 to 0.1 mol of a hydrochloric acid aqueous solution for 1 to 3 minutes at room temperature. Palladium complex salts, such as palladium potassium chloride may be used in place of palladium chloride. When metallic fine particles of platinum, iridium or rhodium are used as the precipitation specks, treatment is performed in the same manner by using the acid solution of each metallic compound.

In electroless reduction to make a hardly water-soluble particle surface carry a metallic dust, the temperature suitable for each reaction system is selected from the range of from room temperature to 90° C., in many cases the temperature is preferably from 25 to 50° C. The time of the treatment is also appropriately selected according to the temperature, generally the reaction condition that a metallic dust is formed from several seconds to 10 minutes is selected. The activity of electroless reduction system is adjusted by controlling the concentration of each of a water-soluble metallic salt, a complex-forming agent, and a reducing agent, and the pH of a reaction solution.

Constitution of Image-Recording Layer

The metallic compounds carrying a superficially hydrophilic light/heat convertible fine piece according to the present invention have been described. The constitution of an image-recording layer, i.e., a photosensitive layer, containing the metallic compound will be described below.

The constitution of an image-recording layer according to the present invention comprises a hydrophilic medium having dispersed therein metallic compound particles carrying a superficially hydrophilic light/heat convertible dust. The hydrophilic medium is preferably a hydrophilic high molecular medium or a hydrophilic sol/gel convertible medium, particularly preferably a hydrophilic sol/gel convertible medium. Above all, sol/gel convertible systems having the property of forming gel structure of polysiloxane are preferred. Image recording of the present invention is performed by irradiating the photosensitive layer with laser beam to thereby convert the photosensitive layer to hydrophobic, thus the photosensitive layer according to the present invention is sometimes called the image-recording layer. Hydrophilic media of the image-recording layer are described below.

<Medium of Sol/Gel Convertible System>

Particularly preferred binders for the image-recording layer of the present invention are sol/gel convertible systems described below. The sol/gel convertible systems which are preferably applied to the present invention are polymers wherein the bonding groups of polyvalent elements form a network structure via oxygen atoms and, at the same time, polyvalent metals also have hydroxyl groups and alkoxyl groups not bonded and they are mixed and form resinous structure. The systems are in a sol state when there are many alkoxyl groups and hydroxyl groups, and the network resinous structure comes to heighten with the advancement of ether bonding. In addition to the property that the degree of the hydrophilicity of the resinous structure varies, the sol/gel convertible systems according to the present invention also have the function of bonding a part of the hydroxyl groups to the solid fine particles to modify the surfaces of the solid fine particles, to thereby change the degree of the hydrophilicity. The polyvalent bonding elements of the compounds having sol/gel convertible hydroxyl groups and alkoxyl groups are aluminum, silicon, titanium and zirconium, all of which can be used in the present invention. The sol/gel convertible systems by siloxane bonding which are most preferably used in the present invention are described below. Sol/gel conversion using aluminum, titanium and zirconium can be executed by substituting respective elements with the following-described silicons.

That is, particularly preferably used systems are sol/gel convertible systems containing silane compounds having at least one silanol group.

Systems utilizing sol/gel conversion are further described below.

Inorganic hydrophilic matrices formed by sol/gel conversion are preferably resins having a siloxane bond and a silanol group. The image-recording layer of a lithographic printing plate precursor according to the present invention is a sol system containing a silane compound having at least one silanol group, wherein hydrolysis condensation of the silanol group advances to form the structure of a siloxane skeleton, and gelation progresses during the lapse of time after coating. The layer formed by the sol/gel conversion has high degree of hydrophilicity, thus discriminating property from the hydrophilic area becomes large, which is an advantageous characteristic of the present invention. Recording layers containing materials such as the later-described organic high molecular compounds in the gel structure of the medium for the purpose of improving physical properties (e.g., the improvement of film thickness and flexibility) and coating property are preferably used in the present invention.

A siloxane resin having gel structure is represented by the following formula (I), and a silane compound having at least one silanol group is represented by the following formula (II). A substance which converts from hydrophilic to hydrophobic contained in the image-recording layer is not necessarily a silane compound represented by formula (II) alone, in general, the substance may comprise the oligomer of the silane compound partially polymerized by hydrolysis, or may be mixture of the silane compound and the oligomer thereof.

(I)

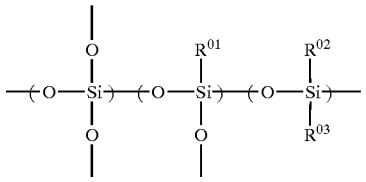

The siloxane-based resin represented by formula (I) is formed by sol/gel conversion from the dispersion solution containing at least one silane compound represented by the following formula (II). In formula (I), at least one of $R^{01}$, $R^{02}$ and $R^{03}$ represents a hydroxyl group, and the remaining represent(s) an organic residue selected from $R^0$ and Y in the following formula (II).

$$(R^0)_n Si(Y)_{4-n} \quad \text{(II)}$$

wherein at least one of $R^0$ represents a hydroxyl group, a hydrocarbon group or a heterocyclic group; Y represents a hydrogen atom, a halogen atom, —$OR^1$, —$OCOR^2$ or —$N(R^3)(R^4)$; ($R^1$ and $R^2$ each represents a hydrocarbon group, and $R^3$ and $R^4$, which may be the same or different, each represents a hydrogen atom or a hydrocarbon group); and n represents 0, 1, 2 or 3.

$R^0$ in formula (II) preferably represents, as a hydrocarbon group or a heterocyclic group other than a hydroxyl group, a straight chain or branched alkyl group having from 1 to 12 carbon atoms which may be substituted (e.g. ,methyl, ethyl, propyl, butyl, pentyl, hexyl, heptyl, octyl, nonyl, decyl, dodecyl, etc.; as the substituents of these groups, halogen (chlorine, fluorine, bromine), hydroxyl, thiol, carboxyl, sulfo, cyano, epoxy, —OR' (R' represents methyl, ethyl, propyl, butyl, heptyl, hexyl, octyl, decyl, propenyl, butenyl, hexenyl, octenyl, 2-hydroxyethyl, 3-chloropropyl, 2-cyanoethyl, N,N-dimethylaminoethyl, 2-bromoethyl, 2-(2-methoxyethyl)oxyethyl, 2-methoxycarbonylethyl, 3-carboxypropyl, benzyl, etc.), —OCOR" (R" has the same meaning as R'), —COOR", —COR", —N(R'")(R'") (R'" represents hydrogen or has the same meaning as R', two R" may be the same or different) —NHCONHR", —NHCOOR", —$Si(R")_3$, —CONHR'" and —NHCOR" can be exemplified. A plurality of substituents may be substituted on the alkyl group), a straight chain or branched alkenyl group having from 2 to 12 carbon atoms which may be substituted (e.g., vinyl, propenyl, butenyl, pentenyl, hexenyl, octenyl, decenyl, dodecenyl, etc., as the substituents of these groups, the same groups described above as the substituents of the alkyl group can be exemplified), an aralkyl group having from 7 to 14 carbon atoms which may be substituted (e.g., benzyl, phenethyl, 3-phenylpropyl, naphthylmethyl, 2-naphthylethyl, as the substituents of these groups, the same groups described above as the substituents of the alkyl group can be exemplified, a plurality of substituents may be substituted), an alicyclic group having from 5 to 10 carbon atoms which may be substituted (e g., cyclopentyl, cyclohexyl, 2-cyclohexylethyl, 2-cyclopentylethyl, norbornyl, adamantyl, etc., as the substituents of these groups, the same groups described above as the substituents of the alkyl group can be exemplified, a plurality of substituents may be substituted), an aryl group having from 6 to 12 carbon atoms (e.g., phenyl, naphthyl, as the substituents of these groups, the same groups described above as the substituents of the alkyl group can be exemplified, a plurality of substituents may be substituted), or a heterocyclic group containing at least one atom selected from a nitrogen atom, an oxygen atom and a sulfur atom which may be condensed (e.g., pyran, furan, thiophene, morpholine, pyrrole, thiazole, oxazole, pyridine, piperidine, pyrrolidone, benzothiazole, benzoxazole, quinoline, tetrahydrofuran, etc., each of which may have a substituent, as the substituents of these groups, the same groups described above as the substituents of the alkyl group can be exemplified, a plurality of substituents may be substituted).

Preferably Y represents an —$OR^1$ group, an —$OCOR^2$ group or an —$N(R^3)(R^4)$ group.

In the —$OR^1$ group, $R^1$ represents an aliphatic group having from 1 to 10 carbon atoms which may be substituted (e.g., methyl, ethyl, propyl, butoxy, heptyl, hexyl, pentyl, octyl, nonyl, decyl, propenyl, butenyl, heptenyl, hexenyl, octenyl, decenyl, 2-hydroxyethyl, 2-hydroxypropyl, 2-methoxyethyl, 2-(methoxyethyloxo)ethyl, 2-(N,N-diethylamino)ethyl, 2-methoxypropyl, 2-cyanoethyl, 3-methyloxapropyl, 2-chloroethyl, cyclohexyl, cyclopentyl, cyclooctyl, chlorocyclohexyl, methoxycyclohexyl, benzyl, phenethyl, dimethoxybenzyl, methylbenzyl, bromobenzyl, etc.).

In the —$OCOR^2$ group, $R^2$ represents an aliphatic group having the same meaning as $R^1$ or an aromatic group having from 6 to 12 carbon atoms (as the aromatic group, those described above in the aryl group in R can be exemplified).

In the —$N(R^3)(R^4)$ group, $R^3$ and $R^4$, which may be the same or different, each represents a hydrogen atom or an aliphatic group having from 1 to 10 carbon atoms which may be substituted (e.g., the same groups described in $R^1$ of the —$OR^1$ group can be exemplified).

More preferably the total number of the carbon atoms of $R^3$ and $R^4$ is not more than 16.

As the specific examples of the silane compound represented by formula (II), the following compounds can be exemplified, but the present invention is not limited to these compounds: tetrachlorosilane, tetrabromosilane, tetramethoxysilane, tetraethoxysilane, tetraisopropoxysilane, tetra-n-propylsilane, tetra-t-butoxysilane, tetra-n-butoxysilane, methyltrichlorosilane, methyltribromosilane, methyltrimethoxysilane, methyltriethoxysilane, methyltriisopropoxysilane, methyltri-t-butoxysilane, ethyltrichlorosilane, ethyltribromosilane, ethyltrimethoxysilane, ethyltriethoxysilane, ethyltriisopropoxysilane, ethyltri-t-butoxysilane, n-propyltrichlorosilane, n-propyltribromosilane, n-propyltrimethoxysilane, n-propyltriethoxysilane, n-propyltriisopropoxysilane, n-propyltri-t-butoxysilane, n-hexyltrichlorosilane, n-hexyltribromosilane, n-hexyltrimethoxysilane, n-hexyltriethoxysilane, n-hexyltriisopropoxysilane, n-hexyltri-t-butoxysilane, n-decyltrichlorosilane, n-decyltribromosilane, n-decyltrimethoxysilane, n-decyltriethoxysilane, n-decyltriisopropoxysilane, n-decyltri-t-butoxysilane, n-octadecyltrichlorosilane, n-octadecyltribromosilane, n-octadecyltrimethoxysilane, n-octadecyltriethoxysilane, n-octadecyltriisopropoxysilane, n-octadecyltri-t-butoxysilane, phenyltrichlorosilane, phenyltribromosilane, phenyltrimethoxysilane, phenyltriethoxysilane, phenyltriisopropoxysilane, phenyltri-t-butoxysilane, dimethoxydiethoxysilane, dimethyldichlorosilane, dimethyldibromosilane, dimethyldimethoxysilane, dimethyldiethoxysilane, diphenyldichlorosilane, diphenyldibromosilane, diphenyldimethoxysilane, diphenyldiethoxysilane, phenylmethyldichlorosilane, phenylmethyldibromosilane, phenylmethyldimethoxysilane, phenylmethyldiethoxysilane, triethoxyhydrosilane, tribromohydrosilane, trimethoxyhydrosilane, isopropoxyhydrosilane, tri-t-butoxyhydrosilane, vinyltrichlorosilane, vinyltribromosilane, vinyltrimethoxysilane, vinyltriethoxysilane, vinyltriisopropoxysilane, vinyltri-t-butoxysilane, trifluoropropyltrichlorosilane, trifluoropropyltribromosilane, trifluoropropyltrimethoxysilane, trifluoropropyltriethoxysilane, trifluoropropyltriisopropoxysilane, trifluoropropyltri-t-butoxysilane, γ-glycidoxypropylmethyldimethoxysilane, γ-glycidoxypropylmethyldiethoxysilane, γ-glycidoxypropyltrimethoxysilane, γ-glycidoxypropyltriethoxysilane, γ-glycidoxypropyltriisopropoxysilane, γ-glycidoxypropyltri-t-butoxysilane, γ-methacryloxypropylmethyldimethoxysilane, γ-methacryloxypropylmethyldiethoxysilane, γ-methacryloxypropyltrimethoxysilane, γ-methacryloxypropyltriisopropoxysilane, γ-methacryloxypropyltri-t-butoxysilane, γ-aminopropylmethyldimethoxysilane, γ-aminopropylmethyldiethoxysilane, γ-aminopropyltrimethoxysilane, γ-aminopropyltriethoxysilane, γ-aminopropyltriisopropoxysilane, γ-aminopropyltri-t-butoxysilane, γ-mercaptopropylmethyldimethoxysilane, γ-mercaptopropylmethyldiethoxysilane, γ-mercaptopropyltrimethoxysilane, γ-mercaptopropyltriethoxysilane, γ-mercaptopropyltriisopropoxysilane, γ-mercaptopropyltri-t-butoxysilane, β-(3,4-epoxycyclohexyl) ethyltrimethoxysilane, and β-(3,4-epoxycyclohexyl) ethyltriethoxysilane.

Together with the silane compound represented by formula (II) used for forming the image-recording layer or for forming the inorganic hydrophilic matrix for the hydrophilic layer, metallic compounds, e.g., Ti, Zn, Sn, Zr, Al, etc., capable of conjoining with resins to form a film can be used in combination.

Examples of the metallic compounds for use for this purpose include, e.g., $Ti(OR")_4$ (R" represents methyl, ethyl, propyl, butyl, pentyl, hexyl), $TiCl_4$, $Zn(OR")_2$, $Zn(CH_3COCHCOCH_3)_2$, $Sn(OR")_4$, $Sn(CH_3COCHCOCH_3)_4$, $Sn(OCOR")_4$, $SnCl_4$, $Zr(OR")_4$, $Zr(CH_3COCHCOCH_3)_4$, $Al(OR")_3$, $Al(CH_3COCHCOCH_3)$, etc.

For accelerating hydrolysis and polymerization condensation reaction of the silane compound represented by formula (II) and the above-described metallic compound used in combination, it is preferred to use an acidic catalyst or a basic catalyst together.

As the catalyst, an acidic or basic compound may be used as it is, or may be dissolved in water or a solvent such as alcohol (hereinafter referred to as the acidic catalyst or the basic catalyst). The concentration of the catalyst is not particularly restricted but when the concentration is high, hydrolysis and polymerization condensation reaction are liable to become fast. However, when the basic catalyst in high concentration is used, a precipitate is formed in some cases, therefore, the concentration of the basic catalyst is preferably 1N (calculated in terms of the concentration in an aqueous solution) or less.

The kinds of the acidic catalyst or the basic catalyst are not restricted but when catalysts in high concentration must be used, catalysts constituted from the elements which hardly remain in the catalyst crystal grains after calcination are preferred. Specifically, as the acidic catalysts, hydrogen halide such as hydrochloric acid, carboxylic acids such as nitric acid, sulfuric acid, sulfurous acid, hydrogen sulfide, perchloric acid, hydrogen peroxide, carbonic acid, formic acid and acetic acid, substituted carboxylic acid represented by RCOOH wherein R is substituted with other elements or substituents, and sulfonic acid such as benzenesulfonic acid can be exemplified, and as the basic catalysts, ammoniacal bases such as aqueous ammonia, and amines such as ethylamine and aniline can be exemplified.

As described above, an image-recording layer produced by the sol/gel method is particularly preferably used in the lithographic printing plate precursor according to the present invention. The details of the sol/gel method are described in Sumio Sakuhana, *Sol/Gel Ho no Kagaku* (*Chemistry of Sol/Gel Method*), Agune Shofu-Sha (1988) and Seki Hirashima, *Saishin Sol/Gel Ho ni yoru Kino-Sei Hakumaku Sakusei Gijutsu* (*Producing Technique of Functional Thin Film by the Latest Sol/Gel Method*), Sogo Gijutsu Center (1992).

<Hydrophilic High Molecular Compound>

As the high molecular compounds contained in the image-recording layer of the lithographic printing plate precursor according to the present invention, other than the above synthetic high molecular compounds, organic high molecular compounds having a hydroxyl group can be used for giving appropriate strength as the image-recording layer and superficial hydrophilicity. Specifically, polyvinyl alcohol (PVA), modified PVA such as carboxyl-modified PVA, starch and derivatives thereof, cellulose derivatives such as carboxymethyl cellulose and hydroxyethyl cellulose, casein, gelatin, water-soluble acryl-based copolymers containing water-soluble acryl monomers as main constitutional components such as polyvinyl pyrrolidone, vinyl acetate-crotonic acid copolymer, styrene-maleic acid copolymer, polyacrylic acid and salts thereof, polyacrylamide, acrylic acid, and acrylamide, alginic acid and alkaline metallic salts thereof, alkaline earth metallic salts or ammonium salts, polyacrylic acid, polyacrylate, poly (ethylene oxide), water-soluble resins such as water-soluble urethane resins, water-soluble polyester resins, polyhydroxyethyl acrylate, polyethylene glycol diacrylate-based polymers, and N-vinylcarboxylic acid amide polymers.

As waterproofing agents for crosslinking and curing the above-described organic high molecular compounds having a hydroxyl group, aldehydes such as glyoxal, and melamine-formaldehyde resins, urea-formaldehyde resins, methylol compounds such as N-methylolurea, N-methylolmelamine, and methylolated polyamide resins, active vinyl compounds such as divinyl sulfone and bis(β-hydroxyethylsulfonate), epoxy compounds such as epichlorohydrin, polyethylene glycol diglycidyl ether, polyamide-polyamine-epichlorohydrin adducts, and polyammide epichlorohydrin resins, ester compounds such as monochloroacetate and thioglycolate, polycarboxylic acids such as polyacrylic acid-methyl vinyl ether-maleic acid copolymers, boric acid, titanyl sulfate, inorganic crosslinking agents such as salts of Cu, Al, Sn, V and Cr, and modified polyamide-polyimide resins can be exemplifiefd.

In addition, crosslinking catalysts such as ammonium chloride, a silane coupling agent, a titanate coupling agent can be used in combination.

In the present invention, among the organic high molecular compounds having a hydroxyl group, gelatin is preferably mainly used.

Gelatin is a kind of derived protein and there is no particular limitation on gelatin so long as it is called gelatin produced from collagen, Preferred gelatin is light in color, transparent, tasteless and odorless. Further, photographic gelatin is preferably used because physical properties, such as the viscosity as an aqueous solution, jelly strength of gel, are within a constant range.

The water-resisting property of the image-recording layer of the present invention is improved by using gelatin-hardening compounds in combination to thereby harden the layer.

Well-known gelatin-hardening compounds can be used in the present invention. With respect to gelatin-hardening compounds, e.g., T. H. James, *The Theory of the Photographic Processes*, Chap. 2, Section III, Macmillan Publishing Co., Inc. (1977), and *Research Disclosure*, No. 17643, p. 26 (December, 1970) can be referred to.

As preferred examples of gelatin-hardening compounds, dialdehydes such as succinaldehyde, glutaraldehyde, and adipoaldehyde, diketones (e.g., 2,3-butanedione, 2,5-hexadione, 3-hexene-2,5-dione, 1,2-cyclopentadione, etc.), and active olefin compounds having 2 or more double bonds bonded to electron attractive groups adjacently can be exemplified.

The amount of the gelatin-hardening compound is preferably from 0.5 to 20 weight parts, more preferably from 0.8 to 10 weight parts, per 100 weight parts of the gelatin.

The image-recording layer obtained with this range of the gelatin-hardening compound retains film strength, shows a water resisting property and, at the same time, does not hinder the hydrophilicity of the image-recording layer.

Other Additives to Image-Recording Layer

Besides the above-described metallic compound particles having a photocatalytic property carrying a hydrophilic light/heat convertible dust and hydrophilic medium, the image-recording layer can contain various compounds for the purpose of controlling the degree of hydrophilicity, improving the physical properties of the image-recording layer, improving the mutual dispersibility of the composition constituting the layer, improving coating property, improving printing aptitude, and for the convenience of plate-making work. As such additives, the following compounds can be exemplified.

<Hydrophilic Sol Particles>

The image-recording layer of the lithographic printing plate precursor according to the present invention may contain hydrophilic sol particles besides the above-described light/heat convertible substances, and organic high molecular compounds having a hydroxyl group for controlling hydrophilicity and improving film property.

As the hydrophilic sol particles, although not particularly limited, preferably a silica sol, an alumina sol, an alumina-silica composite sol, titanium oxide, magnesium oxide, magnesium carbonate, and calcium alginate, and these compounds can be used for accelerating hydrophilization and strengthening a sol/gel film, even if they are not light/heat convertible.

More preferred compounds are a silica sol, an alumina sol, an alumina-silica composite sol, a calcium alginate sol, and mixtures of these.

A silica sol has many hydroxyl groups on the surface and the inside constitutes a siloxane bond (—Si—O—Si—). A silica sol is also called a colloidal silica which comprises ultra-super fine silica particles having a particle size of from 1 to 100 nm dispersed in water or polar solvents. A silica sol is specifically described in, supervised by Toshiro Kagami and Akira Hayashi, *Kojundo Silica no Oyo Gijutsu* (*Application Technique of High Purity Silica*), Vol. 3, published by CMC Publishing Co., Ltd. (1991).

An alumina sol is an alumina hydrate (boehmite-based) having a particle size of from 5 to 200 nm, and dispersed in water with the anions in water (e.g., a halide ion such as a fluorine ion and a chlorine ion, and carboxylate anions such as an acetate ion) as the stabilizer.

The above hydrophilic sol particles preferably have an average particle size of from 10 to 50 nm, more preferably from 10 to 40 nm. All of these hydrophilic sol particles are easily commercially available.

When each particle size of hydrophilic sol particles, hydrophilic particles carrying a metallic fine piece and hydrophilic sol particles (hereinafter these are sometimes merely referred to as silica particles) which may be used in combination falls within the above-described range, film strength of the obtained image-recording layer is sufficiently retained, and when the printing plate precursor is irradiated with laser beams and the like to make a printing plate and printing is performed, the printing plate generates no smearing due to ink adhesion to the non-image area, which shows that the hydrophilicity is remarkably excellent.

The ratio of the silica particles which may be used in combination with the hydrophilic particles of the present invention is from 100/0 to 30/70 by weight ratio, preferably from 100/0 to 40/60 by weight ratio.

When hydrophilic particles and hydrophilic sol particles are contained in the image-recording layer, the addition amount in total is from 2 to 95 wt %, preferably from 5 to 85 wt %, more preferably from 5 to 80 wt %, and most preferably from 20 to 60 wt %, based on the solid contents in the image-recording layer.

<Organic High Molecular Compound>

The image-recording layer can contain organic high molecular compounds for controlling the degree of hydrophilicity, increasing the strength of the image-recording and improving the mutual dispersibility of other components in the image-recording layer. Examples of the organic high molecular compounds to be added include, e.g., polyvinyl chloride, polyvinyl acetate, polyvinyl phenol, halogenated polyvinyl phenol, polyvinyl formal, polyvinyl acetal, polyvinyl butyral, polyamide, polyurethane, polyurea, polyimide, polycarbonate, epoxy resin, phenol novolak, condensation resins of resolphenols and aldehyde or ketone, polyvinyl pyrrolidone, polyvinylidene chloride, polystyrene and silicone resins.

Organic high molecular compounds consisting of water emulsions are preferably used in the hydrophilic layers of the present invention. Water emulsion is an aqueous solution of a hydrophobic polymer suspension comprising fine polymer particles and, if necessary, a protective agent for stabilizing the dispersion of the polymer particles dispersed in water.

Specific examples of the water emulsions for use in the present invention include vinyl-system polymer latex (polyacrylate-system, vinyl acetate-system, and ethylene-vinyl acetate-system latexes), conjugated diene-system polymer latexes (methyl methacrylate-butadiene-system, styrene-butadiene-system, acrylonitrile-butadiene-system, chloroprene-system), and polyurethane resins.

When organic high molecular compounds are added to the image-recording layer, the addition amount is from 1 to 20 wt %, preferably from 2 to 10 wt %, based on the solid contents in the image-recording layer.

<Dye and Pigment>

Dyes and pigments can be added to the image-recording layer of the present invention for coloring and discriminating kinds of the plate.

Preferred examples of the dyes include Rhodamine 6G chloride, Rhodamine B chloride, Crystal Violet, Malachite Green oxalate, oxazine 4 perchlorate, quinizarin, 2-(α-naphthyl)-5-phenyloxazole, and coumarin-4. As other dyes, triphenylmethane-series, diphenylmethane-series, oxazine-series, xanthene-series, iminonaphthoquinone-series, azomethine-series, and anthraquinone-series dyes represented by Oil Yellow #101, Oil Yellow #103, Oil Pink #312, Oil Green BG, Oil Blue BOS, Oil Blue #603, Oil Black BY, Oil Black BS, Oil Black T-505 (manufactured by Orient Chemical Industry Co., Ltd.), Victoria Pure Blue, Crystal Violet (C.I. 42555), Methyl Violet (C.I. 42535), Ethyl Violet, Methylene Blue (C.I. 52015), Patent Pure Blue (manufactured by Sumitomo Mikuni Chemical Co., Ltd.), Brilliant Blue, Methyl Green, Erythrithine B, Basic Fuchsine, m-Cresol Purple, Auramine, 4-p-diethylaminophenyliminonaphthoquinone, and cyano-p-diethyl-aminophenyl acetanilide, and the dyes disclosed in JP-A-62-293247 and JP-A-9-179290 can be exemplified.

When the above dyes are added to the image-recording layer, the addition amount is generally about from 0.02 to 10 wt %, preferably about from 0.1 to 5 wt %, based on the solid contents in the image-recording layer.

<Surfactant>

For widening the stability to printing conditions, the image-forming layer of the lithographic printing plate precursor of the present invention can contain the nonionic surfactants disclosed in JP-A-62-251740 and JP-A-3-208514, the cationic surfactants and fluorien-containing surfactants as disclosed in JP-A-2-195356, and the ampholytic surfactants as disclosed in JP-A-59-121044 and JP-A-4-13149, in addition to the above-described nonionic and anionic surfactants.

As specific examples of ampholytic surfactants, alkyldi (aminoethyl) glycine, alkylpolyaminoethyl glycine hydrochloride, 2-alkyl-N-carboxyethyl-N-hydroxyethyl-imidazolinium betaine and N-tetradecyl-N,N-betaine (e.g., Amorgen K (trade name), manufactured by Daiichi Kogyo Seiyaku Co., Ltd.) can be exemplified.

Specific examples of nonionic surfactants include sorbitan tristearate, sorbitan monopalmitate, sorbitan trioleate, stearic acid monoglyceride, and polyoxyethylene-nonylphenyl ether.

Specific examples of cationic surfactants include laurylamine acetate, lauryltrimethylammonium chloride, distearyldimethylammonium chloride, and alkylbenzyldimethylammonium chloride.

The ratio occupied by the above surfactants in the total solid contents in the image-forming layer is preferably from 0.05 to 15 wt %, more preferably from 0.1 to 5 wt %.

According to cases, the image-recording layer may use a fluorine-based surfactant within the above-described addition amount range of surfactant. Specifically, surfactants having a perfluoroalkyl group are preferably used, e.g., anionic surfactants having any of carboxylic acid, sulfonic acid, sulfate and phosphate, cationic surfactants such as aliphatic amine and quaternary ammonium salt, betaine type ampholytic surfactants, and nonionic surfactants such as aliphatic esters of polyoxy compounds, polyalkylene oxide condensation type, and polyethyleneimine condensation type can be exemplified.

Solvent

The coating solution for the image-recording layer is water solvent system and water-soluble solvent is used in combination for uniform liquefaction by inhibiting precipitation during preparation of the coating solution. Examples of water-soluble solvents include alcohols (e.g., methanol, ethanol, propyl alcohol, ethylene glycol, diethylene glycol, propylene glycol, dipropylene glycol, ethylene glycol monomethyl ether, propylene glycol monomethyl ether, ethylene glycol monoethyl ether, etc.), ethers (e.g., tetrahydrofuran, ethylene glycol dimethyl ether, propylene glycol dimethyl ether, tetrahydropyran, etc.), ketones (e.g., acetone, methyl ethyl ketone, acetylacetone, etc.), esters (e.g., methyl acetate, ethylene glycol monomethyl monoacetate, etc.), and amides (e.g., formamide, N-methylformamide, pyrrolidone, N-methylpyrrolidone, etc.), and the solvent may be used alone or two or more solvents may be used in combination.

These solvents may be used alone or two or more solvents may be used in combination. When the coating solution is prepared, the concentration of the above-described constitutional components of the image-forming layer (all the solid contents including additives) in the solvent is preferably from 1 to 50 wt %.

Coating

The coating solution prepared by mixing the above-described constitutional components is coated on a support by any of the well-known coating methods and dried, thus a plate precursor is obtained.

The coating method can be selected from the following well-known methods, e.g., bar coater coating, rotary coating, spray coating, curtain coating, dip coating, air knife coating, plate coating, roll coating, etc.

The image-forming layer of the lithographic printing plate precursor according to the present invention can contain surfactants, e.g., the above-described various kinds of surfactants and the fluorine surfactants disclosed in JP-A-62-170950 for improving coating property. The addition amount of the surfactant is preferably from 0.01 to 1 wt %, more preferably from 0.05 to 0.5 wt %, based on the total solid contents in the image-recording layer.

The dry coating amount of the image-forming layer (solid content) is varied according to the purpose but in the general lithographic printing plate precursor, it is from 0.1 to 30 $g/M^2$, preferably from 0.3 to 10 $g/m^2$, more preferably from 0.5 to 5.0 $g/m^2$, and most preferably from 0.5 to 2.0 $g/m^2$.

Since the surface of the lithographic printing plate precursor according to the present invention is hydrophilic, it is liable to be affected by the environmental atmosphere and becomes hydrophobic during handling before use, to be influenced by temperature and humidity, or susceptible to mechanical scratches and staining. In general, protective work is performed by coating a plate burning conditioner (also called a gumming solution) on the plate in the plate-making process. If a protective solution is coated on the plate at the producing stage of the printing plate precursor, protective function can be obtained from immediately after production and the time for coating a plate burning conditioner at plate-making stage can be saved, thus the workability is improved. This is very effective for the hydrophilic surfaces of the printing plate precursor of the present invention.

Accordingly, in the preferred embodiment of the present invention, a water-soluble surface protective layer is provided on the image-recording layer as described above. The content of the surface protective layer is the same as the plate burning conditioner (a gumming solution). The details will be described later in the item of the coating solution as "a surface-finishing solution".

Support

A substrate (i.e., a support) on which a coating solution for the image-recording layer is coated will be described below.

Substrates which can be used in the present invention are plate-like materials having dimensional stability, and examples of substrates include paper, paper laminated with plastics (e.g., polyethylene, polypropylene, polystyrene), a metal plate (e.g., aluminum, zinc, copper, nickel, stainless steel), a plastic film (e.g., cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonate, polyvinyl acetal, etc.), and paper or a plastic film laminated or deposited with the above metals.

Preferred substrates are a polyester film, aluminum, an SUS plate not liable to be corrosive on a printing plate. Of these materials, an aluminum plate is particularly preferred because it is dimensionally stable and relatively inexpensive.

Preferred aluminum plates are a pure aluminum plate and an aluminum alloy plate comprising aluminum as a main component and a trace amount of different elements. A plastic film laminated or deposited with aluminum may also be used. Different elements which may be contained in aluminum alloy are silicon, iron, manganese, copper, magnesium, chromium, zinc, bismuth, nickel, titanium, etc. The content of different elements in the aluminum alloy is at most 10% by weight. Particularly preferred aluminum for use in the present invention are pure aluminum but 100% pure aluminum is difficult to produce from the refining technique, accordingly an extremely small amount of different elements may be contained. The composition of aluminum plates used in the present invention are not specified as described above, and conventionally well-known and commonly used aluminum materials can be used arbitrarily. A substrate for use in the present invention has a thickness of from about 0.05 to about 0.6 mm, and preferably from 0.1 to 0.4 mm, and particularly preferably from 0.15 to 0.3 mm.

Prior to surface roughening of an aluminum plate, if desired, degreasing treatment for removing the rolling oil on the surface of the plate is conducted using a surfactant, an organic solvent or an alkaline aqueous solution, for example.

Surface roughening treatment of an aluminum plate may be or may not be performed. Surface roughening treatment of an aluminum plate can be performed by various methods, e.g., mechanical roughening, electrochemical roughening by dissolving the surface, and chemical roughening by selectively dissolving the surface. As mechanical roughening, well-known methods, e.g., a ball rubbing method, a brush abrading method, a blasting method, or a buffing method, can be used. As chemical roughening, a method of roughening the surface by immersing an aluminum plate in a saturated aqueous solution of the aluminum salt of an inorganic acid as disclosed in JP-A-54-31187 is suitably used. As electrochemical roughening, a method of roughening the surface in a hydrochloric acid or nitric acid electrolyte by alternating current or direct current can be used. Further, electrolytic surface roughening using mixed acids can be used as disclosed in JP-A-54-63902.

Of these surface roughening methods, a roughening method using mechanical roughening and electrochemical roughening in combination as disclosed in JP-A-55-137993 is preferably used because the adhesion of a sensitizing image to a support is strong.

These roughening treatments are preferably performed so that the central surface roughness (Ha) of an aluminum plate becomes from 0.3 to 1.0 $\mu$m.

The thus surface-roughened aluminum plate is, if required, subjected to alkali etching treatment with an aqueous solution of potassium hydroxide or sodium hydroxide and neutralizing treatment and then to anodizing treatment to obtain desired water retentivity and abrasion resistance of the surface.

Various electrolytes for forming porous oxide film can be used in the anodizing treatment of an aluminum plate and, in general, sulfuric acid, hydrochloric acid, oxalic acid, chromic acid and mixed acids of these are used. The concentration of these electrolytes are arbitrarily determined according to the kinds of electrolytes.

Anodizing treatment conditions vary according to electrolytes used but in general appropriately the concentration of electrolyte is from 1 to 80 wt % solution, the liquid temperature is from5 to 70° C., the electric current density is from 5 to 60 A/dm$^2$, the voltage is from 1 to 100 V, electrolytic time is from 10 seconds to 5 minutes.

The amount of the film formed is preferably from 1.0 to 5.0 g/m$^2$, particularly preferably from 1.5 to 4.0 g/m$^2$. If the amount of the anodic oxide film is less than 1.0 g/m$^2$, the press life becomes insufficient.

Of these anodizing treatments, the method of anodizing in sulfuric acid at high electric current density disclosed in British Patent 1,412,768 and the method of anodizing with phosphoric acid as electrolytic bath disclosed in U.S. Pat. No. 3,511,661 are preferred.

The aluminum plate preferably roughened and anodized may be subjected to hydrophilizing treatment, if necessary. As preferred examples, there are a method of treatment using alkali metal silicate, e.g., an aqueous solution of sodium silicate disclosed in U.S. Pat. Nos. 2,714,066 and 3,181,461, a method of using potassium zirconate fluoride disclosed in JP-B-36-22063 (the term "JP-B" as used herein means an "examined Japanese patent publication"), and a method of treatment using polyvinyl sulfonate disclosed in U.S. Pat. No. 4,153,461. In many cases, the background smearing can be prevented by hydrophilizing treatment.

An aluminum plate and an SUS plate are provided with an organic undercoating layer before coating a photosensitive layer, according to necessity. As organic compounds for use in the organic undercoating layer, e.g., phosphonic acids having an amino group such as carboxymethyl cellulose, dextrin, gum arabic, and 2-aminoethylphosphonic acid, organic phosphonic acids such as phenylphosphonic acid, naphthylphosphonic acid, alkylphosphonic acid, glycerophosphonic acid, methylenediphosphonic acid, and ethylenediphosphonic acid each of which may have a substituent, organic phosphoric acids such as phenyl phosphoric acid, naphthyl phosphoric acid, alkyl phosphoric acid, and glycerophosphoric acid each of which may have a substituent, organic phosphinic acid such as phenylphosphinic acid, naphthylphosphinic acid, alkylphosphinic acid, and glycerophosphinic acid which may have a substituent, amino acids such as glycine and β-alanine, and hydrochloride of amine having a hydroxyl group such as hydrochloride of triethanolamine can be exemplified, these organic compounds may be used in combination of two or more.

These organic undercoating layers are provided by following methods. That is the above organic compounds are dissolved in water or in an organic solvent, e.g., methanol, ethanol, methyl ethyl ketone, or mixture of these organic solvents, the obtained solution is coated on an aluminum plate and dried, or the above organic compounds are dissolved in water or in an organic solvent, e.g., methanol, ethanol, methyl ethyl ketone, or mixture of these organic solvents, an aluminum plate is immersed in the solution to make organic compounds adsorb onto the plate, then washed with water and the like and dried to thereby obtain an organic undercoating layer. In the former method, the solution of the above organic compounds in concentration of from 0.005 to 10 wt % can be coated in various methods. For example, any of bar coater coating, rotary coating, spray coating, curtain coating can be used. Further, in the latter method, the concentration of the solution is from 0.01 to 20 wt %, preferably from 0.05 to 5 wt %, the immersion temperature is from 20 to 90° C., preferably from 25 to 50° C., and the immersion time is from 0.1 second to 20 minutes, preferably from 2 seconds to 1 minute.

The pH of the solution is adjusted with basic substances such as ammonia, triethylamine and potassium hydroxide or acidic substances such as hydrochloric acid and phosphoric acid. pH range maybe from 1 to 12. A yellow dye can be added to the solution for improving the tone reproducibility of photosensitive lithographic printing plates.

The dry coating weight of the organic undercoating layer is generally from 2 to 200 mg/M$^2$, preferably from 5 to 100 mg/m$^2$. When the coating weight is less than 2 mg/m$^2$, sufficient press life cannot be obtained, while when it is ore than 200 mg/m$^2$, the situation is the same.

For securing contact adhesion between the support and the image-recording layer, an undercoating solution containing a silane coupling agent, or in some cases a titanium coupling agent, may be coated on the surface of the support. Silane coupling agents are generally represented by formula $(RO)_3SiR'$ (R and R' each represents an alkyl group), RO group is hydrolyzed and becomes OH group, and is bonded to the surface of the support by ether bonding, while the adhesion of R' group to the medium of the image-recording layer is improved through hydrolysis and ether bonding.

Examples of silane coupling agents include γ-chloropropyltrimethoxysilane, vinyltrichlorosilane, vinyltriethoxysilane, vinyltris(β-methoxyethoxy)silane, γ-methacryloxypropyltrimethoxysilane, γ-glycosidoxypropyltrimethoxysilane, γ-mercaptopropyltrimethoxysilane, γ-aminopropyltriethoxysilane, γ-ureidopropyltriethoxysilane, and N-(β-aminoethyl)-(β-aminopropyl)dimethoxysilane.

For securing adhesion with the image-recording layer, the plastic support is subjected to well-known electrostatic charge treatment before coating.

Other Layers

If necessary, aback-coating layer is provided on the back surface of the support. With respect to such back-coat layers, the organic high molecular compounds disclosed in JP-A-5-45885, and the coating layer comprising a metallic oxide obtained by hydrolysis and polymerization condensation disclosed in JP-A-6-35174 are preferably used in the present invention.

Of these coating layers, alkoxyl compounds of silicon such as $Si(OCH_3)_4$, $Si(OC_2H_5)_4$, $Si(OC_3H_7)_4$, and $Si(OC_4H_9)_4$ are available inexpensively and the coating layer of these metallic oxides are excellent in hydrophilicity.

Plate-Making Method

The plate-making method of this lithographic printing plate precursor will be described below. This lithographic printing plate precursor can be applied to direct imagewise heat-sensitive recording by means of a thermal recording head, etc., and light/heat converting type exposure such as a solid state laser or a semiconductor laser emitting infrared ray of the wavelength of from 760 to 1,200 nm, high intensity flash light such as a xenon electric discharge lamp, and infrared lamp exposure.

Writing of images may be any of exposure system and scanning system. The former case is infrared ray irradiation system, or the system of irradiating the plate precursor with xenon electric discharge lamp of high illumination intensity for a short time period and generating heat by light/heat conversion. When a face exposure light source such as an infrared lamp is used, preferred exposure amount varies by the illumination intensity but generally face exposure intensity before being modulated by images for printing is preferably from 0.1 to 10 $J/cm^2$ more preferably from 0.1 to 1 $J/cm^2$. When a transparent support is used, exposure can be effected from the back side of the support through the support. It is preferred to select illumination intensity of exposure so as to reach the above exposure intensity with the irradiation time of from 0.01 to 1 msec, preferably from 0.01 to 0.1 msec. When irradiation time is long, it is necessary to increase exposure intensity in the light of the competitive relationship between the generating rate of heat energy and diffusing rate of the generated heat energy.

In the latter case, scanning is performed on the printing plate precursor using laser light sources containing a large amount of infrared ray components with modulating the laser beams by printing image. Examples of laser light sources include a semiconductor laser, a helium-neon laser, a helium-cadmium laser, and a YAG laser. A laser light source having laser output of from 0.1 to 300 W can be used for irradiation. When a pulse laser is used, it is preferred to perform irradiation with laser beams having peak output of 1,000 W, preferably 2,000 W. In this case, exposure amount is preferably in face exposure intensity before modulation by printing image of from 0.1 to 10 $J/cm^2$, preferably from 0.3 to 1 $J/cm^2$. When a transparent support is used, exposure can be effected from the back side of the support through the support.

When plate-making of a lithographic printing plate is performed, if necessary, a process called gumming is carried out after image exposure for protecting the non-image area by coating a plate surface protecting solution (so-called gumming solution) on the plate surface. Gumming is performed for various purposes, e.g., for preventing the deterioration of the hydrophilicity of the hydrophilic surface of the lithographic printing plate by the influence of a small amount of contaminants in the air, for increasing the hydrophilicity of the non-image area, for preventing the deterioration of the lithographic printing plate during the time after plate-making until printing, or after interrupting printing until resumption, for preventing the non-image area from becoming ink-receptive and smearing due to adhesion of oils transferred from fingers and ink during handling in the case of loading the plate onto the printing machine, further for preventing scratches from generating on the non-image area and the image area during handling.

As preferred examples of the water-soluble resins having a film-forming property for use in the present invention, e.g., gum arabic, cellulose derivatives (e.g., carboxymethyl cellulose, carboxyethyl cellulose, methyl cellulose, etc.), and modified products thereof, polyvinyl alcohol and derivatives thereof, polyvinyl pyrrolidone, polyacrylamide and copolymers thereof, acrylic acid copolymers, vinylmethyl ether-maleic anhydride copolymers, vinyl acetate-maleic anhydride copolymers, styrene-maleic anhydride copolymers, calcined dextrin, acid-decomposed dextrin, and acid-decomposed etherified dextrin can be exemplified.

The content of the above-described water-soluble resins in the protective agent in the surface-finishing solution is generally from 3 to 25 wt %, preferably from 10 to 25 wt %.

In the present invention, the above-described water-soluble resins may be used in mixture of two or more.

A plate surface protective agent for a lithographic printing plate may contain various surfactants besides the above. Anionic surfactants and nonionic surfactants can be used. Examples of anionic surfactants include aliphatic alcohol sulfates, tartaric acid, malic acid, lactic acid, levulinic acid, and organic sulfonic acid, and as inorganic acids, nitric acid, sulfuric acid, and phosphoric acid are useful. At least two or more of inorganic acids, organic acids and inorganic salts may be used in combination.

In addition to the above, if necessary, lower polyhydric alcohols such as glycerol, ethylene glycol, and triethylene glycol can be used as a wetting agent. The content of these wetting agents in a protective agent is from 0.1 to 5.0 wt %, preferably from 0.5 to 3.0 wt %. Besides the above-described compounds, a plate surface protective agent for a lithographic printing plate according to the present invention can contain preservatives, e. g., benzoic acid and derivatives thereof, phenol, formaldehyde, sodium dehydroacetate, etc., in an amount of from 0.005 2.0 wt %.

A defoaming agent may be added to a plate surface protective agent. Organic silicone compounds are preferably used as a defoaming agent and the addition amount is preferably from 0.0001 to 0.1 wt %.

For preventing the sensitivity reduction of the image area, a plate surface protective agent may contain an organic solvent. Preferred organic solvents are water-soluble and petroleum fractions having a boiling point of from about 120 to about 250° C., and plasticizers having a freezing point of 15° C. or less and a boiling point of 300° C. or more, e.g., dibutyl phthalate and dioctyl adipate can be exemplified. Such organic solvent is added in an amount of from 0.05 to 5 wt %.

A plate surface protective agent may take any form of a homogeneous solution type, a suspension type and emulsion type, and the emulsion type containing the above organic solvents exhibits excellent performance. In this case, it is preferred to contain a surfactant in combination as disclosed in JP-A-55-105581.

A printing plate precursor which has been subjected to image exposure and water development after development and, if necessary, gumming treatment, can be loaded on a printing machine and printing can be immediately performed. Further, a printing plate precursor can be installed on a printing machine immediately after exposure and printing can be performed without going through development. Alternatively, after installing a printing plate precursor on a printing machine, a printing plate can be formed on the machine by performing imagewise scanning exposure with laser beams. That is, in the plate-making method using the lithographic printing plate precursor according to the present invention, a lithographic printing plate can be made without going through development.

For exhibiting the effect of the present invention, it is necessary that the image-recording layer containing light/heat convertible substances should have light-absorbing property of necessary level to effectively cause light/heat conversion action, i.e., particle density. The light-absorbing property of necessary level means to have spectral absorption region of absorbance of 0.3 or more in the light/heat convertible spectral wavelength region of from 300 to 1,200 nm, specifically means to have absorption maximum of absorbance of 0.3 or more in the wavelength region of the irradiation light for image-forming (in the case of short wavelength, the wavelength region of 100 nm width with the wavelength as the center), or means that continuous spectral absorption wavelength region of 100 nm or more of absorbance of 0.3 or more is present even when the absorption maximum is not present in this wavelength region.

Further, the transmission density of an image-forming layer is preferably from 0.3 to 3.0 measured based upon the International Standardization Organization IS05-3 and IS05-4. If the transmission density exceeds 3.0, the intensity of radiant rays at the bottom part of the image-recording layer markedly reduces due to the attenuation of radiant rays, as a result, the conversion to hydrophobicity is difficult to occur. While when it is 0.3 or less, radiant ray energy is not sufficiently absorbed, as a result, the heat energy obtained by light/heat conversion is often insufficient.

EXAMPLE

The present invention will be illustrated in more detail with reference to examples below, but these are not to be construed as limiting the invention.

Example I

(1) Preparation of Substrate

A rolled plate having a thickness of 0.24 mm of aluminum defined in JIS-A-1050 containing 99.5% by weight of aluminum, 0.01% by weight of copper, 0.03% by weight of titanium, 0.3% by weight of iron, and 0.1% by weight of silicon was surface-grained using a 20% by weight aqueous suspension of 400 mesh pumicestone powder (manufactured by Kyoritsu Yogyo K.K.) and a rotary nylon brush (6,10-nylon), and then the plate was thoroughly washed with water.

The plate was immersed in a 15% by weight aqueous solution of sodium hydroxide (containing 4.5% by weight of aluminum) and etched so as to reach the dissolving amount of aluminum of 5 g/m$^2$, then washed with flowing water, and further neutralized with 1% by weight nitric acid. Subsequently, the plate was subjected to electrolytic roughening treatment in a 0.7% by weight aqueous nitric acid solution (containing 0.5% by weight of aluminum) using rectangular alternating wave form voltage (electric current ratio r=0.90, electric current wave form disclosed in JP-B-58-5796) of the anode time voltage of 10.5 V and the cathode time voltage of 9.3 V, with the quantity of electricity of the anode time of 160 coulomb/dm. After washing with water, the plate was immersed in a 10% by weight aqueous solution of sodium hydroxide at 35° C. and etched so as to reach the dissolving amount of aluminum of 1 g/m$^2{}_1$ and then washed with water. The plate was immersed in a 30% by weight aqueous sulfuric acid solution at 50° C., desmutted, and washed with water.

Further, the plate was subjected to porous anodized oxidation film-forming treatment in a 20% by weight aqueous sulfuric acid solution (containing 0.8% by weight of aluminum) at 35° C. using direct current. That is, electrolysis was conducted at electric current density of 13 A/dm$^2$ and 2.7 g/m$^2$ of anodized oxidation film weight was obtained by controlling the electrolysis time.

This substrate was washed with water, immersed in a 3% by weight aqueous solution of sodium silicate at 70° C. for 30 seconds, washed and dried.

The reflection density of the thus-obtained aluminum substrate measured by Macbeth RD920 reflection densitometer was 0.30, and the central line average roughness was 0.58 $\mu$m.

(2) Preparation of Hydrophobitization Precursor

Seven kinds of hydrophobitization precursors according to the present invention shown below and three kinds of hydrophobitization precursors out of the present invention were prepared.

<Precursor A: Composite Particle 1 Having Hetero Coagulation Surface Layer>

Into a three neck flask were added 70 g of styrene, 30 g of trimethoxysilylpropyl methacrylate, 200 g of water, and 10 g of surfactant XL-102F (manufactured by Lion Co., Ltd. (a 4.7% aq. soln.)), and the temperature was raised to 80° C. while introducing nitrogen. Thereafter, the content of the flask was stirred for about 30 minutes, then 1 g of $K_2S_2O_8$ was added thereto and emulsification polymerization was conducted at 80° C. for 6 hours, thus resin particles having particle sizes of about 0.1 $\mu$m were obtained. Further, 30 g of Snowtex C (manufactured by Nissan Chemical Industries, Ltd.) was added to the above resin particle dispersion solution and made silica sol particles hetero-coagulate on the surfaces of the resin particles. Thus composite particle 1 having a particle size of 0.15 $\mu$m and having hetero-coagulated hydrophilic surface layer whose core comprised resin and shell comprised silica layer was produced.

<Precursor B: Composite Particle 2 Having Hetero Coagulation Surface Layer>

Into a three neck flask were added 60 g of styrene, 10 g of divinylbenzene, 30 g of trimethoxysilylpropyl methacrylate, 200 g of water, and 10 g of surfactant XL-102F (manufactured by Lion Co., Ltd. (a 4.7% aq. soln.)), and the temperature was raised to 80° C. while introducing nitrogen. Thereafter, the content of the flask was stirred for about 30 minutes, then 1 g of $K_2S_2O_8$ was added thereto and emulsification polymerization was conducted at 80° C. for 6 hours, thus resin particles having particle sizes of about 0.2 $\mu$m were obtained. Further, 30 g of Snowtex C (manufactured by Nissan Chemical Industries, Ltd.) was added to the above resin particle dispersion solution and made silica sol particles hetero-coagulate on the surfaces of the resin particles. Thus composite particle 2 having a particle size of 0.25 $\mu$m and having hetero-coagulated hydrophilic surface layer whose core comprised resin and shell comprised silica layer was produced.

<Precursor C: Composite Particle 3 Having Hetero Coagulation Surface Layer>

Into a three neck flask were added 70 g of styrene, 30 g of trimethoxysilylpropyl methacrylate, 200 g of water, and 10 g of surfactant XL-102F (manufactured by Lion Co., Ltd. (a 4.7% aq. soln.)), and the temperature was raised to 80° C. while introducing nitrogen. Thereafter, the content of the flask was stirred for about 30 minutes, then 1 g of $K_2S_2O_8$ was added thereto and emulsification polymerization was conducted at 80° C. for 6 hours, thus resin particles having particle sizes of about 0.1 $\mu$m were obtained. Further, 30 g of alumina sol (manufactured by Nissan Chemical Industries, Ltd.) was added to the above resin particle dispersion solution and made alumina sol particles hetero-coagulate on the surfaces of the resin particles. Thus composite particle 3 having a particle size of 0.15 μm and having hetero-coagulated hydrophilic surface layer whose core comprised resin and shell comprised alumina layer was produced.

<Precursor D: Composite Particle 1 Having Hetero Phase Surface>

Into a three neck flask were added 70 g of styrene, 30 g of trimethoxysilylpropyl methacrylate, 200 g of water, and 10 g of surfactant XL-102F (manufactured by Lion Co., Ltd. (a 4.7% aq. soln.)), and the temperature was raised to 80° C. while introducing nitrogen. Thereafter, the content of the flask was stirred for about 30 minutes, then 1 g of $K_2S_2O_8$ was added thereto and emulsification polymerization was conducted at 80° C. for 6 hours, thus resin particles having particle sizes of about 0.1 μm were obtained. Further, 30 g of tetraethoxysilane (manufactured by Shin-Etsu Chemical Co., Ltd.) was added to the above resin particle dispersion solution, sol/gel reaction was performed at room temperature, thereby the surfaces of resin particles were coated with silica. Thus composite particle 1 having a particle size of 0.15 μm and having a hydrophilic gel surface layer was produced.

<Precursor E: Composite Particle 2 Having Hetero Phase Surface>

Into a three neck flask were added 60 g of styrene, 10 g of divinylbenzene, 30 g of hydroxyethyl methacrylate, 200 g of water, and 10 g of surfactant XL-102F (manufactured by Lion Co., Ltd. (a 4.7% aq. soln.)), and the temperature was raised to 80° C. while introducing nitrogen. Thereafter, the content of the flask was stirred for about 30 minutes, then 1 g of $K_2S_2O_8$ was added thereto and emulsification polymerization was conducted, thus resin particles having particle sizes of about 0.2 μm were obtained. Further, 30 g of tetraethoxysilane (manufactured by Shin-Etsu Chemical Co., Ltd.) was added to the above resin particle dispersion solution, sol/gel reaction was performed at room temperature, thereby the surfaces of resin particles were coated with silica. Thus composite particle 2 having a particle size of 0.25 μm and having a hydrophilic gel surface layer was produced.

<Precursor F: Core/Shell Particle 1>

Into a three neck flask were added 80 g of styrene, 10 g of divinylbenzene, 10 g of Macromonomer AA-6 (dispersant, manufactured by Toa Gosei Co., Ltd.), and 400 g of MEK, and the temperature was raised to 75° C. while introducing nitrogen. Thereafter, the content of the flask was stirred for about 30 minutes, then 2 g of azoisobutyronitrile was added thereto and dispersion polymerization was conducted at 75° C. for 6 hours, thus resin particles having particle sizes of 0.2 μm were obtained. Further, the temperature of the resin particle dispersion solution was raised to 75° C. while introducing nitrogen. After stirring the dispersion solution for about 30 minutes, 35 g of acrylamide, 4 g of methylenebisacrylamide, and 1 g of azoisobutyronitrile were dissolved in 100 g of MEK and this solution was dropwise added to the flask over 2 hours, and then the reaction solution was seed dispersion polymerized for 3 hours. Thus core/shell particle 1 whose core comprised crosslinked styrene and shell comprised acrylamide and having a particle size of 0.3 μm was produced.

<Precursor G: Core/Shell Particle 2>

Into a three neck flask were added 80 g of styrene, 10 g of divinylbenzene, 10 g of Macromonomer AA-6 (dispersant, manufactured by Toa Gosei Co., Ltd.), and 400 g of MEK, and the temperature was raised to 75° C. while introducing nitrogen. Thereafter, the content of the flask was stirred for about 30 minutes, then 2 g of azoisobutyronitrile was added thereto and dispersion polymerization was conducted at 75° C. for 6 hours, thus resin particles having particle sizes of 0.2 μm were obtained. Further, the temperature of the resin particle dispersion solution was raised to 75° C. while introducing nitrogen. After stirring the dispersion solution for about 30 minutes, 35 g of acrylic acid, 4 g of ethylene glycol diacrylate, and 1 g of azoisobutyronitrile were dissolved in 100 g of MEK and this solution was dropwise added to the flask over 2 hours, and then the reaction solution was seed dispersion polymerized for 3 hours. Thus core/shell particle 2 whose core comprised crosslinked styrene and shell comprised acrylamide and having a particle size of 0.3 μn was produced. pH of the core/shell particle 2 was adjusted to 10 or more with sodium hydroxide, thus core/shell particles in which the carboxyl group of the acrylic acid was converted to sodium salt were obtained.

<Precursor H: Microencapsulated Particle 1>

Ethyl acetate 19.0 parts (hereinafter parts means parts by weight), 5.9 parts of isopropylphenyl, 5 parts of glycerol laurate and 2.5 parts of tricresyl phosphate were heated and mixed homogeneously. As the capsule wall material (hydrophobitization precursor), 7.6 parts of xylene diisocyanate-trimethylolpropane adduct (a 75% ethyl acetate solution, Takenate D110N, manufactured by Takeda Chemical Industries, Ltd.) was added to the above-obtained solution and stirred homogeneously. Separately, 2.0 parts of a 10 wt % aqueous solution of sodium dodecylsulfonate was added to 64 parts of a 6 wt % aqueous gelatin solution (MGP-9066, manufactured by Nippi Gelatin Industry Co., Ltd.) and emulsified with a homogenizer.

To the obtained emulsified solution was added 20 parts of water to make the solution homogeneous, and the temperature of the solution was raised to 40° C. with stirring and capsulation reaction was performed for 3 hours. The temperature of the solution was then lowered to 35° C., and 6.5 parts of ion exchange resin Amberlite IRA68 (manufactured by Organo Co., Ltd.), and 13 parts of Amberlite IRC50 (manufactured by Organo Co., Ltd.) were added to the above solution and the content was stirred for 1 hour. Then, the ion exchange resins were filtered to obtain the objective capsule solution. The average particle size of the capsules was 0.64 μm, which was designated microencapsulated particle 1.

<Hydrophobic Resin Particle Dispersion 1 for Comparative Example 1>

Into a three neck flask were added 80 g of styrene, 10 g of divinylbenzene, 10 g of Macromonomer AA-6 (dispersant, manufactured by Toa Gosei Co., Ltd.), and 400 g of MEK, and the temperature was raised to 75° C. while introducing nitrogen. Thereafter, the content of the flask was stirred for about 30 minutes, then 2 g of azoisobutyronitrile was added thereto and dispersion polymerization was conducted at 75° C. for 6 hours, thus resin particles having particle sizes of 0.2 μm were obtained.

<Hydrophilic Resin Particle Dispersion 1 for Comparative Example 2>

Dispersion of dispersion polymerization particle of polyvinyl pyrrolidone (average particle size: 0.2 μm) was used.

(3) Preparation of Light/Heat Converting Agent

Surface hydrophilization treated iron oxide, copper oxide, manganese oxide, metallic iron, tianium black and carbon black particles, which are shown in Table 1, were used as light/heat convertible solid particles. The surface hydrophilization treatment was conducted according to the method described in the item of light/heat converting agent. Hydroxyl groups were added to the surfaces of the carbon black by aqueous vapor treatment as described above, then surface silica film was formed with tetraethoxysilane. The titanium black particles were hydrophilic in themselves. Exemplified compound (1) was used as hydrophilic IR dye.

<Preparation of Light/Heat Converting Agent for Comparative Examples 3 and 4 and Comparative Example 5>

In Comparative Example 3, the above carbon black particles which were not treated for surface hydrophilization were used. In Comparative Example 4, a hydrophobic infrared absorbing dye having bisindolenine structure shown below was dispersed and used. In Comparative Example 5, a coating solution was prepared without using a light/heat converting agent.

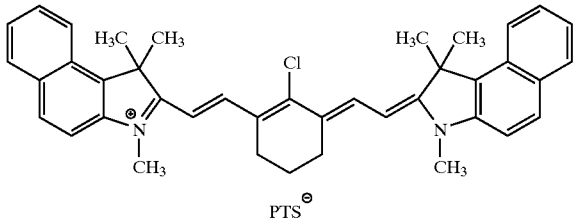

(4) Coating of Image-Recording Layer

<Preparation of Tetramethoxysilane Dispersion Solution>

As sol/gel convertible component, a dispersion solution according to the following prescription (A) (sol/gel solution (A)) containing tetramethoxysilane was prepared. Silicon tetramethoxide, ethanol, pure water, nitric acid were mixed in this order, stirred at room temperature for 1 hour to obtain sol/gel solution (A).

Prescription of Sol/Gel Solution (A)

Silicon tetramethoxide 18.37 g

Ethanol (95%) 32.56 g

Pure water 32.56 g

Nitric acid 0.02 g

<Preparation of Coating Solution for Image-Recording Layer>

Coating Solutions for Examples 1 to 14 and Comparative Examples 1 to 5

Dispersion solutions of 19 kinds of Examples 1 to 14 and Comparative Examples 1 to 5 were prepared as coating solutions for image-recording layers. Sol/gel solution (A) and light/heat converting agents and hydrophobitization precursors were combined by changing the kinds as shown in Table 1. Each dispersion solution was prepared by adding 10 g of glass beads to the following shown mixture and stirring the mixture with a paint shaker for 10 minutes.

Coating Solution for Image-Recording Layer

Light/heat converting agent (Table 1) 2.17 g

Hydrophobitization precursor (Table 1) 2.17 g

Sol/gel solution (A) 3.34 g

PVA117 (10% aq. soln.) 3.50 g

Colloidal silica R503 (20% aq. soln.) 6.0 g

Pure water 7.49 g

<Coating>

Image-recording layer coating solution was coated on the above aluminum plate by bar coating with #14 bar in a dry thickness of 2.0 μm, then the plate was put in an air oven and dried at 100° C. for 10 minutes to thereby obtain an image-recording layer.

(5) Preparation of Printing Plate

<Preparation of Printing Plate and Printing>

Each of the thus-obtained lithographic printing plate precursors 1 to 8 was irradiated with semiconductor laser beam of wavelength of 830 nm.

Laser irradiation conditions are shown below.

Laser output: 350 mW

Beam radius: 12.5 μm

Scanning speed: 1.7 m/sec

Output: 700 mJ/cm$^2$

The precursor exposed with laser beam was loaded on a printing machine and printing was performed without any post-treatment. The degree of printing smearing (i.e., printing staining) was visually evaluated when 10,000 sheets and 20,000 sheets were printed respectively.

Heidelberg SOR-M printing machine was used. As fountain solution, an aqueous solution obtained by adding 1 vol % of EU-3 (manufactured by Fuji Photo Film Co., Ltd.) and 10 vol % of IPA to water was used, ink was GEOS (N) black.

(6) Evaluation of Printing Plate Precursor and Method of Evaluation

Evaluation of the finished printing plate precursor was as follows.

<Evaluation of Printing Smearing>

When 10,000 sheets were printed, printing smearing of the printed face was visually observed. The case where no smearing was observed was evaluated as o, and the case where smearing was observed was evaluated as x. When no smearing was observed, further 10,000 sheets were printed, and the case where smearing was not observed was evaluated as ⊙. The results obtained are shown in Table 1.

TABLE 1

| Sample | Light/Heat Converting Agent (μm) | Hydrophobitization Precursor | Printing Quality |
|---|---|---|---|
| Example 1 | Particles of iron oxide ($Fe_3O_4$) treated with silicate (0.1) | Precursor A | ○ |
| Example 2 | Particles of iron oxide ($Fe_3O_4$) treated with silicate (0.1) | Precursor B | ○ |
| Example 3 | Particles of iron oxide ($Fe_3O_4$) treated with silicate (0.1) | Precursor C | ○ |
| Example 4 | Particles of iron oxide ($Fe_3O_4$) treated with silicate (0.1) | Precursor D | ⊙ |
| Example 5 | Particles of iron oxide ($Fe_3O_4$) treated with silicate (0.1) | Precursor E | ⊙ |
| Example 6 | Particles of iron oxide ($Fe_3O_4$) treated with silicate (0.1) | Precursor F | ○ |
| Example 7 | Particles of iron oxide ($Fe_3O_4$) treated with silicate (0.1) | Precursor G | ○ |
| Example 8 | Particles of iron oxide ($Fe_3O_4$) treated with silicate (0.1) | Precursor H | ○ |
| Comparative Example 1 | Particles of iron oxide ($Fe_3O_4$) treated with silicate (0.1) | Polystyrene particles | x |
| Comparative Example 2 | Particles of iron oxide ($Fe_3O_4$) treated with silicate (0.1) | Polyvinyl pyrrolidone particles | x |
| Example 9 | Fine particles of metallic iron coated with alumina (0.1) | Precursor D | ○ |

TABLE 1-continued

| Sample | Light/Heat Converting Agent (μm) | Hydrophobitization Precursor | Printing Quality |
|---|---|---|---|
| Example 10 | Fine particles of carbon black coated with silica (0.03) | Precursor D | ○ |
| Example 11 | Fine particles of titanium black ($TiO_x$) (0.1) | Precursor D | ○ |
| Example 12 | Particles of manganese oxide ($Mo_3O_4$) treated with silicate (0.05) | Precursor D | ○ |
| Example 13 | Particles of copper oxide (CuO) treated with silicate (0.05) | Precursor D | ○ |
| Example 14 | Hydrophilic IR dye (Compound 16) | Precursor D | ○ |
| Comparative Example 3 | Carbon black fine particles (0.03) | Precursor D | x |
| Comparative Example 4 | Hydrophobic IR dye | Precursor D | x |
| Comparative Example 5 | Light/heat converting agent was not added | Precursor D | x |

(Note) Note with respect to Table 1

1. $TiO_x$ (x=1.0 to 1.1): commercially available product, hydrophilic
2. Printing quality: When printing was impossible, it was evaluated as x, even if smearing was not observed.
3. Precursors A to H are as follows (described in the specification)

Precursor A: Composite particle 1 having hetero coagulation surface layer

Precursor B: Composite particle 2 having hetero coagulation surface layer

Precursor C: Composite particle 3 having hetero coagulation surface layer

Precursor D: Composite particle 1 having hetero phase surface

Precursor E: Composite particle 2 having hetero phase surface

Precursor F: Core/shell particle 1

Precursor G: Core/shell particle 2

Precursor H: Microencapsulated particle 1

(7) Results

As is shown in Table 1, any of samples containing hydrophobitization precursors comprising hetero-coagulation particles in Examples 1 to 8, particles having hetero-gel phase surfaces, particles having hydrophilic shell resin layer or composite composition having microcapsule wall material of hydrophilic surface layer generated no smearing even after 10, 000 sheets or more were printed. In particular, samples in Examples 4 and 5 using core/shell type resin particles comprising hydrophilic shell part and hydrophobic core part did not generate printing smearing even after 20,000 sheets or more were printed and that having excellent printing life was improved. On the other hand, sample in Comparative Example 1 using polystyrene particles without surface hydrophilizing treatment generated smearing on the non-image area. In sample in Comparative Example 2 using hydrophilic polyvinyl pyrrolidone particles, ink did not adhere to the image area, as a result, printing was not effected (evaluation x in Table 1 shows the impossibility of printing).

Any of samples in Examples 9 to 14 of the present invention in which light/heat converting agents hydrophilic in themselves or subjected to hydrophilizing treatment were used, although the materials of the light/heat converting agents were different such as iron oxide, metallic iron, carbon black, titanium black, manganese oxide, copper oxide, and hydrophilic dye, did not generate printing smearing after 10,000 sheets or more were printed and showed excellent press life. On the other hand, in Comparative Examples 3 and 4, where carbon black fine particles or hydrophobic infrared absorbing dye were used without surface hydrophilizing treatment, printing smearing was generated on the non-image area. In Comparative Example 5, where light/heat converting agent was not used, ink did not adhere to the image area, as a result, printing was not effected (evaluation x in Table 1 shows the impossibility of printing).

Printing plate precursors having an image-recording layer comprising a hydrophilic medium having dispersed therein a light/heat converting agent which itself is hydrophilic or a light/heat converting agent having hydrophilic surfaces and a hydrophobitization precursor having hydrophilic surfaces show excellent printing performance such as high discriminating property of the image area and the non-image area, and excellent press life hardly generating printing smearing. In addition, the present invention can provide a lithographic printing plate precursor by which a printing plate can be made directly from digital data by performing recording with a solid laser or a semiconductor laser emitting infrared rays.

Example II-1

Preparation of Aluminum Support

The surface of an aluminum plate having a thickness of 0.24 mm (JIS-A-1050) was surface-grained using a nylon brush and an aqueous suspension of 400 mesh pumicestone powder, and the plate was thoroughly washed with water. The plate was then immersed in a 10% aqueous solution of sodium hydroxide at 70° C. for 60 seconds and etching was performed, and then washed with flowing water. The plate was neutralized with a 20% aqueous solution of nitric acid and washed with water. Subsequently, the plate was subjected to electrolytic roughening treatment in a 1% aqueous nitric acid solution containing 0.5% of aluminum nitrate using rectangular alternating wave form current (conditions: anode time voltage: 12.7 V, ratio of the quantity of electricity of the cathode time to the quantity of electricity of the anode time: 0.9, the quantity of electricity of the anode time: 160 coulomb/$dm^2$). The surface roughness of the obtained plate was 0.6 μm (Ra). Following the above treatment, the plate was immersed in a 1% aqueous solution of sodium hydroxide at 40° C. for 30 seconds, then in a 30% aqueous solution of sulfuric acid at 55° C. for 1 minute to effect treatment. Thereafter, the plate was subjected to anodic oxidation treatment in a 20% aqueous solution of sulfuric acid using direct current at electric current density of 2 A/$dm^2$ so as to obtain 2.5 g/$dm^2$ of the film thickness. The plate was washed with water and dried, thereby a support was prepared.

Preparation of Image-Recording Layer

The water system coating solution having the composition shown below was dispersed for 10 minutes with a paint shaker. The obtained coating solution was coated on the above-prepared aluminum support with a bar coater, the plate was dried in an oven at 100° C. for 10 minutes. The dry film weight of the hydrophilic layer was 3.0 g/$m^2$.

Titanium oxide powder (rutile type, 1.5 g
average particle size: 0.2 μm,
manufactured by Wako Pure Chemical Industries Ltd.)

PVA117 (10% aq. soln., manufactured by Kurare Co., Ltd.) 3.5 g

20% Aqueous solution of silica gel 6.0 g dispersion

Sol/gel adjusting solution 7.2 g

Water 26.4 g

The sol/gel adjusting solution used here has the following composition.

Sol/Gel Adjusting Solution (room temperature, ripening for 1 hour)

Tetramethoxysilane 11.0 g

Ethanol 20.7 g 0.1N Nitric acid 4.5 g

Precipitation of Metallic Fine Piece

The thus-prepared printing plate precursor was immersed in an aqueous solution of 1N silver nitrate, and then the entire surface was irradiated with 100 W high pressure mercury lamp through a Pyrex filter for 2 minutes to precipitate a black metallic silver fine piece on the surface of the titanium oxide. The contact angle with water droplet of the surface of the thus-prepared printing plate showed extended wetting (i.e., spreading wetting), that is, the hydrophilicity of the surface was remarkably high.

Imagewise Exposure

When the printing plate was subjected to exposure using PEARL setter 74 (manufactured by Presstek Co., Ltd.) as a laser beam scanning exposure apparatus, the surface of the exposed area converted to the state fused with a silver film. The contact angle with water droplet of the surface of the irradiated area of this printing plate was 50° and the surface was converted to a surface of high hydrophobicity.

Printing

Printing was performed using RYOBI-3200MCD printing machine. As fountain solution, an aqueous solution of 1 vol % of EU-3 (manufactured by Fuji Photo Film Co., Ltd.) was used, and ink was GEOS (N) black. After 10 sheets were printed from the start, an excellent printed matter was obtained, adhesion of ink at the dot part and the solid part was uniform and smearing was not observed at the non-image area. Fifty thousand (50,000) sheets were further printed and high quality printed matters having no smearing were obtained.

Example II-2

In this example, different medium from that in Example II-1 was used as the medium of the image-recording layer. A lithographic printing plate precursor was prepared in the same manner as in Example II-1 except the sol/gel convertible substance in Example II-1 was replaced with the medium having the composition shown below. The dry film weight of the hydrophilic layer having the following composition was 3.0 g/m$^2$.

Titanium oxide powder (rutile type, 1.7 g average particle size: 0.2 $\mu$m, manufactured by Wako Pure Chemical Industries Ltd.)

PVA117 (10% aq. soln., manufactured by 10.1 g Kurare Co., Ltd.)

20% Aqueous solution of silica gel 6.0 g dispersion

Glyoxal 0.8 g

Aqueous solution of 0.1N silver nitrate 8.4 g

Surfactant K* (5% aq. soln.) 0.3 g

Water 13.7 g

* Surfactant K: Polyethylene glycol-p-nonylphenyl ether (average number of ethyleneoxy group: 8.5)

The thus-prepared printing plate precursor was irradiated with 100 W high pressure mercury lamp through a Pyrex filter for 2 minutes to precipitate a black metallic silver fine piece on the surface of the titanium oxide. The contact angle with water droplet of the surface of the image-recording layer containing the titanium oxide carrying the silver fine piece showed extended wetting, i.e., the hydrophilicity of the surface was remarkably high. The printing plate surface was subjected to exposure using PEARL setter 74 (manufactured by Presstek Co., Ltd.) as a scanning exposure apparatus. The contact angle with water droplet of the surface of the fused metal layer was 50°, which was the same with the result in Example II-1.

Similarly to Example II-1, excellent printed matters of 50,000 sheets having no printing smearing were obtained.

Example II-3

In this example, different light/heat convertible metallic compound particles were used. A printing plate was prepared in the same manner as in Example II-1 except the zinc oxide powder (average particle size: 0.15 $\mu$m) was used in place of the titanium compound in Example II-1. When printing was performed in the same manner as in Example II-1, printed matters of 50,000 sheets of high quality having no printing smearing were obtained.

Example II-4

In this example, a photocatalytic metallic compound carrying a metallic dust in advance was used. The reaction solution having the following composition was prepared. The reaction solution was irradiated with 100 W high pressure mercury lamp through a Pyrex filter for 30 minutes with thoroughly stirring. The reaction solution was filtered, washed with water and dried. Colored particles of titanium oxide, on the surface of which was deposited silver fine piece of the metallic silver, were obtained with high yield.

Composition of Reaction Solution

Titanium oxide powder (anatase type, 30.0 g average particle size: 0.15 $\mu$m, manufactured by Wako Pure Chemical Industries Ltd.)

Aqueous solution of 0.1N silver nitrate 34.5 g

Methanol 265.5 g

Using the thus-prepared titanium oxide particles carrying the metallic silver fine piece, the water system coating solution having the following composition was prepared by dispersing the composition with a paint shaker for 10 minutes. The obtained coating solution was coated on the corona discharged PET support having a thickness of 180 $\mu$m using a bar coater in a dry coating amount of 22.5 ml/m$^2$, and the plate was dried in an oven at 100° C. for 10 minutes. The dry film weight of the hydrophilic layer was 3.0 g/m$^2$.

Titanium oxide particles carrying 1.5 g the above metallic silver fine piece

PVA117 (10% aq. soln., manufactured by 3.5 g Kurare Co., Ltd.)

20% Aqueous solution of silica gel 6.0 g dispersion

Sol/gel adjusting solution 7.2 g

Water 26.4 g

The sol/gel adjusting solution used here has the following composition.

Sol/Gel Adjusting Solution
(room temperature, ripening for 1 hour)

Tetramethoxysilane 11.0 g

Ethanol 20.7 g 0.1N Nitric acid 4.5 g

Imagewise exposure was performed in the same manner as in Example II-1. Both irradiated part and non-irradiated part showed the same contact angle with water droplet as in Example II-1. Printing was performed using this printing plate precursor in the same manner as in Example II-1. The same results as in Example II-1 were obtained.

Example II-5

This example shows that the printing plate precursor can be produced by precipitating a metallic fine piece from the state of a coating solution containing a metallic salt in the step of making a printing plate precursor. The coating solution for a hydrophilic layer prepared in Example II-2 was irradiated with 100 W high pressure mercury lamp through a Pyrex filter for 5 minutes to precipitate a dark brown metallic silver on the surface of the titanium oxide. The coating solution was coated on a support in dry film weight of 3.0 g/m$^2$, and the plate was dried in an oven at 100° C. for 10 minutes, thereby a lithographic printing plate was obtained. The reflective optical density of this printing plate was 1.12. The contact angle with water droplet of the surface showed extended wetting, i.e., the hydrophilicity of the surface was remarkably high. When printing was performed in the same manner as in Example II-1, printed matters of 10,000 sheets of high quality having no printing smearing were obtained.

Example II-6

In this example, a sparingly water-soluble metallic compound was used.

Preparation of Image-Recording Layer

The water system coating solution having the composition shown below was dispersed for 10 minutes with a paint shaker. The obtained coating solution was coated on the same aluminum support as used in Example II-1 with a bar coater, the plate was dried in an oven at 100° C. for 10 minutes. The dry film weight of the hydrophilic layer was 3.0 g/m$^2$.

Silica particles (Silysia 310 1.5 g average particle size: 1.4 $\mu$m, manufactured by Fuji Silysia Chemical Co., Ltd.)

PVA117 (10% aq. soln., manufactured by 3.5 g Kurare Co., Ltd.)

Sol/gel adjusting solution 7.2 g

Water 26.4 g

The sol/gel adjusting solution used here has the following composition.

Sol/Gel Adjusting Solution
(room temperature, ripening for 1 hour)

Aminopropyltriethoxysilane 11.0 g

Ethanol 20.7 g 0.1N Nitric acid 4.5 g

Precipitation of Metallic Fine Piece

The thus-produced printing plate precursor was immersed in a 1N silver nitrate aqueous solution for 30 seconds and then taken out. Subsequently, the precursor was immersed in an aqueous solution containing 1% formaldehyde and 0.2% sodium hydroxide for 30 seconds. The precursor was taken out and again immersed in a 1N silver nitrate aqueous solution for 30 seconds and then taken out. Subsequently, the precursor was again immersed in an aqueous solution containing 1% formaldehyde and 0.2% sodium hydroxide for 30 seconds.

A black metallic silver fine piece was precipitated on the surface of the silica-containing image-recording layer by this procedure. The contact angle with water droplet of the surface of the thus-produced printing plate showed extended wetting, i.e., the hydrophilicity of the surface was remarkably high.

Imagewise Exposure

When the printing plate was subjected to exposure using PEARL setter 74 (manufactured by Presstek Co., Ltd.) as a laser beam scanning exposure apparatus, the surface of the exposed area converted to the fused state. The contact angle with water droplet of the surface of the irradiated area of this printing plate was 500 and the surface was converted to a surface of high hydrophobicity.

Printing

Printing was performed using RYOBI-3200MCD printing machine. As fountain solution, an aqueous solution of 1 vol % of EU-3 (manufactured by Fuji Photo Film Co., Ltd.) was used, and ink was GEOS (N) black. After 10 sheets were printed from the start, an excellent printed matter was obtained, adhesion of ink at the dot part and the solid part was uniform and smearing was not observed at the non-image area. Fifty thousand (50,000) sheets were further printed and high quality printed matters having no smearing were obtained.

Example II-7

A lithographic printing plate precursor was prepared in the same manner as in Example II-6 except that the printing plate precursor was immersed in an aqueous solution of silver nitrate (1 mol) containing 24 mol of ammonium hydroxide and 1 mol of glucose at 45° C. for 2 minutes and then washed and dried in place of immersing the plate precursor in a 1N silver nitrate aqueous solution and an aqueous solution containing 1% formaldehyde and 0.2% sodium hydroxide alternately. The plate precursor was subjected to imagewise exposure to make a printing plate and printing was performed. The same results as in Example II-6 were obtained.

Example II-8

A lithographic printing plate precursor was prepared in the same manner as in Example II-6 except that the printing plate precursor was immersed in a copper-ammonia complex salt aqueous solution (1 mol) having the composition shown below and aqueous solution of reducing agent (a) at 35° C. alternately each for 30 seconds and then washed and dried in place of immersing the plate precursor in a 1N silver nitrate aqueous solution and an aqueous solution containing 1% formaldehyde and 0.2% sodium hydroxide alternately. The plate precursor was subjected to imagewise exposure to make a printing plate and printing was performed. The same results as in Example II-6 were obtained.

Copper Ammonia Complex Salt Aqueous Solution

Copper sulfate (0.1 mol) was dissolved in 800 ml of water, 1 mol of ammonium sulfate was added thereto, the pH was adjusted to 11 with a 28% aqueous ammonia and water was added to make the volume 1 liter.

Aqueous Solution of Reducing Agent (a)

Potato starch (50 g) and 60 g of potassium hydroxide were dissolved in 800 ml of water, and water was added to make the volume 1 liter, thus aqueous solution of reducing agent (a) was obtained.

Example II-9

A lithographic printing plate precursor was prepared in the same manner as in Example II-6 except that in place of using silica particles as hardly water-soluble metallic compound particles, the same amount of tin oxide particles (an 8% aqueous dispersion solution, Seramase S-8, manufactured by Taki Chemical Co., Ltd.) was used. The plate precursor was subjected to imagewise exposure to make a printing plate and printing was performed. The same results as in Example II-6 were obtained.

Example II-10

A paper support for black-and-white photographic paper having a baryta undercoating layer was immersed in an aqueous solution of silver nitrate (1 mol/liter) containing ammonium hydroxide (24 mol/liter) and glucose (1 mol/liter) at 45° C. for 5 minutes, washed and dried, thereby a black plate precursor was prepared. Silver fine piece was precipitated on the surfaces of the baryta particles. The plate precursor was subjected to imagewise exposure in the same manner as in Example II-6 to make a printing plate and printing was performed. Printed matters of 1,000 sheets of high quality having little printing smearing were obtained.

Example II-11

The water system coating solution having the composition shown below was dispersed for 10 minutes with a paint shaker, then 0.16 g of a 0.2% aqueous glyoxal solution was added thereto to obtain a black coating solution containing silica particles having a metallic silver fine piece precipitated on the surfaces. The obtained coating solution was coated on the same aluminum support as used in Example II-1 with a bar coater, the plate was dried in an oven at 145° C. for 5 minutes. The dry film weight of the hydrophilic layer was 4.0 g/m$^2$.

Silica particles (Silysia 310 1.5 g average particle size: 1.4 $\mu$m, manufactured by Fuji Silysia Chemical Co., Ltd.)

10% Aqueous solution of polyacrylic acid 3.5 g

10% Aqueous solution of tetraethylene glycol 0.7 g diglycidyl ether

Aqueous solution of 0.1N silver nitrate 0.1 g

Water 7.1 g

The contact angle with water droplet of the surface of the thus-produced printing plate precursor showed extended wetting, i.e., the hydrophilicity of the surface was remarkably high. This plate precursor was subjected to imagewise exposure to make a printing plate and printing was performed. The same results as in Example II-6 were obtained.

Example II-12

A lithographic printing plate precursor was prepared in the same manner as in Example II-11 except that titanium oxide sol STS-01 (manufactured by Ishihara Sangyo Kaisha Ltd.) was used i n place of silica particles. The plate precursor was subjected to imagewise exposure to make a printing plate and printing was performed. The same results as in Example II-11 were obtained.

The method for producing a negative type heat mode lithographic printing plate according to the present invention from a printing plate precursor having a hydrophilic surface carrying a light/heat convertible metallic dust by imagewise exposure, thereby the irradiated area of which is made hydrophobic and a fast ink-receptive surface, and a method for printing using this printing plate show excellent printing performance such as high discriminating property of the image area and the non-image area, and excellent press life hardly generating printing smearing. In addition, the present invention can provide a lithographic printing plate precursor by which a printing plate can be made directly from digital data by performing recording with a solid state laser or a semiconductor laser emitting infrared rays.

While the invention has been described in detail and with reference to specific examples thereof, it will be apparent to one skilled in the art that various changes and modifications can be made therein without departing from the spirit and scope thereof.

What is claimed is:

1. A lithographic printing plate precursor which comprises a support having provided thereon a layer comprising a hydrophilic medium, wherein the layer comprising the hydrophilic medium contains a hydrophobitization precursor having a hydrophilic surface which is at least one dispersion of particles selected from the group consisting of a dispersion of particles having a composition constitution containing a hydrophilic hydrophobic substance at a core part and having a superficial hydrophilicity at a surface part wherein heat provides hydrophobicity in the vicinity of the particles and a dispersion of particles having a hydrophilic surface and being heat-cross-linkable wherein said cross-linking provides hydrophobicity; and a hydrophilic dye having a light/heat converting property having in a molecule at least one water-soluble group selected from the group consisting of a sulfonic acid group, a carboxyl group, and a phosphonic acid group, or a solid fine particle having a light/heat converting property which has been subjected to surface-hydrophilization treatment wherein upon imagewise irradiation, the imaged portions of the hydrophilic layer are converted to hydrophobic so as to accept printing ink.

2. The lithographic printing plate precursor as claimed in claim 1, wherein the layer comprising a hydrophilic medium is sol/gel convertible.

3. The lithographic printing plate precursor as claimed in claim 1, wherein the hydrophobitization precursor having a hydrophilic surface is a particle dispersion of composite constitution containing a hydrophobic substance at the core part and having a surface layer of superficial hydrophilicity.

4. The lithographic printing plate precursor as claimed in claim 1, wherein the layer contains a solid fine particle selected from the group consisting of a metal, a metallic compound, a pigment and a carbon simple substance each having a hydrophilic surface or a hydrophilic dye which is soluble in a hydrophilic medium.

5. The lithographic printing plate precursor as claimed in claim 1, wherein the printing plate precursor is provided with a water-soluble protective layer.

6. A method of lithographic printing which comprises imagewise irradiating the lithographic printing plate precursor claimed in claim 1 with light/heat convertible visible rays or infrared rays, bringing the irradiated part into contact with an ink to make the image area accept the ink to form a printing plate surface, and performing printing.

* * * * *